US006357418B1

(12) United States Patent
Uemura et al.

(10) Patent No.: US 6,357,418 B1
(45) Date of Patent: Mar. 19, 2002

(54) INTERNAL COMBUSTION ENGINE CONTROL SYSTEM AND APPARATUS THEREFOR

(75) Inventors: Kiyoshi Uemura; Narutoshi Aoki, both of Numazu (JP)

(73) Assignee: Kokusan Denki Co., Ltd., Shizuoka-Ken (JP)

( * ) Notice: Subject to any disclaimer, the term of this patent is extended or adjusted under 35 U.S.C. 154(b) by 0 days.

(21) Appl. No.: 09/634,308

(22) Filed: Aug. 8, 2000

(51) Int. Cl.[7] ..... F02P 5/145
(52) U.S. Cl. ..... 123/406.58; 123/406.62
(58) Field of Search ..... 123/406.58, 406.62

(56) References Cited

U.S. PATENT DOCUMENTS 4,414,946 A * 11/1983 Daumer et al. ..... 123/406.62
5,243,947 A 9/1993 Yamamoto et al.
5,343,842 A * 9/1994 Fukui ..... 123/406.62
5,509,389 A 4/1996 Oshima et al.
5,671,714 A * 9/1997 Fukui et al. ..... 123/406.62
6,016,789 A * 1/2000 Denz et al. ..... 123/406.62

FOREIGN PATENT DOCUMENTS

JP 6-249120 9/1994
JP 10-141193 5/1998

* cited by examiner

*Primary Examiner*—Erick Solis
(74) *Attorney, Agent, or Firm*—Pearne & Gordon LLP

(57) ABSTRACT

An internal combustion engine control system comprising the steps of supplying a reference position detection pulse and a low revolution ignition position detection pulse generated by a single pulser coil of a crank shaft sensor at a reference position of each of cylinders and a low revolution ignition position thereof through respective waveform shaping circuits to a CPU of an electronic control unit and controlling the internal combustion engine so that all the cylinders are simultaneously ignited at an extreme low revolution area where it cannot be judged which of the cylinders each of the pulses generated by the crank shaft sensor corresponds to when the crank shaft sensor generates every reference position detection pulse near a top dead center in a compression stroke of each of the cylinders.

14 Claims, 19 Drawing Sheets

CRANK ANGLE θ
720°CA
AFTER REFERENCE JUDGEMENT
BEFORE REFERENCE JUDGEMENT
360°CA
180°CA
60°CA
BT5°
BT65°
#3

Fig. 3F #1
Fig. 3G #3
Fig. 3H #4
Fig. 3I #2
Fig. 3J #1,4
Fig. 3K #2,3
Fig. 3L #1
Fig. 3M #3
Fig. 3N #4
Fig. 3O #2
COM
EXP
EXH
INT

Fig. 12A

INTERRUPTION ROUTINE OF IGNITION TIMER FOR FIRST INJECTOR INJECTION TIMER

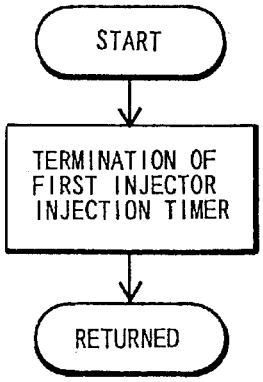

Fig. 12B

INTERRUPTION ROUTINE OF IGNITION TIMER FOR THIRD INJECTOR INJECTION TIMER

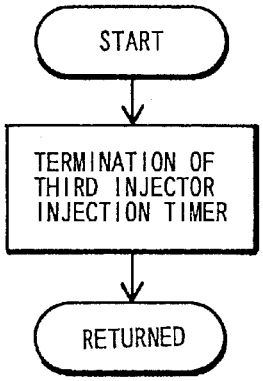

Fig. 12C

INTERRUPTION ROUTINE OF IGNITION TIMER FOR FOURTH INJECTOR INJECTION TIMER

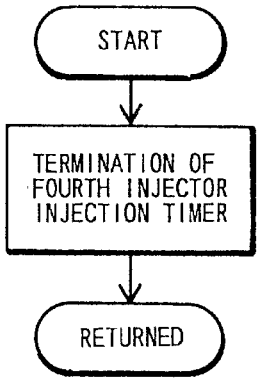

Fig. 12D

INTERRUPTION ROUTINE OF IGNITION TIMER FOR SECOND INJECTOR INJECTION TIMER

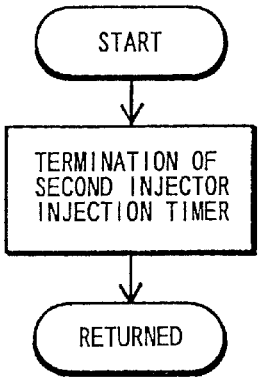

Fig. 15A

INTERRUPTION ROUTINE OF CONDUCTION TIMER FOR FIRST CYLINDER IGNITION COIL

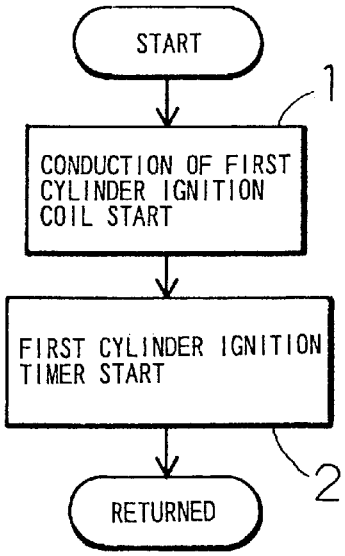

Fig. 15B

INTERRUPTION ROUTINE OF CONDUCTION TIMER FOR SECOND CYLINDER IGNITION COIL

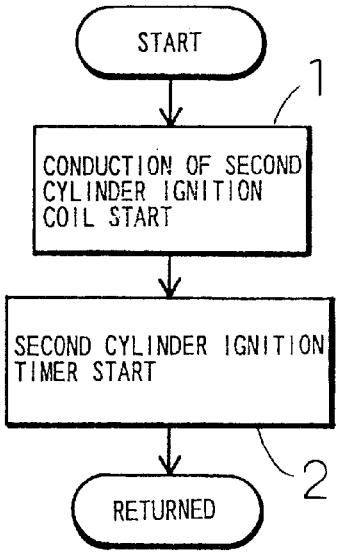

Fig. 15C

INTERRUPTION ROUTINE OF CONDUCTION TIMER FOR THIRD CYLINDER IGNITION COIL

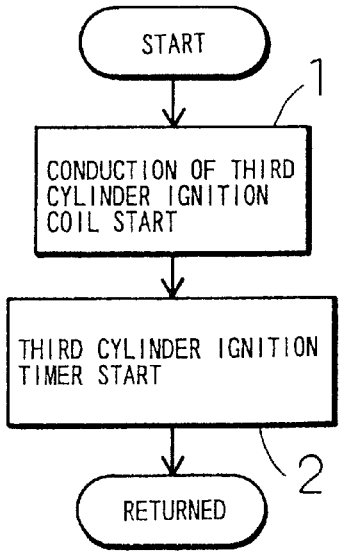

INTERRUPTION ROUTINE OF THREE CYLINDER BT65° CA

Prior Art

Prior Art

INTERNAL COMBUSTION ENGINE CONTROL SYSTEM AND APPARATUS THEREFOR

TECHNICAL FIELD OF THE INVENTION

This invention pertains to an internal combustion engine control system adapted to control an ignition system or a fuel injection system for a four cycle internal combustion engine by means of an electronic control unit using a microcomputer and also pertains to an apparatus for practicing the system.

BACKGROUND OF THE INVENTION

A four cycle internal combustion engine comprises a plurality of cylinders, a crank shaft rotationally driven by pistons moving in the cylinders, respectively, a cam shaft driving an air supply valve and an exhaust valve rotated in synchronization with the crank shaft at half a revolution rate of the crank shaft and an ignition system to ignite each of the cylinders in accordance with ignition signals therefor whereby a combustion cycle of four strokes including an explosion stroke, an exhaust stroke, an intake or suction stroke and a compression stroke is repeated to rotate the crank shaft thereby.

In order to sufficiently draw an output power out of the four cycle internal combustion engine, improve on fuel consumption and enhance purification of the exhaust gas, an ignition position of the internal combustion engine (a rotary angle position of the crank shaft at which an ignition operation is made) and a supply amount of fuel are required to be controlled in a highly precise manner in accordance with various control conditions such as a revolution rate (r.p.m) of the engine.

To this end, the latest four cycle internal combustion engine comprises a fuel injection system including an injector (an electro-magnetic fuel injection valve) provided for the respective cylinders, a fuel pump to supply a fuel to the injector and an injector drive circuit to supply a drive current to the injector and also a contactless ignition system whereby an electronic control unit (ECU) including a microcomputer controls the fuel injector system and the ignition system.

The injector for the fuel injection system comprises an injector body having a fuel injection port at a leading end thereof, a solenoid (an electromagnet) disposed within the injector body and a valve adapted to open the fuel injection port while the predetermined drive current is supplied to the solenoid whereby the fuel is supplied from the fuel pump to the injector body under predetermined pressure. The injector is mounted on an intake pipe of the engine, for example and serves to inject the fuel through the fuel injection port by opening the valve while the drive current is supplied to the solenoid from the injector drive circuit. The fuel injected within the intake pipe is combined with air entering the intake pipe through a throttle valve and supplied within the cylinders when intake valves thereof are opened.

Although an injection amount of the fuel from the injector is based on the product of the time during which the valve is opened and the fuel pressure provided by the fuel pump, it is generally determined on the injection time (a signal width of an injection instruction signal) because the fuel pressure is kept constant by a pressure regulator. Accordingly, in the internal combustion engine in which the fuel is supplied by the fuel injection system, the amount of the fuel supplied to the engine has been controlled by adjusting the signal width of the injection instruction signal.

In case that the fuel is injected into the intake pipe of the four cycle internal combustion engine, it is generally known that the fuel is desirably injected over the exhaust stroke and the intake stroke of the engine for precisely controlling the fuel consumption and the component of the exhaust gas. Accordingly, a position where the injection instruction signal is supplied to the injector drive circuit (a position where the fuel injection starts) should be set at a proper position within a scope of the rotary angle of the crank shaft corresponding to the exhaust stroke.

The contactless ignition system for igniting the internal combustion engine comprises an ignition plug mounted on each of the cylinders of the engine, an ignition coil having a secondary coil connected to the ignition plug for each of the respective cylinders and an ignition drive circuit to give an abrupt change in a primary current of the ignition coil in accordance with the ignition signals for the respective cylinders for inducing an igniting high voltage across the secondary coil of the ignition coil at the ignition position of the internal combustion engine (the rotary angle position of the crank shaft).

In general, the ignition coil is provided for every cylinder of the internal combustion engine, but one ignition coil is provided for a set of two cylinders having their ignition positions provided in a manner far away to each other at an crank angle of 360° in some internal combustion engines having an even number of cylinders such as two or four cylinders. For instance, in the four cycle four cylinder internal combustion engine, the ignition is made in order of the first, third, fourth and second cylinders. In this case, the first and fourth cylinders having the ignition positions far away from each other at the crank angle of 360° are as a first set of cylinders while the second and third cylinders are as another set of cylinders. Thus, there are provided two ignition coils including a first ignition coil for the first and fourth cylinders and a second ignition coil for the second and third cylinders. The secondary coils of the ignition coils have both ends connected to the non-grounding terminals of the ignition plugs for the two corresponding cylinders.

In case that the common one ignition coil is provided for the two cylinders having the ignition position far away from each other at the crank angle of 360°, the coil is referred as to "simultaneous ignition coil", a secondary coil of which induces the igniting high voltage to be applied across the two ignition plugs of the two cylinders. In this case, the ignition operation (the operation of spark discharging the high voltage through the ignition plugs) is simultaneously made in the two cylinders, but in the four cycle internal combustion engine, one of the two cylinders having the ignition positions far away from each other at the crank angle of 360° is at a normal ignition position when another cylinder is at an end of the exhaust stroke where the spark of another cylinder can never contribute to the ignition of the fuel. Thus, it will be noted that the operation of the engine has no trouble even though the two cylinders having the ignition position far away from each other at the crank angle of 360° are simultaneously ignited.

A capacitor discharge type circuit and a current interruption type circuit are known as the ignition drive circuit provided at the primary side of the ignition coil. The capacitor discharge type ignition drive circuit comprises an igniting capacitor provided at the primary side of the ignition coil to be charged at one polarity at a position advanced relative to the ignition position and a primary current controlling switch turned on when the ignition signal is given to discharge the charge of the capacitor through the primary coil of the ignition coil whereby the abrupt change in the primary current of the ignition coil is generated by discharging the igniting capacitor to induce the igniting high voltage.

The current interruption type ignition drive circuit comprises a power source to supply the primary current to the ignition coil and a primary current controlling switch turned on by the ignition signal at the position advanced relative to the ignition position. The ignition drive circuit makes the primary current flow through the ignition coil when it receives the ignition signal and interrupts the primary current controlling switch when the ignition signal is extinguished at the ignition position whereby the igniting high voltage is induced in the secondary coil of the ignition coil. As the current interruption type ignition drive circuit are used a battery type one having a battery used for the power source and a generating coil type one having a generating coil for the power source provided in a magneto generator driven by the internal combustion engine.

The capacitor discharge type ignition drive circuit and the current interruption type ignition drive circuit are different from each other in a process of response to the ignition signal. More particularly, since the capacitor discharge type ignition drive circuit turns on the primary current controlling switch when the ignition signal is received to discharge the igniting capacitor to make the ignition operation, the timing when the ignition signal is generated corresponds to the ignition position, but since the current interruption type ignition drive circuit begins to conduct the primary current into the primary coil when the ignition current is received and interrupts the primary current when the ignition signal is extinguished to make the ignition operation, the timing when the ignition signal is extinguished corresponds to the ignition position.

Although either of the two ignition drive circuits may be used for the internal combustion engine to which the invention should be applied, the current interruption type ignition drive circuit having the battery used for the power source may be used as the ignition drive circuit for many four cycle internal combustion engine. Therefore, the case in which the current interruption type ignition drive circuit having the battery used for the power source is used will be explained later.

In case that the current interruption type ignition drive circuit having the battery used for the power source is used, there should be controlled a conduction start position (a position where the ignition signal is generated) to start the conduction of the primary current through the ignition coil and a conduction end position (a position where the ignition signal is extinguished) to interrupt the primary current.

The electronic control unit may comprise a CPU to arithmetically operates the revolution rate of the engine on the period of occurrence of the pulses generated at the particular rotary angle position of the crank shaft of the engine and to arithmetically operate the aforementioned conduction start position, the conduction end position (the ignition position) and the fuel injection time on the obtained revolution rate and the control conditions detected by various sensors.

The conduction start position is arithmetically operated as a time (a number of clocks to be counted) taken for the crank shaft to rotate to the conduction end position from a reference position of each of the cylinders (a position of 65° prior to the top dead center of the compression stroke) set at the position fully advanced relative to the top dead center in the compression stroke of each of the cylinders (the rotary angle position when the piston of each of the cylinders reaches the top dead center). Similarly, the conduction end position (the ignition position) is arithmetically operated as a time required for the crank shaft to rotate from the conduction start position to the conduction end position.

The electronic control unit starts a conduction timer (a timer to measure the conduction start position by counting clock pulses) for every cylinder when the reference position therefor is detected and begins to measure the arithmetically obtained conduction start position. Also, it starts to inject the fuel from the injector for each of the cylinders when the reference position for each of the cylinders is detected and to start an injection timer (a timer to measure a fuel injection time) to begin to measure the fuel injection time.

When the conduction timer measures the conduction start position, the primary current starts to flow through the ignition coil for each of the cylinders and at the same time an ignition timer (a timer to measure the ignition position by counting the number of clock pulses) start to measure the ignition position. When the ignition timer measures the ignition position, the primary current through the ignition coil for each of the cylinders is interrupted to make the ignition operation of each of the cylinders. Also, when the injection timer completes to measure the fuel injection time, the injection of the fuel from the injector for each of the cylinders stops.

As aforementioned, the electronic control unit requires the informations on the reference position set for each of the cylinders in order to measure the conduction start position for the primary current through the ignition coil and the position where the injection of the fuel from the injector stops.

The ignition position cannot be obtained immediately when the engine should start because it takes time for the ignition position to be arithmetically operated and therefore the startability of the engine cannot be avoided from being deteriorated. Furthermore, since the revolution rate of the engine largely changes due to variation in the strokes of the engine immediately after the engine starts, it is hard to arithmetically operate the ignition position. Accordingly, it is desirable that in order to improve the startability of the engine by starting the ignition operation as soon as the starting operation of the engine begins, the ignition operation is made at the previously set constant position, but not at the ignition position determined by the arithmetical operation. Thus, the electronic control unit requires a signal for detecting the ignition position in the extremely low revolution range of the engine (referred to as "low revolution ignition position" herein just below).

The aforementioned control system is adapted to mount on the crank shaft the crank shaft sensor for generating the pulses having the different polarities at the reference position and the low revolution ignition position for each of the cylinders to apply to the electronic control unit the signals obtained from the crank shaft sensor.

The crank shaft sensor sequentially generates the reference position detection pulse and the low revolution ignition position detection pulse for each of the cylinders, but even though the pulses are input to the electronic control unit, the unit cannot judge for which of the cylinders the input pulses are. Therefore, a cam shaft sensor is mounted on a cam shaft to generate one reference judgement pulse when the cam shaft rotates every one revolution and which of the cylinders a series of signals generated from the crank shaft sensor are for is judged on the reference judgement pulse.

In the four cycle internal combustion engine control system of the prior art, in case that the number of the cylinders of the internal combustion engine is two or four, the pulser coils having half the number of the cylinders are provided on the crank shaft sensor so that the pulses generated by each of the pulser coils at the reference position and the pulses generated by each of the pulser coils at the low revolution ignition position are input through the waveform shaping circuit to the CPU, respectively.

In case that the number of the cylinders is three, three pulser coils are provided so that the pulses generated by each of the pulser coils at the reference position and the pulses generated by each of the pulser coils at the low revolution ignition position are input through the waveform shaping circuit to the CPU, respectively.

In this manner, the prior internal combustion engine control system requires many pulser coils provided on the crank shaft sensor and in addition many waveform shaping circuits provided in the electronic control unit. Thus, the construction of the apparatus is disadvantageously expensive as well as complicated and large-sized.

If the ignition operation is adapted to be not made in the extremely low revolution range where the reference judgement pulse cannot be detected, then the single pulser coil would be desirably provided in the crank shaft sensor, which causes the construction of the apparatus to be simplified. However, if the ignition operation is not made in the extremely low revolution range, the startability of the engine cannot be avoided from being deteriorated because a cranking revolution rate is required to be higher when the engine starts.

In case that a vehicle driven by the internal combustion engine is one having the engine which should be avoided from stopping against the driver's will such as an outerboard engine, a snow-mobile or the like, the engine desirably continues to be driven as much as possible even though a part of the control system is abnormally operated. However, in case that only one pulser coil is provided in the crank shaft sensor, the ignition operation and the fuel injection operation cannot be made when no signal is generated from the cam shaft sensor due to its disconnection so that which of the cylinders the reference position detection pulse is for cannot be judged. This disadvantageously prevents the engine from being effectively operated.

SUMMARY OF THE INVENTION

Accordingly, it is an object of the invention to provide an internal combustion engine control system and an apparatus therefor adapted to make an ignition operation with a single pulser coil provided in a crank shaft sensor even in case that no signal can be detected from a cam shaft sensor whereby the startability of the engine is not deteriorated and the construction of the apparatus is simplified.

It is another object of the invention to provide an internal combustion engine control system and an apparatus therefor adapted to continue to drive the engine even in case that no output can be detected from a cam shaft sensor due to some trouble.

One aspect of the present invention is applied to an internal combustion engine control system to control an ignition system for a four cycle multi-cylinder internal combustion engine.

In the internal combustion engine control system, there are provided a crank shaft sensor mounted on a crank shaft of the internal combustion engine to generate a low revolution ignition position detection signal of pulse wave at a low revolution ignition position of each of cylinders set near a top dead center in a compression stroke of each of the cylinders and to generate a reference position detection pulse at a reference position of each of the cylinders set at a position advanced relative to the low revolution ignition position of each of the cylinders, a cam shaft sensor mounted on a cam shaft of the internal combustion engine to generate a reference judgement pulse at a set rotary angle position of the cam shaft once per one revolution of the cam shaft and ignition position arithmetical operation means to arithmetically operate an ignition position for each of the cylinders on the predetermined control conditions, there are accomplished the step of simultaneously making an ignition operation in all of the cylinders at a position where the crank shaft sensor generates each of low revolution ignition position detection signals under the condition of being unable to detect any reference judgement pulse from the cam shaft sensor, the step of judging which of the cylinders a series of reference position detection pulses are one detecting the reference position for from a generation order of the series of the reference position detection pulses after the reference position detection pulses are generated when the reference judgement pulses is detected and the step of starting a measurement of the ignition position of each of the cylinders arithmetically operated by the ignition position arithmetical operation means at a position where the judged reference position detection pulse for each of the cylinders is generated to make the ignition operation at each of the cylinders when the thus arithmetically operated ignition position for each of the cylinders is measured.

Another aspect of the present invention is applied to an internal combustion engine control system to control an ignition system and a fuel injection system for a four cycle multi-cylinder internal combustion engine having a fuel supplied by the fuel injection system having an injector provided for each of cylinders.

In this internal combustion engine control system, there are provided a crank shaft sensor mounted on a crank shaft of the internal combustion engine to generate a low revolution ignition position detection signal of pulse wave at a low revolution ignition position of each of cylinders set near a top dead center in a compression stroke of each of the cylinders and to generate a reference position detection pulse at a reference position of each of the cylinders set at a position advanced relative to the low revolution ignition position of each of the cylinders, a cam shaft sensor mounted on a cam shaft of the internal combustion engine to generate a reference judgement pulse at a set rotary angle position of the cam shaft once per one revolution of the cam shaft, ignition position arithmetical operation means to arithmetically operate an ignition position for each of the cylinders on the predetermined control conditions and fuel injection time arithmetical operation means to arithmetically operate a fuel injection time of the injector for each of the cylinders and there are accomplished the step of starting an injection of the fuel from the injectors for all of the cylinders at a position where the crank shaft sensor generates each of the reference position detection pulse under the condition of being unable to detect any reference judgement pulse from the cam shaft sensor to inject the fuel from the corresponding injector for a set time, the step of simultaneously making an ignition operation in all of the cylinders at a position where the crank shaft sensor generates each of low revolution ignition position detection signals under the condition of being unable to detect any reference judgement pulse from the cam shaft sensor, the step of judging which of the cylinders a series of reference position detection pulses are one detecting the reference position for from a generation order of the series of the reference position detection pulses after the reference position detection pulses are generated when the reference judgement pulses are detected, the step of starting an injection of the fuel from the injector for each of the cylinders at a position where the judged reference position detection pulse for each of the cylinders is generated and stopping the injection of the fuel when the fuel injection time arithmetically operated by the fuel injection time arithmetical operation means lapses and the step of starting a measurement of the ignition position of each of the cylinders arithmetically operated by the ignition position arithmetical operation means at a position where the judged reference position detection pulse for each of the cylinders judged by the reference position detection judgement means is generated and making the ignition operation at each of the cylinders when the thus arithmetically operated ignition position for each of the cylinders is measured.

In case that the invention is applied to an internal combustion engine control apparatus to control an ignition system for a four cycle multi-cylinder internal combustion engine, the control apparatus comprises a crank shaft sensor, a cam shaft sensor and an electronic control unit (ECU).

The control apparatus of the invention is characterized by simultaneously making an ignition operation in all of the cylinders at a position where the crank shaft sensor generates each of low revolution ignition position detection signals under the condition of being unable to immediately generate any reference judgement pulse from the cam shaft sensor, which will occur when a crest value of an output pulse from the cam shaft sensor is too low due to the revolution rate of the internal combustion engine within the extreme low revolution range or when a reluctor on a rotor of the cam shaft sensor moves beyond a magnetic pole position of a signal generator when the start operation of the engine begins or under the condition of being unable to detect any reference judgement pulse generated from the cam shaft sensor, which will occur when a wiring for applying an output of the cam shaft sensor to the electronic control unit is disconnected, for example.

To this end, the crank shaft sensor used for the invention is mounted on the crank shaft of the internal combustion engine and so constructed as to generate a low revolution ignition position detection signal of pulse waveform at a low revolution ignition position set near a top dead center (a rotary angle position of the crank shaft when a piston of each of the cylinders reaches the top dead center) in a compression stroke of each of the cylinders and a reference position detection pulse at a reference position of each of the cylinders set at a position advanced relative to the low revolution ignition position of each of the cylinders. The cam shaft sensor is mounted on a cam shaft of the internal combustion engine and so constructed as to generate a reference judgement pulse at a rotary angle position set at a predetermined rotary angle position of the cam shaft once per one revolution of the cam shaft.

The electronic control unit includes urgent ignition signal supply means to supply an ignition signal to the ignition system whereby an ignition operation is simultaneously made in all of the cylinders at a position where the crank shaft sensor generates each of the low revolution ignition position detection signals under the condition of being unable to detect any reference judgement pulse from the cam shaft sensor, reference position detection pulse judgement means to judge which of the cylinders a series of reference position detection pulses are one detecting the reference position for from a generation order of the series of the reference position detection pulses after the reference judgement pulses are generated when the reference judgement pulses is detected, ignition position arithmetical operation means to arithmetically operate an ignition position for each of the cylinders under predetermined control conditions and constant ignition position control means to start a measurement of the ignition position of each of the cylinders arithmetically operated by the ignition position arithmetic measurement means at a position where the reference position detection pulse for each of the cylinders judged by the reference position pulse judgement means is generated and to make the ignition operation in each of the cylinders when the thus arithmetically operated ignition position for each of the cylinders is measured.

In case that the number of cylinders of the internal combustion engine is four, the four cylinders are divided into two sets of two cylinders having their ignition positions provided in a manner far away from each other at an crank angle of 360° and both of the two cylinders of each of the cylinder sets are simultaneously ignited. The crank shaft sensor comprises a rotor rotationally driven by a crank shaft and having two reluctors provided at an equal angle distance corresponding to the two sets of cylinders, respectively and a single signal generator to generate pulses of different polarities when each of the reluctors on the rotor at a front edge and at a rear edge as viewed in the rotational direction, respectively;

In this case, a relation of position between each of the reluctors on the rotor and the signal generator is so set that the pulse generated when the signal generator detects the front edge of the reluctor corresponding to each of the cylinder sets and the pulse generated when the signal generator detects the rear edge of the reluctor corresponding to each of the cylinder sets become the reference position detection pulse and the low revolution ignition position detection pulse for each of cylinder sets, respectively.

In the four cycle four-cylinder internal combustion engine, if the four cylinders are simultaneously ignited when every low revolution ignition position detection signal for each of the cylinders is generated, a mixture gas is burnt in the cylinder having the ignition period to produce a torque to transfer the cylinder to an explosion stroke. One of the three cylinders having no ignition period is at an end of the explosion stroke and the remaining two of them are at an end of an exhaust stroke and at an end of intake stroke, respectively. Since the combustion is already finished in the cylinder being at the explosion stroke, no trouble occurs even though the ignition operation is made. Since no combustion is made in the cylinder being at the end of the exhaust stroke, no trouble also occurs even though a spark is generated. The fuel flows into the cylinder being at the end of the intake stroke, but the mixture gas will be never ignited and therefore combustion will hardly be extended because of the piston of the cylinder being near a bottom dead center. Even if the mixture gas is ignited, there will not occur such a torque as prevents the activation of the engine. Thus, in case all the four cylinders are ignited when the low revolution ignition position detection signal is generated, the ignition will be wastefully done in the cylinders other than the cylinder being at the ignition period and the engine can be started without any trouble because the rotation of the engine is adversely not affected by the wasteful ignition.

When the reference judgement pulse is detected, there is judged which of the cylinders a series of pulses generated by the crank shaft sensor correspond to. Thus, the ignition operation can be made at the position arithmetically operated by the CPU and therefore the engine can be driven without any trouble on the constant operation thereof.

As aforementioned, in the invention, since the ignition operation is simultaneously made in all the cylinders at the position where each of the low revolution ignition position detection signal is generated under the condition of being unable to detect any reference judgement pulse, such a sensor as sequentially generates pulses at the reference position and the low revolution ignition position of the series of cylinders may be used as the crank shaft sensor. Accordingly, the crank shaft sensor may have only one pulser coil provided therein, which causes the construction of the crank shaft sensor to be simplified. Since a circuit to input the output of the crank shaft sensor to the CPU may comprise only two circuits including a circuit to convert the reference position detection pulse into a signal having a waveform which can be recognized by the CPU and a circuit to convert the low revolution ignition position detection pulse into a signal having a waveform which can be recognized by the CPU, the construction of the electronic control unit can be more simplified than that of the prior art.

Although, in the aforementioned construction, only the ignition system is controlled, the invention may be applied to a four cycle four-cylinder internal combustion engine control apparatus which is adapted to control a fuel injection system as well as the ignition system. In this case, a crank shaft sensor is so constructed to generate the low revolution ignition position detection signal at the low revolution ignition position of each of the cylinders set near the top dead center in the compression stroke of each of the cylinders and to generate the reference position detection pulse at the reference position of each of the cylinders set at a position advanced relative to the low revolution ignition position of each of the cylinders and set at the position suitable for starting the injection of the fuel from the injector of each of the cylinders.

In this case, there is provided a electronic control unit including urgent fuel injection control means to apply to the fuel injection system a fuel injection instruction signal to start an injection of the fuel from the injectors for all of the cylinders at a position where the crank shaft sensor generates each of the reference position detection pulse under the condition of being unable to detect any reference judgement pulse from the cam shaft sensor because the revolution rate of the internal combustion engine is within a range of extreme low revolution of the internal combustion engine to inject the fuel from the respective injectors for a set time, urgent ignition control means to apply to an ignition system an ignition signal to simultaneously make an ignition operation in all of the cylinders at a position where the crank shaft sensor generates each of low revolution ignition position detection signals under the condition of being unable to detect any reference judgement pulse from the cam shaft sensor, reference position detection pulse judgment means to judge which of the cylinders a series of reference position detection pulses are one detecting the reference position for from a generation order of the series of the reference position detection pulses generated by the crank shaft sensor after the reference position detection pulses are generated, fuel injection time arithmetical operation means to arithmetically operate a fuel injection time (a time for which the fuel is injected from the injector) of the injector for each of the cylinders under predetermined control conditions, ignition position arithmetical operation means to arithmetically operate an ignition position for each of the cylinders under the predetermined control conditions, constant fuel injection control means to start an injection of the fuel from the injector for each of the cylinders at a position where the reference position detection pulse for each of the cylinders judged by the reference position detection pulse judgement means is generated and to stop the injection of the fuel when the fuel injection time arithmetically operated by the fuel injection arithmetical operation means lapses and constant ignition position control to start a measurement of the ignition position of each of the cylinders arithmetically operated by the ignition position arithmetical operation means at a position where the reference position detection pulse for each of the cylinders judged by the reference position detection pulse judgement means is generated and to make the ignition operation at each of the cylinders when the thus arithmetically operated ignition position for each of the cylinders is measured.

With the internal combustion engine control apparatus constructed as aforementioned, although the fuel is simultaneously injected from the injectors for all the cylinders under the condition of being unable to detect any reference judgment pulse, the fuel is never excessively supplied to the respective cylinders by properly adjusting the drive current supplied to a pump motor of a fuel pump so as to regulate the injection amount of the fuel from the respective injectors in a predetermined manner whereby no problem occurs in the operation of the engine.

The invention may be applied to a control apparatus to control a four cycle three-cylinder internal combustion engine.

In this case, there are provided a crank shaft sensor including a rotor rotationally driven by the crank shaft of the internal combustion engine and having three reluctors provided at a distance of 120° angle corresponding to the three cylinders, respectively and a single signal generator to generate pulses of different polarities when each of the reluctors on the rotor at a front edge and at a rear edge as viewed in the rotational direction, respectively is detected and a relation of position between each of the reluctors on the rotor and the signal generator being set so as to generate a reference position detection pulse and a low revolution ignition position detection pulse when the signal generator detects the front edge and the rear edge of the reluctor corresponding to each of the cylinders at a reference position of each of the cylinders set at a position advanced relative to the position of top dead center in the compression stroke of each of the cylinders and at a low revolution ignition position of each of cylinders set near the top dead center in a compression stroke of each of the cylinders, respectively and a cam shaft sensor to generate a reference judgement pulse once per one revolution of the cam shaft in the same manner as aforementioned.

In this case, an electronic control unit includes urgent ignition signal supply means to supply an ignition signal to the ignition system so that an ignition operation is simultaneously made in all of the cylinders when the signal generator of the crank shaft sensor detects the rear edge of each of the reluctors as viewed in the rotational direction to generate the pulse under the condition of being unable to detect any reference judgement pulse output by the cam shaft sensor, reference position detection pulse judgement means to judge which of the cylinders a series of reference position detection pulses sequentially generated are one detecting the reference position for by distinguishing the generation order of the series of the reference position detection pulses obtained by the crank shaft sensor after the reference judgement pulses are generated under the condition of being able to detect the reference judgement pulses, ignition position arithmetical operation means to arithmetically operate an ignition position of each of the cylinders under predetermined control conditions and constant ignition position control means to start a measurement of the ignition position of each of the cylinders arithmetically operated by the ignition position arithmetical operation means at a position where the reference position detection pulse for each of the cylinders judged by the reference position detection judgement means is generated and to make the ignition operation in each of the cylinders when the thus arithmetically operated ignition position of each of the cylinders is measured.

In case that the internal combustion engine is consisted of three cylinders, the adjacent cylinders are spaced from each other at an angle distance of 240°. Thus, with the reluctors provided on the rotor of the crank shaft sensor at the angle distance of 120° as aforementioned to generate the low revolution ignition signals for every 120° rotation so as to make the simultaneous ignition operation in all of the three cylinders, a wasteful spark occurs at the beginning of the compression stroke of each of the cylinders and then the ignition operation is made at the low revolution ignition position set at the end of the compression stroke. In this case, when the wasteful spark occurs at the beginning of the compression stroke, the piston is located near the bottom dead center where the ratio of compression is low and as a result, the ignition operation will lead to the combustion of the mixture with extremely low probability. Thus, since the mixture will be actually ignited by the second ignition made at the end of the compression stroke, the engine can start without any problem.

The fuel injection system as well as the ignition system may be also controlled by the invention in case that it is applied to the three-cylinder internal combustion engine as aforementioned.

In this case, the electronic control unit includes urgent fuel injection control means to apply an injection instruction signal to the fuel injection system so as to simultaneously start an injection of the fuel from the injectors for all of the cylinders when the signal generator of the crank shaft sensor detects the front edge as viewed in the rotational direction to generate a pulse under the condition of being unable to detect any reference judgement pulse output by the cam shaft sensor to inject the fuel from the injectors for a set time, urgent ignition signal supply means to apply an ignition signal to the ignition system so as to simultaneously make an ignition operation in all of the cylinders when the signal generator of the crank shaft sensor detects the rear edge as viewed in the rotational direction to the crank shaft sensor to generate a pulse under the condition of being unable to detect any reference judgement pulse output by the cam shaft sensor, reference position detection pulse judgment means to judge which of the cylinders a series of reference position detection pulses are one detecting the reference position for by distinguishing the generation order of the series of the pulses output by the crank shaft sensor after the reference judgement pulses is generated, fuel injection time arithmetical operation means to arithmetically operate a fuel injection time of the injector for which the fuel is injected therefrom for each of the cylinders under the predetermined control conditions, ignition position arithmetical operation means to arithmetically operate an ignition position of each of the cylinders under the predetermined control conditions, constant fuel injection control means to apply an injection instruction signal to the fuel injection system to start an injection of the fuel from the injector for each of the cylinders at a position where there is generated the reference position detection pulse for each of the cylinders judged by the reference position detection pulse judgment means and to stop the injection of the fuel from each of the injectors when the fuel injection time arithmetically operated by the fuel injection arithmetical operation means lapses and constant ignition position control means to apply an ignition signal to the ignition system so as to start a measurement of the ignition position of each of the cylinders arithmetically operated by the ignition position arithmetical operation means at a position where there is generated the reference position detection pulse for each of the cylinders judged by the reference position detection pulse judgement means and to make the ignition operation in each of the cylinders when the ignition position of each of the cylinders arithmetically operated by the ignition position arithmetical operation means is measured.

Each of the reluctors on the rotor of the crank shaft sensor is formed so as to have a polar arc angle of 60° and the reference position of each of the cylinders is set at a position advanced by an angle of 65° relative to a top dead center of a compression stroke of each of the cylinders. The low revolution ignition position of each of the cylinders is set at a position advanced by an angle of 5° relative to the top dead center of the compression stroke of each of the cylinders.

The invention can be also applied to a control apparatus to control a four cycle six-cylinder internal combustion engine.

In this case, the six cylinders are divided into three cylinder sets, respective one of which includes two cylinders having an ignition position far away from each other at a crank angle of 360°. The control apparatus comprises a crank shaft sensor including a rotor rotationally driven by the crank shaft of the internal combustion engine and having three reluctors provided at a distance of 120° angle corresponding to the three cylinder sets, respectively and a single signal generator to generate pulses of different polarities when each of the reluctors on the rotor at a front edge and at a rear edge as viewed in the rotational direction, respectively is detected, respectively and a relation of position between each of the reluctors on the rotor and the signal generator being set so as to generate a reference position detection pulse and a low revolution ignition position detection pulse when the signal generator detects the front edge and the rear edge of the reluctor corresponding to each of the cylinder sets at a reference position advanced relative to a top dead center of a compression stroke of each of the cylinder sets and at a low revolution ignition position of each of the cylinder sets set near the top dead center in the compression stroke of each of the cylinder sets, respectively and a cam shaft sensor mounted on a cam shaft of the internal combustion engine to generate a reference judgement pulse at a set rotary angle position of the cam shaft once per one revolution of the cam shaft.

The electronic control unit includes urgent ignition signal supply means to supply an ignition signal to the ignition system so that an ignition operation is simultaneously made in all of the cylinders when the signal generator of the crank shaft sensor detects the rear edge of each of the reluctors as viewed in the rotational direction to generate the pulse under the condition of being unable to detect any reference judgement pulse from the cam shaft sensor, reference position detection pulse judgement means to judge which set of the cylinders a series of reference position detection pulses are one detecting the reference position for from a generation order of the series of the reference position detection pulses obtained by the crank shaft sensor after the reference judgement pulses are generated when the reference judgement pulses is detected, ignition position arithmetical operation means to arithmetically operate an ignition position for each of the cylinder sets under predetermined control conditions and constant ignition position control means to apply an ignition signal to the ignition system so as to start a measurement of the ignition position of each of the cylinder sets arithmetically operated by the ignition position arithmetical operation means at a position where there is generated the reference position detection pulse for each of the cylinder sets judged by the reference position detection pulse judgement means and to make the ignition operation in each of the cylinder sets when the thus arithmetically operated ignition position for each of the cylinder sets is measured.

In case that the four cycle six-cylinder internal combustion engine having a fuel injection system is controlled by the invention, the electronic control unit includes urgent fuel injection control means to apply an injection instruction signal to the fuel injection system so as to simultaneously start an injection of the fuel from the injectors for all of the cylinders at a position where the signal generator of the crank shaft sensor detects the front edge as viewed in the rotational direction to generate a pulse under the condition of being unable to detect any reference judgement pulse from the cam shaft sensor to inject the fuel from the injectors for a set time, urgent ignition signal supply means to apply the ignition signal to the ignition system so as to simultaneously make an ignition operation in all of the cylinders at a position where the signal generator of the crank shaft sensor detects the rear edge as viewed in the rotational direction to the crank shaft sensor to generate a pulse under the condition of being unable to detect any reference judgement pulse from the cam shaft sensor, reference position detection pulse judgment means to judge which of the cylinder sets a series of reference position detection pulses are one detecting the reference position for from a generation order of the series of the reference position detection pulses after the reference judgement pulses are generated when the reference judgement pulses is detected, fuel injection time arithmetical operation means to arithmetically operate a fuel injection time of the injector for each of the cylinder sets under the predetermined control conditions, ignition position arithmetical operation means to arithmetically operate an ignition position for each of the cylinder sets under the predetermined control conditions, constant fuel injection control means to apply an injection instruction signal to the fuel injection system so as to start an injection of the fuel from the injector for each of the cylinder sets at a position where there is generated the reference position detection pulse for each of the cylinder sets judged by the reference position detection pulse judgment means and to stop the injection of the fuel when the fuel injection time arithmetically operated by the fuel injection arithmetical operation means lapses and constant ignition position control to apply an ignition signal to the ignition system so as to start a measurement of the ignition position of each of the cylinder sets arithmetically operated by the ignition position arithmetical operation means at a position where there is generated the reference position detection pulse for each of the cylinder sets judged by the reference position detection pulse judgement means and to make the ignition operation in each of the cylinder sets when the ignition position for each of the cylinder sets arithmetically operated by the ignition position arithmetical operation means is measured.

BRIEF DESCRIPTION OF THE DRAWING

The above and other objects and features of the invention will be apparent from the description of the embodiments of the invention taken along with reference to the accompanying drawings in which;

FIG. 12A is a flow chart showing an algorithm of a first injector injection timer interruption routine of the program practiced by the CPU of the four-cylinder internal combustion engine control apparatus of the invention;

FIG. 12B is a flow chart showing an algorithm of a second injector injection timer interruption routine of the program practiced by the CPU of the four-cylinder internal combustion engine control apparatus of the invention;

FIG. 12C is a flow chart showing an algorithm of a third injector injection timer interruption routine of the program practiced by the CPU of the four-cylinder internal combustion engine control apparatus of the invention;

FIG. 12D is a flow chart showing an algorithm of a fourth injector injection timer interruption routine of the program practiced by the CPU of the four-cylinder internal combustion engine control apparatus of the invention;

FIG. 15A is a flow chart showing an algorithm of a first cylinder ignition coil conduction timer interruption routine of the program practiced by the CPU of the three-cylinder internal combustion engine control apparatus of the invention;

FIG. 15B is a flow chart showing an algorithm of a second cylinder ignition coil conduction timer interruption routine of the program practiced by the CPU of the three-cylinder internal combustion engine control apparatus of the invention;

FIG. 15C is a flow chart showing an algorithm of a third cylinder ignition coil conduction timer interruption routine of the program practiced by the CPU of the three-cylinder internal combustion engine control apparatus of the invention;

DETAILED DESCRIPTION OF EMBODIMENT OF THE INVENTION

Figure 1:
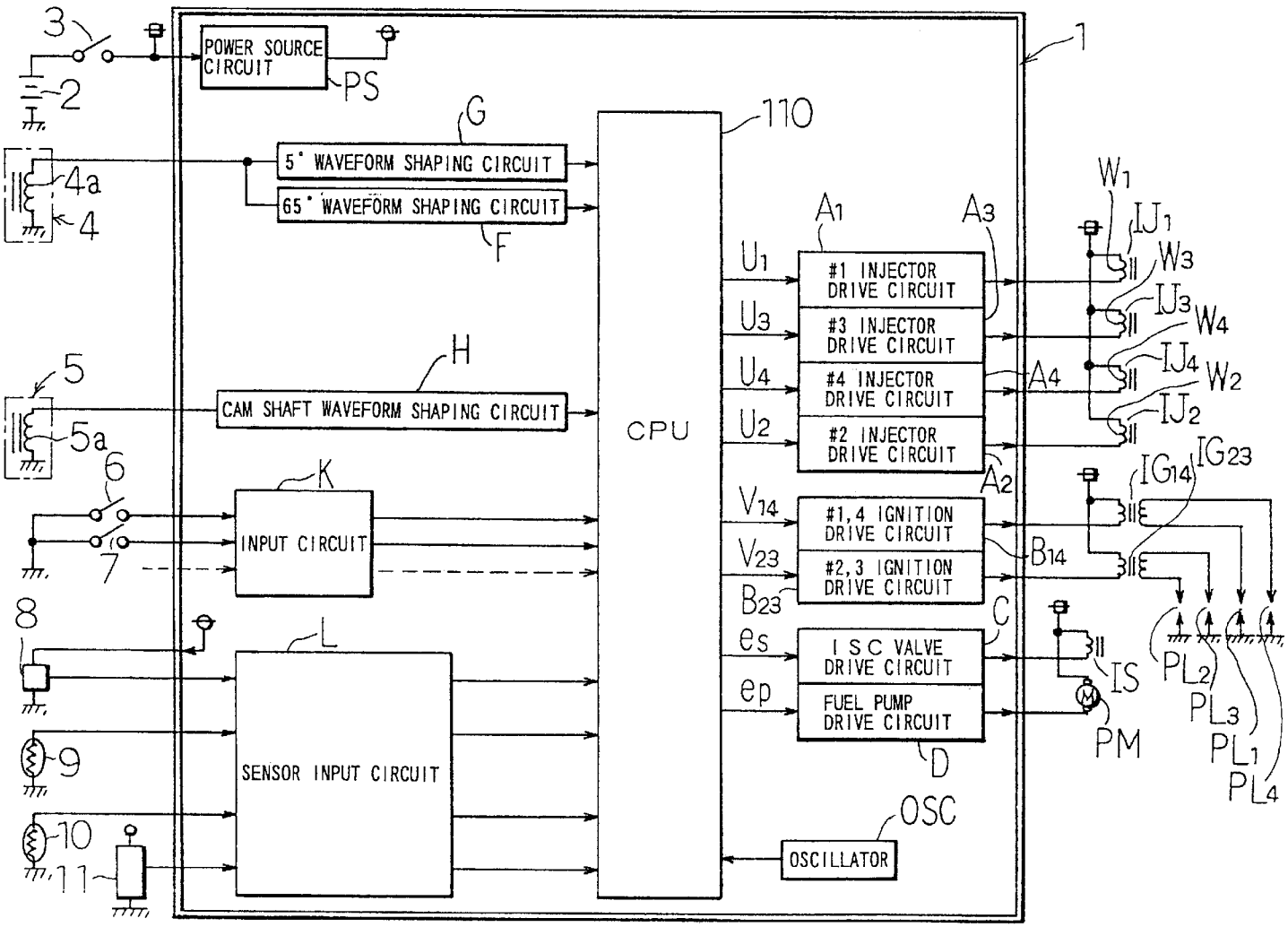
FIG. 1 is a block diagram illustrating a construction of a hardware for a control apparatus to control a four cycle four-cylinder internal combustion engine and to which the present invention is applied.

A mode of embodiment of the invention will be described with reference to the accompanying drawings herein just below.

In the drawings, such as reference codes as #1, #2, #3 and #4 designate first through fourth cylinders, respectively.

FIG. 1 illustrates a construction of a hardware for a four cycle internal combustion engine control apparatus of the invention. The control apparatus comprises an electronic control unit (ECU) designated by a reference numeral 1. A battery designated by a reference numeral 2 serves to apply a source voltage to the electronic control unit 1 and an injector. An output voltage of the battery 2 is applied through a power source switch 3 to a power source input terminal of the electronic control unit 1. The control apparatus of the invention also comprises a crank shaft sensor designated by a reference numeral 4 and a cam shaft sensor designated by a reference numeral 5. An idling switch designated by a reference numeral 6 serves to detect that a throttle valve is returned to an idling position (a fully closed position) and a neutral switch designated by a reference numeral 7 serves to detect that a transmission is in a neutral condition. A pressure sensor designated by a reference numeral 8 serves to detect an atmospheric pressure, an engine temperature sensor designated by a reference numeral 9 serves to detect a temperature of cooling water of the engine as an engine temperature, an intake temperature sensor designated by a reference numeral 10 serves to detect a temperature of an intake gas of the engine and a throttle opening sensor designated by a reference numeral 11 serves to detect an opening degree of the throttle valve.

Injectors for first through fourth cylinders of the engine designated by reference numerals IJ1 through IJ4, respectively are provided to supply fuel to the first through fourth cylinders. An ignition coil designated by a reference numeral IG14 is commonly provided for the first and fourth cylinders while an ignition coil designated by a reference numeral IG23 is commonly provided for the second and third cylinders. Ignition plugs designated by reference numerals PL1 through PL4 are provided in the first through fourth cylinders.

The ignition coil IG14 for the first and fourth cylinders serves to make a simultaneous ignition by applying an igniting high voltage to the ignition plugs for the first and fourth cylinders while the ignition coil IG23 for the second and third cylinders serves to make a simultaneous ignition by applying an igniting high voltage to the ignition plugs for the second and third cylinders.

The injectors IJ1 through IJ4 for the first through fourth cylinders have solenoid coils W1 through W4 to drive their respective valves. The solenoid coils W1 through W4 at their one end are connected through the switch 3 to a positive terminal of the battery 2 and at their other end connected to injector drive circuits A1 through A4, respectively, which are in turn provided in the electronic control unit 1.

Primary coils of the ignition coils IG14 and IG23 at their one end are connected through the switch 3 to the positive terminal of the battery 2 and at their other end connected to an ignition drive circuit B14 and an ignition drive circuit B23, respectively, which are in turn provided in the electronic control unit 1.

Non-grounding terminals of the ignition plugs PL1 and PL4 are connected to opposite ends of a secondary coil of the ignition coil IG14 while non-grounding terminals of the ignition plugs PL2 and PL3 are connected to opposite ends of a secondary coil of the ignition coil IG23.

A drive coil IS for an electromagnetic idling speed control valve (ISC valve) serves to control an amount of air flowing through an air passage bypassing the throttle valve for making an idling speed control (ISC). A pump motor PM serves to supply the fuel to the injectors IJ1 through IJ4. The drive coil IS for the ISC valve and the pump motor PM at their one end are connected through the switch 3 to the positive terminal of the battery 2 and at their other end connected to an ISC valve drive circuit C and a fuel pump drive circuit D, respectively, which are in turn provided in the electronic control unit 1.

The injector drive circuits A1 through A4 have switch means connected in series to the solenoid coils of the injectors IJ1 through IJ4, respectively and serve to pass a drive current from the battery 2 to the injectors IJ1 through IJ4 by conducting the respective switch means when injection instruction signals U1 through U4 are given from a CPU 110. The injectors IJ1 through IJ4 inject the fuel while the drive current is given.

The ignition drive circuits B14 and B23 comprises switch means connected in series to the primary coils of the ignition coils IG14 and IG23, respectively and serve to pass a primary current through the primary coils of the ignition coils IG14 and IG23 when ignition signals V14 and V23 are given from the CPU 110 and to interrupt the primary current of the ignition coils IG14 and IG23 when the ignition signals V14 and V23 are extinguished. This interruption of the primary current induces an igniting high voltage across the secondary coils of the ignition coils IG14 and IG23.

A fuel injection system is formed by the injector drive circuits A1 through A4, the injectors IJ1 through IJ4, the fuel pump and a pressure regulator (not shown) to control a pressure of the fuel supplied from the fuel pump to the injectors IJ1 through IJ4. An ignition system is formed by the ignition coils IG14 and IG23 and the ignition drive circuits B14 and B23.

The electronic control unit 1 comprises a power source circuit PS having the output voltage of the battery input through the switch 3, the CPU having a power source voltage applied from the power source circuit PS and an oscillator OSC to apply a clock signal to the CPU 110. The predetermined output ports of the CPU 110 are connected to injection instruction signal input terminals of the injector drive circuits A1 through A4, ignition signal input terminals of the ignition drive circuits B14 and B23, an input terminal of the ISC valve drive circuit C and an input terminal of the fuel pump drive circuit D, respectively.

Also, the electronic control unit 1 comprises a 65° waveform shaping circuit F and a 5° waveform shaping circuit G, both of which are commonly provided for the first through fourth cylinders, a cam shaft waveform shaping circuit H, an input circuit K and a sensor input circuit L. Outputs from the various sensors are input to the predetermined input ports of the CPU 110 through these waveform shaping circuits and the input circuits.

The term "65° waveform shaping circuit" means a circuit to shape the waveform of the pulse signal generated at a position of 65° prior to the top dead center of the compression stroke of the respective cylinders (a rotary angle position of the crank shaft) while the term "5° waveform shaping circuit" means a circuit to convert the pulse signal generated at a position of 5° prior to the top dead center of the compression stroke of the respective cylinders (a rotary angle position of the crank shaft) into a signal of waveform which can be recognized by the CPU.

The crank shaft sensor 4 is provided on the crank shaft of the internal combustion engine for applying to the electronic control unit 1 an information on a "reference position" which should be used as the rotary angle position of the crank shaft for starting a measurement of the ignition position expressed by the rotary angle position of the crank shaft for the respective cylinders of the internal combustion engine and an information on the ignition position when the respective cylinders are operated at an extremely low revolution (including the time when the engine starts). The crank shaft sensor 4 serves to generate a low revolution ignition position detection pulse at a low revolution ignition position of the respective cylinders set near the top dead center of the compression stroke (at the position of 5° prior to the top dead center of the compression stroke, in the illustrated embodiment) and to generate a reference position detection pulse at a reference position of the respective cylinders set at a position advanced relative to the low revolution ignition position of the respective cylinders and suitable for starting the injection of the fuel from the injectors of the respective cylinders (a position of 65° prior to the top dead center of the compression stroke, in the illustrated embodiment).

The cam shaft sensor 5 is provided for applying to the electronic control unit 1 a reference judgement pulse to be used for judging which of the cylinders a series of pulses generated by the crank shaft sensor 4 corresponds to. The cam shaft sensor 5 is adapted to generate the reference judgment pulse at the specific rotary angle position once while the cam shaft rotates one revolution (or the crank shaft rotates two revolutions).

Figure 2:
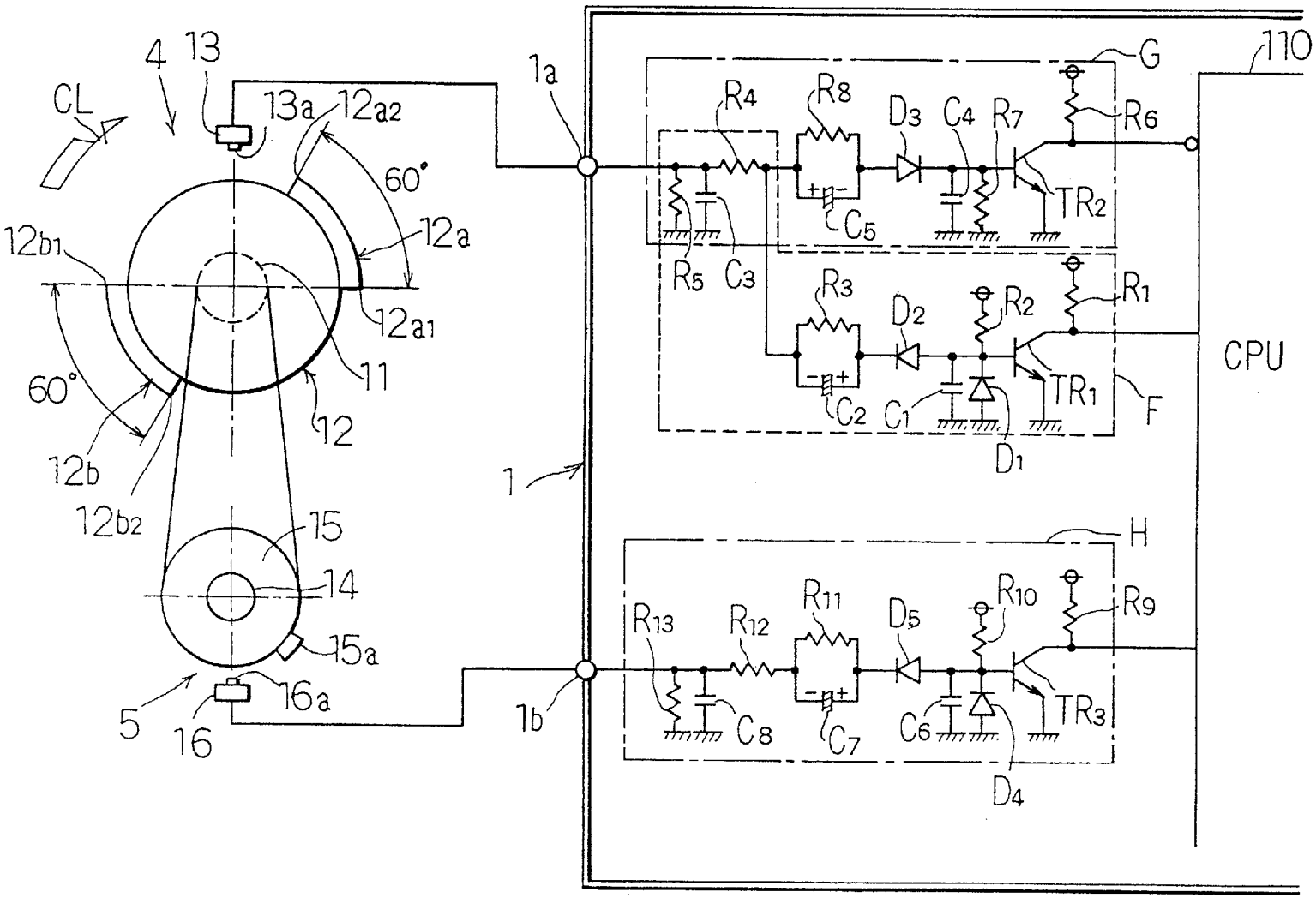
FIG. 2 illustrates a concrete construction of a gist of the apparatus shown in FIG. 1.

In FIG. 2 are illustrated the portion of the internal combustion engine control apparatus including the crank shaft sensor 4 and the cam shaft sensor 5 and a portion of the input circuit of the electronic control unit 1.

The crank shaft sensor 4 shown in FIG. 2 may be formed of ferromagnetic material such as iron and comprises a rotor 12 mounted on a crank shaft 11 of the internal combustion engine and having a center axis common to the crank shaft 11 and a signal generator 13 disposed near the rotor and secured to an engine case or the like.

The rotor 12 is so formed as to have a cylindrical outer peripheral surface having an axis common to the crank shaft 11 and comprises arc-like reluctors 12*a* and 12*b* having a polar arc angle of 60° and symmetrically provided far away from each other by a 180° angle distance.

The signal generator 13 comprises an iron core at its leading end having a magnetic pole portion 13*a* faced to the outer periphery of the rotor 12, a pulser coil 4*a* (see FIG. 1) wound on the iron core and a permanent magnet magnetically bonded to the iron core.

In case that a flywheel magnet rotor is provided in the internal combustion engine, the rotor 12 may be formed by forming the reluctor 12*a* on the periphery of the flywheel of the magnet rotor.

The rotor 12 of the crank shaft sensor 4 rotates together with the crank shaft 11 of the engine in a direction indicated by an arrow CL in FIG. 2. As the rotor 12 rotates, the pulser coil 4*a* provided in the signal generator 13 induces pulses of different polarities when leading or front edges 12*a*1 and 12*b*1 of the reluctors 12*a* and 12*b* as viewed in the rotational direction of FIG. 2 pass the position where the magnetic pole 13*a* of the iron core of the signal generator 13 is located (or when the signal generator 13 detects the front edges of the reluctors 12*a* and 12*b*) and when rear edges 12*a*2 and 12*b*2 of the reluctors 12*a* and 12*b* as viewed in the rotational direction of FIG. 2 pass the position where the magnetic pole 13*a* of the iron core of the signal generator 13 is located (or when the signal generator 13 detects the rear edges of the reluctors 12*a* and 12*b*).

The position where the pulser coil 4*a* is disposed within the signal generator 13 is so set that the signal generator 13 detects the front edge of the reluctor 12*a* or 12*b* at the reference position of the first through fourth cylinders set at the position advanced by the 65° angle relative to the top dead center position of the compression stroke of the first through fourth cylinders (the rotary angle position of the crank shaft when the pistons of the first through fourth cylinders reach the top dead center at the end of the compression stroke) to generate reference position detection pulses S1 through S4 in order of S1, S2, S3 and S4 (or in order of the ignition of cylinders) and detects the rear edge of the reluctor 12*a* or 12*b* at the low revolution ignition position of the first through fourth cylinders set at the position advanced by the 5° angle relative to the top dead center position of the compression stroke of the first through fourth cylinders to generate low revolution ignition position detection pulses S1' through S4' in order of S1', S3', S4' and S2'.

The cam shaft sensor 5 comprises a rotor 15 mounted on a cam shaft 14 connected to the crank shaft 11 through a reduction gear such as a chain-sprocket mechanism or a timing belt mechanism to rotate by half a revolution rate of the crank shaft 11 and a signal generator 16 disposed near the rotor 15 and secured to the engine case or the like. A reluctor 15*a* of an arc-like protrusion is provided on the periphery of the rotor 15.

Figures 3A, 3B, 3C, 3D, 3E:
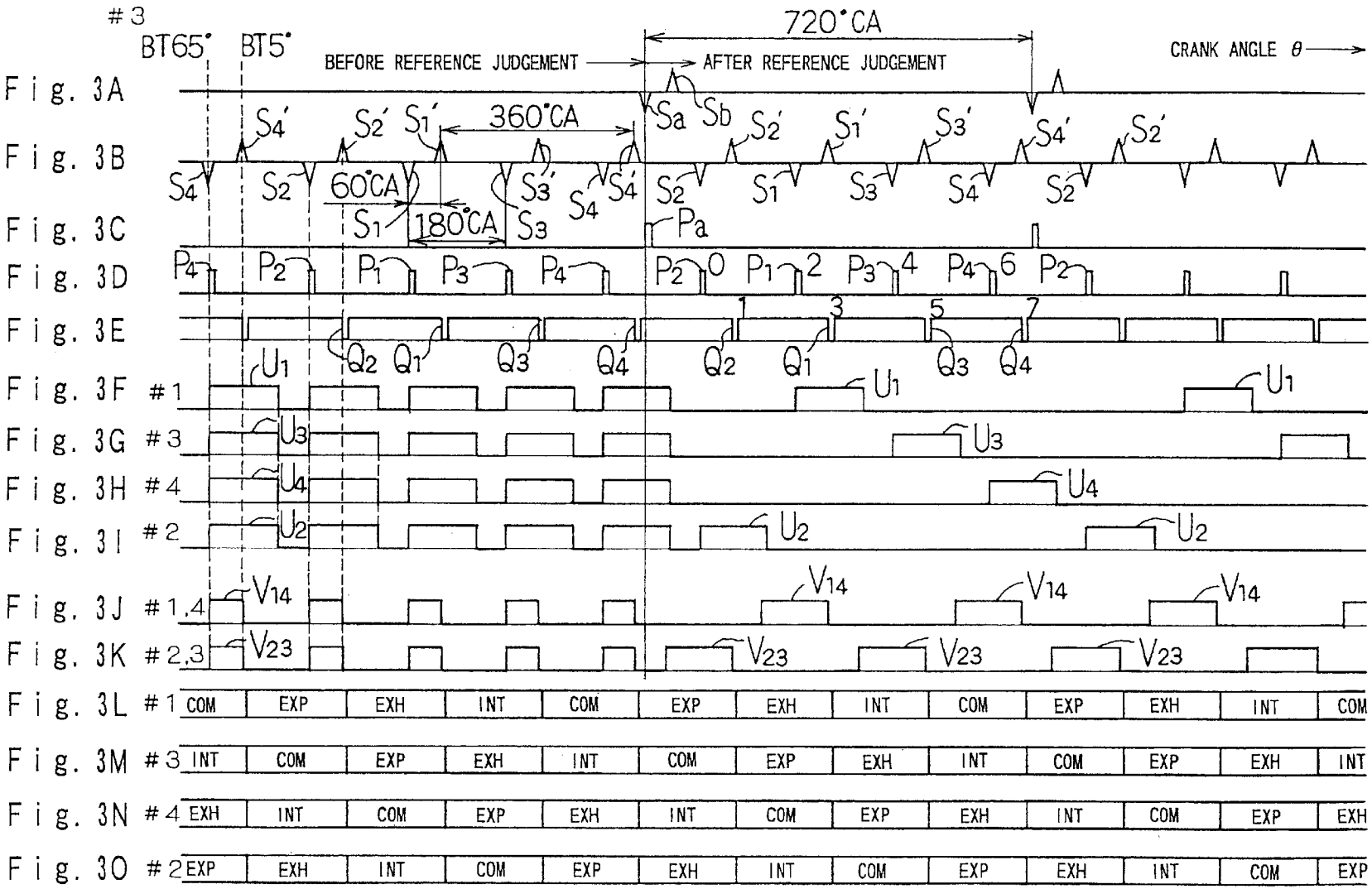
FIG. 3 shows waveforms of signals in various parts of the apparatus of FIGS. 1 and 2.

The signal generator 16 may have the same construction as the signal generator 13 and has a pulser coil 5*a* (see FIG. 1) wound on the iron core thereof. The signal generator 16 outputs pulses Sa and Sb as indicated in FIG. 3A when it detects the front and rear edges of the reluctor 15*a* as viewed in the rotational direction of FIG. 2. Since the cam shaft 14 rotates at half the revolution rate of the crank shaft 11, the signals Sa and Sb are generated once per one combustion cycle (while the crank shaft rotates two revolutions).

In the illustrated embodiment, the position of the signal generator 16 is so set that the pulse Sa generated when the signal generator 16 of the cam shaft sensor 5 detects the front edge of the reluctor 15*a* is used as a reference judgement signal and that the reference judgement pulse is generated immediately after the low revolution ignition position detection pulse S4' for the fourth cylinder is generated.

The reference position detection pulses S1 through S4 generated by the signal generator 13 of the crank shaft sensor 4 at the position of 65° prior to the top dead center of the compression stroke for the first through fourth cylinders are converted by the 65° waveform shaping circuit F into positive logical reference position detection signals P1 through P4 as indicated in FIG. 3D and then input to the CPU 110. The low revolution ignition position detection pulses S1' through S4' generated by the signal generator 13 at the position of 5° prior to the top dead center of the compression stroke for the first through fourth cylinders are converted by the 5° waveform shaping circuit G into negative logical reference position detection signals Q1 through Q4 as indicated in FIG. 3E and then input to the CPU 110.

The reference judgment pulse Sa generated by the cam shaft sensor 5 is converted by the cam shaft waveform shaping circuit H into a positive logical reference judgment pulse Pa as indicated in FIG. 3C and then input to the CPU 110.

In FIG. 2 are illustrated detailed constructions of the 65° waveform shaping circuit F, the 5° waveform shaping circuit G and the cam shaft waveform shaping circuit H.

The 65° waveform shaping circuit F illustrated in FIG. 2 may comprise a NPN transistor TR1 having an emitter grounded to earth and a collector connected the input port of the CPU, resistances R1 and R2 connected between the collector of the transistor TR1 and the output terminal of the power source circuit PS (see FIG. 1) and between the base of the transistor TR1 and the output terminal of the power source circuit PS, respectively, a diode D1 connected between the base of the transistor TR1 and the earth so that an anode of the diode D1 is directed toward the grounded earth, a capacitance C1 connected in parallel to the diode D1, a diode D2 having an anode connected the base of the transistor TR1, a resistance R3 and a capacitance C2 having one end connected commonly to the cathode of the diode D2, a resistance R4 having one end connected to the other ends of the resistance R3 and the capacitance C2 and other end connected to an input terminal 1*a* of the crank shaft sensor of the electronic control unit 1 and a resistance R5 and a capacitance C3 connected in parallel between the input terminal 1*a* of the electronic control unit 1 and the grounded earth.

The 5° waveform shaping circuit G may comprise a NPN transistor TR2 having an emitter grounded to earth and a collector connected to an input port of the CPU 110, a resistance R6 connected between the collector of the transistor TR2 and the grounded earth, a resistance R7 and a capacitance C4 connected in parallel between the base of the transistor TR2 and the grounded earth, a diode D3 having a cathode connected to the base of the transistor TR2 and a resistance R8 and a capacitance C5 having one end connected to the anode of the diode D3 and other end connected to one end of the resistance R4 in addition to the aforementioned resistances R4 and R5 and the capacitance C3.

Furthermore, the cam shaft waveform shaping circuit H may comprise a NPN transistor TR3 having an emitter connected to earth and a collector connected to the input port of the CPU 110, resistances R9 and R10 connected between the collector of the transistor TR3 and the output terminal of the power source circuit PS and between a base of the transistor TR3 and the output terminal of the power source circuit PS, respectively, a diode D4 connected between the base of the transistor TR3 and the grounded earth so that an anode of the diode D4 is directed toward the grounded earth, a capacitance C6 connected in parallel to the diode D4, a diode D5 having an anode connected to the base of the transistor TR1, a resistance R11 and a capacitance C7 having one end connected commonly to the cathode of the diode D5, a resistance R12 having one end connected to the other ends of the resistance R11 and the capacitance C7 and other end connected to the input terminal 1*b* of the cam shaft sensor of the electronic control unit 1 and a resistance R13 and a capacitance C8 connected in parallel between the input terminal 1*b* of the electronic control unit 1 and the grounded earth in the same manner as the waveform shaping circuit F.

A nongrounded output terminal of the signal generator 13 is connected to the input terminal 1*a* of the crank shaft sensor of the electronic control unit 1 while a nongrounded output terminal of the signal generator 16 is connected to the input terminal 1*b* of the crank shaft sensor of the electronic control unit 1.

Although the electronic control unit 1 of FIG. 2 is shown to have only a portion of the CPU 110 and the waveform shaping circuits F through H among the components of the input circuit, the remaining circuit components are constructed in the same manner as those shown in FIG. 1.

In the embodiment of FIG. 2, when no pulse of negative polarity is generated by the pulser coil 4*a* of the signal generator 13, the transistor TR1 is in the conductive condition. As the reference position detection pulses S1, S3 - - - of negative polarity are generated by the signal generator 13, a current flows through the pulser coil 4*a*, the diodes D1 and D2, the resistances R3 and R4 and again the pulser coil 4*a* while the magnitude of the pulses exceeds the value of voltage across the capacitance C2, which causes a drop of the voltage to occur between the both ends of the diode D1. Thus, the base and the emitter of the transistor TR1 are reversely biased so as to provide an interruption condition of the transistor TR1. This causes the reference position detection signals P1, P3 - - - of positive logical pulse waveform as indicated in FIG. 3D to be obtained at the collector of the transistor TR1.

The parallel circuit of the resistance R3 and the capacitance C2 serves as a bias circuit provided for preventing an error signal from being input to the CPU 110 by a noise signal induced at the pulser coil 4*a*. Once a current flows through the resistance R3, the capacitance C2 is charged with the polarity shown in FIG. 2 by a voltage drop across the resistance R3. Thereafter, only when there is input a pulse having a magnitude exceeding the voltage (a threshold value) across the capacitance C2, the current flows through the resistance R3 to provide a signal of pulse waveform at the collector of the transistor TR1. The parallel circuit of the resistance R8 and the capacitance C5 for the waveform shaping circuit G and the parallel circuit of the resistance R11 and the capacitance C7 for the waveform shaping circuit H are provided also for the same purpose.

In the embodiment of FIG. 2, when no pulse of positive polarity is generated by the pulser coil 4*a* of the signal generator 13, the transistor TR2 is in the non-conductive condition and the potential of the collector of the transistor TR2 is in the high level condition. As the pulse of negative polarity is generated by the pulser coil 4*a* of the signal generator 13, a current flows through the pulser coil 4*a*, the resistance R4 and R8, the diode D3, the base and the emitter of the transistor TR2 and again the pulser coil 4*a* while the magnitude of the pulses exceeds the value of voltage across the capacitance C5. This causes the low revolution ignition position detection signals of negative logical pulse waveform as indicated in FIG. 3E to be obtained at the collector of the transistor TR2.

The waveform shaping circuit H operates in the same manner as the waveform shaping circuit F and when the cam shaft sensor 5 generates the pulses Sn of negative polarity, the positive logical reference judgement signal Pa is generated at the collector of the transistor TR3.

The operation of the aforementioned internal combustion engine control apparatus will be described with reference to the waveforms (timing chart) shown in FIG. 3. In FIG. 3, a code "CA" attached after the angles such as 720° and so on means the rotary angles of the crank shaft.

When the switch 3 is closed and applies the source power to the CPU 110, the latter is activated to apply the drive signal ep intermittently produced at predetermined duty ratio to the fuel pump drive circuit D and to pass the drive current controlled by a pulse width modulation (PWM) system from the drive circuit D through the pump motor PM so that the fuel is supplied to the injector under a pressure suitable for starting the engine. This operates the fuel pump to supply the fuel to the injectors IJ1 through IJ4 under the pressure suitable for starting the engine.

The CPU 110 sequentially assigns the numbers of 0, 1, 2, 3, 4, 5, 6, 7 - - - to the reference position detection signals and the low revolution ignition detection signals P2 and Q2, P1 and Q1, P3 and Q3, P4 and Q4 - - - sequentially input thereto after there is detected the reference judgment signal Pa obtained by shaping the reference judgement pulse Sa generated by the cam shaft sensor 5 as shown in FIGS. 3D and E and judges that the input signals P2 and Q2, P1 and Q1, P3 and Q3, P4 and Q4 - - - are the second cylinder reference position detection signal and the second cylinder low revolution ignition position detection signal, the first cylinder reference position detection signal and the first cylinder low revolution ignition position detection signal, the third cylinder reference position detection signal and the third cylinder low revolution ignition position detection signal, the fourth cylinder reference position detection signal and the fourth cylinder low revolution ignition position detection signal - - - , respectively from the assigned numbers.

Also, the CPU 110 arithmetically operates the revolution rate of the engine on the generation period of the pulses generated by the crank shaft sensor 4 and then arithmetically operates the conduction start position and the interruption position (ignition position) of the primary current of the ignition coil for the respective cylinders and the fuel injection time therefor relative to the arithmetically operated revolution rate and the control conditions detected by the various sensors 8 through 10.

Furthermore, the CPU 110 applies the injection instruction signals U1 through U4 of set time width to the injector drive circuits A1 through A4 of the fuel injection system as indicated at a portion of "before reference judgement" in a leftward end side of FIGS. 3F through I whereby the fuel starts to be injected simultaneously by the injectors IJ1 through IJ4 for the first through fourth cylinders and continues to be injected for the set time whenever the signal generator 13 of the crank shaft sensor 4 generates the reference position detection pulses S1, S3, S4 and S2 - - - (or whenever the reference position detection signals P1, P3, P4 and P2 - - - are input) when there cannot be detected any pulse Pa to be obtained by shaping the reference judgement pulse Sa for the reasons that the low revolution rate of the internal combustion engine is within the extremely low revolution range and so on. Thus, the fuel is injected simultaneously from the injectors for the first through fourth cylinders.

The CPU 110 also applies the ignition signal V14 as indicated in FIG. 3J and the ignition signal V23 as indicated in FIG. 3K to the ignition drive circuit B14 whenever the signal generator of the crank shaft sensor 4 generates the reference position detection pulses S1, S3, S4 and S2 - - - under the condition of being unable to detect any reference judgment pulse to simultaneously pass the primary current through the ignition coil G14 for the first and fourth cylinders and through the ignition coil G23 for the second and third cylinders and to extinguish the ignition signals V14 and V23 whenever the signal generator 13 generates the low revolution ignition position detection pulses S1', S3', S4' and S2' - - - whereby the primary current through the ignition coil IG14 for the first and fourth cylinders and the ignition coil IG23 for the second and third cylinders are interrupted. Thus, the igniting high voltage is induced simultaneously across the secondary coils of the ignition coils IG14 and IG23. The high voltage across the secondary coils of the ignition coils IG14 and IG23 is applied across the ignition plugs PL1 and PL4 for the first and fourth cylinders and across the ignition plugs PL2 and PL3 for the second and third cylinders whereby the simultaneous ignition operation is made at the first through fourth cylinders.

The steps L through O of FIG. 3 designate the combustion cycles of the first, third, fourth and second cylinders, respectively, which are shown corresponding to the waveforms A through K of FIG. 3. In these steps L through O of FIG. 3, "EXP", "EXH", "INT" and "COM" express the explosion stroke, the exhaust stroke, the intake stroke and the compression stroke, respectively.

As apparent from this figure, in case that the four cylinders are simultaneously ignited at the low revolution ignition position of either of the first through fourth cylinders, the mixture gas in the cylinder being at the ignition period is burnt so that a torque is produced for being transferred to the explosion stroke. One of the cylinders being not at the ignition period is at the end of the explosion stroke and the remaining two cylinders are at the end of the exhaust stroke and at the end of the intake stroke, respectively. Since the combustion in the cylinder being at the end of the explosion stroke is already made, there is no trouble even though the ignition operation is made therein. Since no combustion is made in the cylinder being at the exhaust stroke, there is also no trouble even though a spark occurs therein. Although the fuel is introduced into the cylinder being at the end of the intake stroke, there is a low probability that the mixture gas is ignited so as to develop the combustion because the piston is near the bottom dead center and even if the mixture gas is ignited, there occurs no torque preventing the start of the engine. Thus, in case that the simultaneous ignition operation is made in the four cylinders when the low revolution ignition position detection signal is generated, the igniting spark generated in the cylinders other than the cylinder being at the ignition period gets wasteful, which never adversely affects the rotation of the engine and assures to positively start the engine.

As aforementioned, although the fuel is injected simultaneously from the injectors for all the cylinders at the low revolution range where no reference judgement pulse can be detected, the fuel is never excessively supplied to the respective cylinders by properly controlling the amount of injection of the fuel from the respective injectors which can be accomplished by properly adjusting the drive current supplied to the pump motor of the fuel pump at the low revolution range and therefore no trouble occurs in the operation of the engine when it starts.

The CPU 110 also applies the drive signal es to the ISC valve drive circuit C when it is detected by the idling switch 6 that the throttle valve is returned to the idling position and by the neutral switch 7 that the transmission is at the neutral position to control the current flowing through the drive coil IS of the ISC valve so as to keep the revolution rate of the engine at the idling revolution rate.

In FIGS. 6 through 12 are shown flowcharts illustrating the algorithms of the program practiced by the CPU 110 in case that the electronic control unit 1 controls the four cylinder internal combustion engine.

Figure 6:
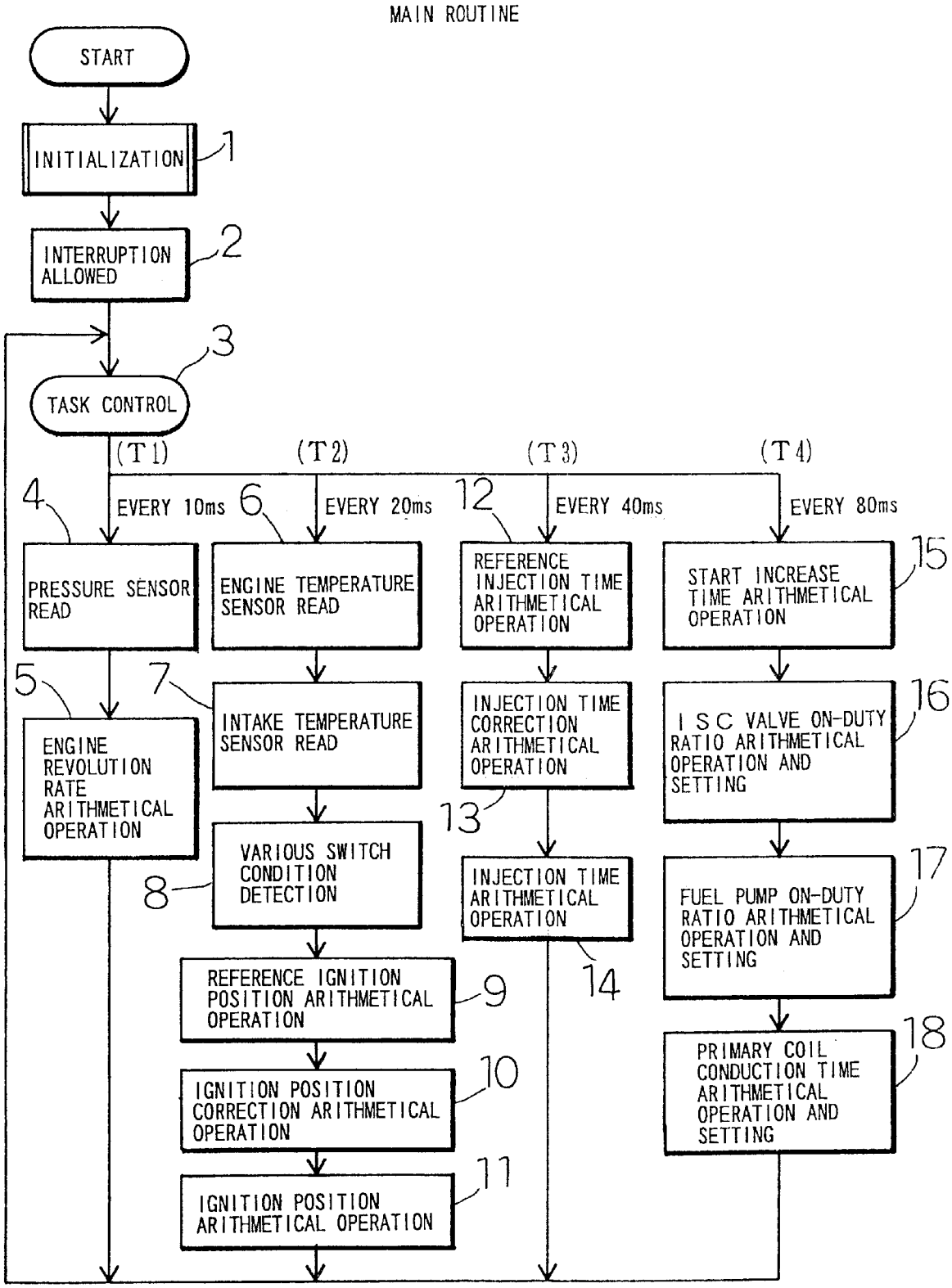
FIG. 6 is a flow chart showing an algorithm of a main routine of a program practiced by a CPU of the control apparatus of the invention.

In the main routine shown in FIG. 6, an initialization is made at the step 1 of the main routine and after an interruption is allowed at the step 2 thereof, the operation is transferred to the step 3 where a task control starts. In this task control, first through fourth tasks T1 through T4 are done every 10 msec., 20 msec., 40 msec. and 80 msec. In the first task T1, at first the output of the pressure sensor 8 detecting the atmospheric pressure is read at the step 4 and then the revolution rate of the internal combustion engine is arithmetically operated on the generation period of the signal given from the crank shaft sensor 4 at the step 5. Thereafter, the operation is returned to the step 3.

In the second task T2, the output of the temperature sensor 9 detecting the engine temperature is read at the step 6 and then the output of the intake temperature sensor 10 is read at the step 7. Thereafter, the conditions of the various switches such as the idling switch 6 at the step 8 and the reference ignition position relative to the revolution rate obtained by the arithmetical operation at the task T1 is arithmetically operated at the step 9 by using an ignition position arithmetically operating map. Then, the correction amount by which the ignition position should be multiplied is arithmetically operated on the control conditions (such as the atmospheric pressure, the engine temperature, the intake temperature and so on) read from the various sensors at the step 10 and the actual ignition position is arithmetically operated by multiplying the reference ignition position arithmetically operated at the step 9 by the correction amount arithmetically operated by the step 10. Thus, the operation is returned to the step 3.

In the third task T3, the reference fuel injection time is arithmetically operated relative to the opening degree of the throttle valve and the revolution rate of the engine at the step 12 and the fuel injection correction amount by which the reference injection time should be multiplied arithmetically operated relative to the outputs from the various sensors read at the steps 6 through 8 at the step 13. Then, the actual injection time is arithmetically operated by multiplying the reference injection time by the injection time correction amount at the step 14. Thereafter, the operation is returned to the step 3.

In the fourth task T4, the start increase time is arithmetically operated which should be added to the reference injection time in order to increase the amount of supply of the fuel at the start of the engine at the step 15. Then, the on-duty ratio of the current which should be supplied to the drive coil of the ISC valve is arithmetically operated and the drive current is supplied to the ISC valve drive circuit C at the step 16 so that the circuit is turned on and off with the duty ratio at the step 16. Also, the on-duty ratio of the current which should be supplied to the pump motor PM of the fuel pump is arithmetically operated and the drive current is supplied to the pump motor PM so that the pump motor is turned on and off with the duty ratio at the step 17. Thereafter, the conduction times of the primary coils of the ignition coils IG14 and IG23 are arithmetically operated at the step 18 on the ignition position arithmetically operated at the step 11 and the revolution rate arithmetically operated at the step 5. The operation is returned to the step 3.

Figure 7:
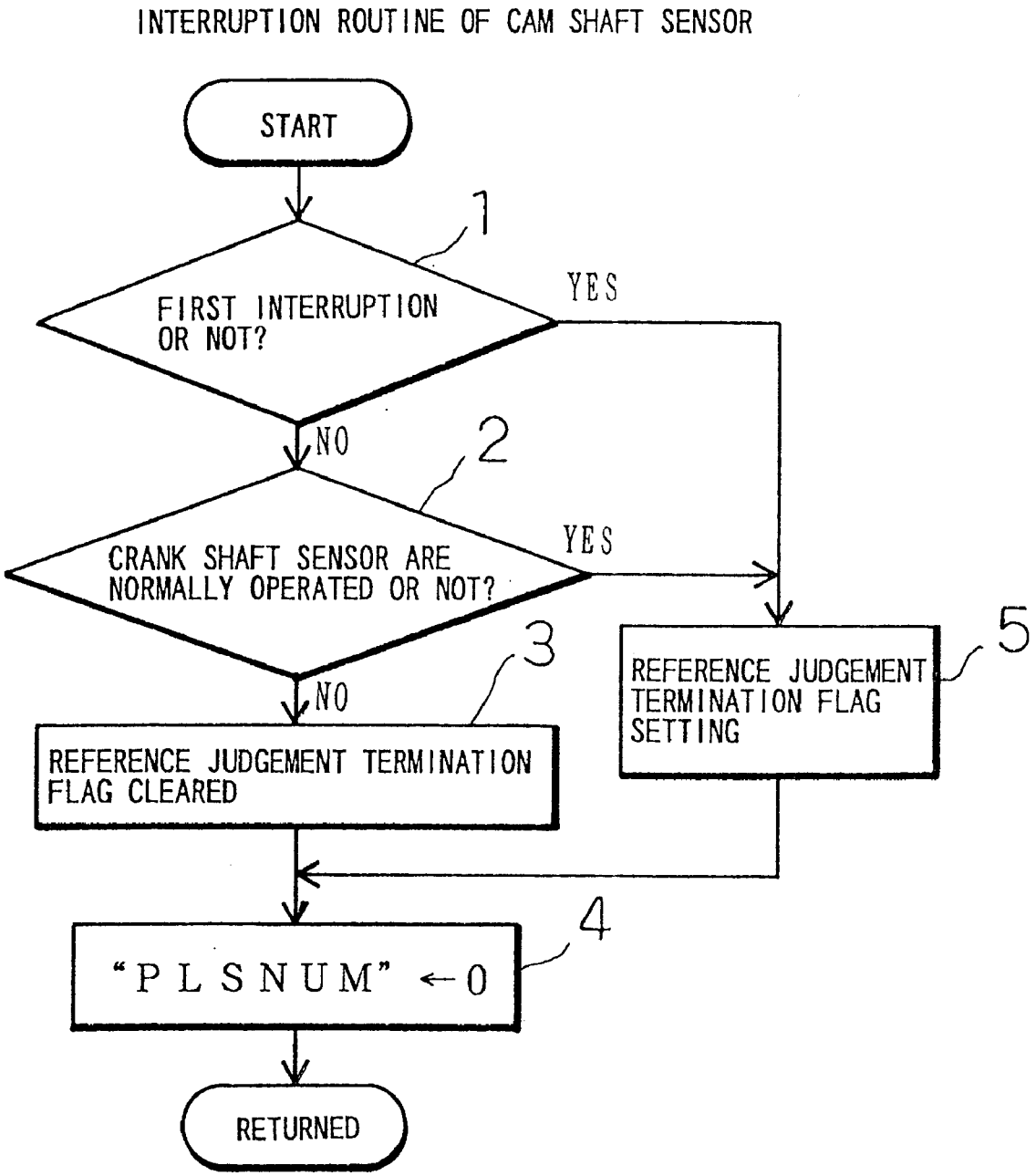
FIG. 7 is a flow chart showing an algorithm of a cam shaft sensor interruption routine of the program practiced by the CPU of the control apparatus of the invention.

Whenever it is detected that the cam shaft sensor 5 generates the reference judgement pulse Sa, the interruption is made in the main routine of FIG. 6 so that the interruption routine shown in FIG. 7 is practiced. In this interruption routine, at first it is judged whether the present interruption is a first interruption or not at the step 1 and when it is judged that it is not the first interruption, the operation is transferred to the step 2 where it is judged whether the pulse numbers PLSNUM of 0, 1, - - - , 7 sequentially assigned to the pulses generated by the crank shaft sensor becomes 8 or not (or whether all the eight pulses generated by the crank shaft sensor are normally generated during one revolution of the crank shaft). As a result, when it is judged that the pulse number PLSNUM is not 8, the operation is transferred to the step 3 where the reference judgement termination flag is cleared and then transferred to the step 4 where after the pulse number PLSNUM contained in the RAM is made 0, the operation is transferred to the main routine.

It will be noted that the interruption routine of FIG. 7 is provided for confirming whether the reference judgement pulses generated by the cam shaft sensor are detected and also for transferring to zero the number of the output pulses generated by the crank shaft sensor after the reference judgment pulses are detected.

Figure 8:
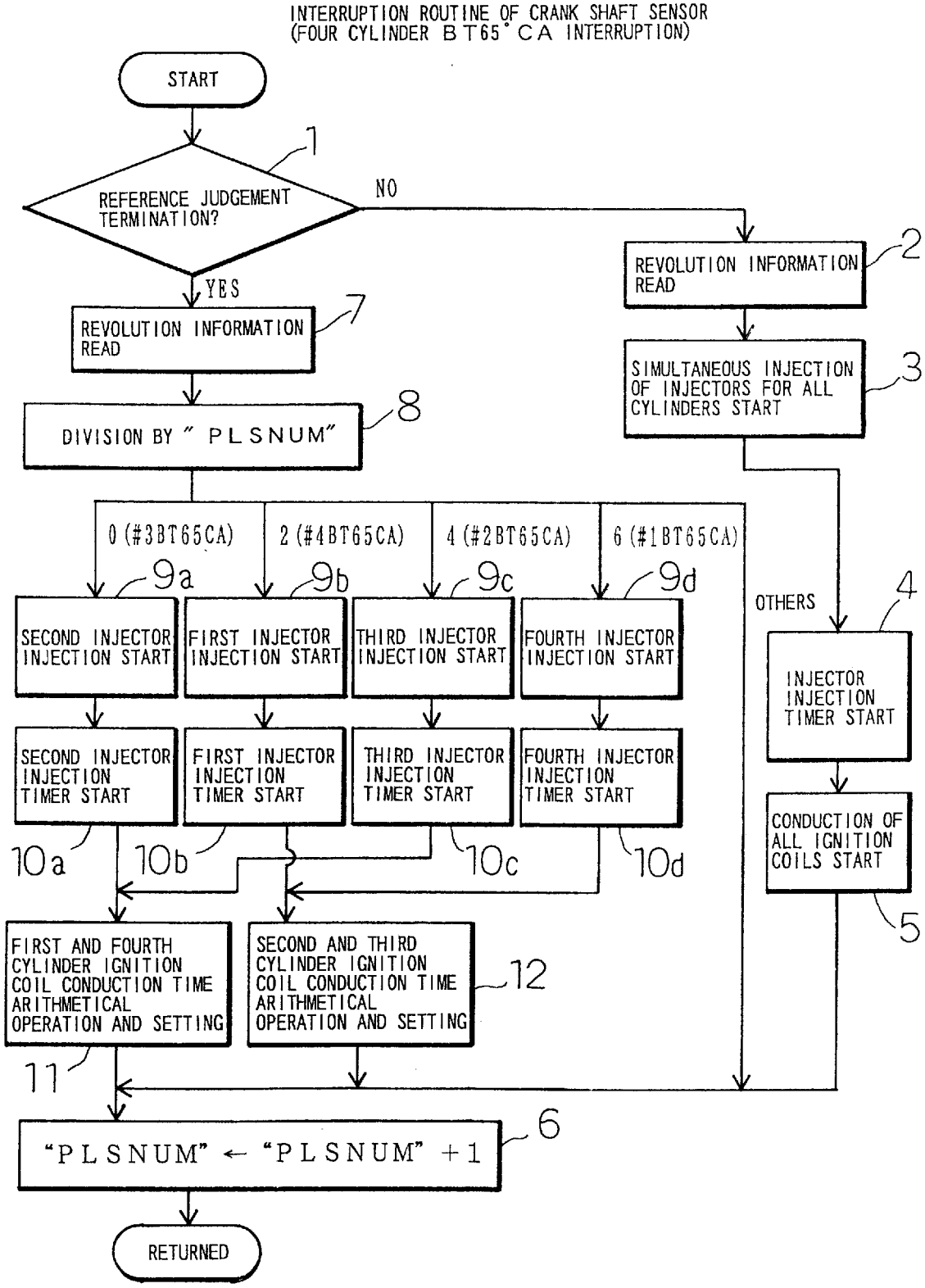
FIG. 8 is a flow chart showing an algorithm of a crank shaft sensor interruption routine of the program practiced by the CPU of the control apparatus of the invention.

When the crank shaft sensor 4 generates every reference position detection pulse at the reference position of 65° prior to the top dead center of each of the cylinders, the interruption routine of FIG. 8 is practiced.

In this interruption routine, it is judged whether the reference judgment flag is set or not at the step 1. As a result, when it is judged that the reference judgement flag is not set (or no reference judgement pulse is detected), the operation is transferred to the step 2 where the revolution rate information (or a count value of a free running counter) used for arithmetically operating the revolution rate in the main routine is read and transferred to the step 3 where the drive signals are applied to the injector drive circuit for all the cylinders to inject the fuel from the injectors IJ1 through IJ4 for all the cylinders. Thereafter, in the step 4, the injector injection timer which arithmetically operates the fuel injection time starts and in the step 5 where after the conduction of the primary coils of all the ignition coils IG14 and IG23 starts, the operation is transferred to the step 6 where "1" is added to the content of the pulse number PLSNUM and then the operation is returned to the main routine.

The reference judgement pulse generated by the cam shaft sensor is detected and when it is judged that the reference judgement termination flag is set at the step 1 of the interruption routine of FIG. 8, the operation is transferred to the step 7 where the revolution rate information is read and thereafter transferred to the step 8 where it is divided into either of the steps 9*a* through 9*d* in accordance with the value of the pulse number PLSNUM.

More particularly, when the value of the pulse number PLSNUM is 0 (or when the present reference position detection pulse is generated at the position of 65° prior to the top dead center of the third cylinder), the operation is transferred to the step 9*a* where the fuel is injected from the injector IJ2 for the second cylinder and then transferred to the step 10*a* where the second injector injection timer for counting the injection time of the injector for the second cylinder starts. Thereafter, the operation is transferred to the step 11 where the time counted by the ignition coil conduction timer for the first and fourth cylinders is arithmetically operated and the measurement of the conduction time by the ignition coil conduction timer for the first and fourth cylinders starts. Then, the operation is transferred to the step 6 where "1" is added to the content of the pulse number PLSNUM and then the operation is returned to the main routine.

In the step 8, when the value of the pulse number PLSNUM is 2 (or when the present reference position detection pulse is generated at the position of 65° prior to the top dead center of the fourth cylinder), the operation is transferred to the step 9*b* where the fuel is injected from the injector IJ1 for the first cylinder and then transferred to the step 10*b* where the first injector injection timer for counting the injection time of the injector for the first cylinder starts. Thereafter, the operation is transferred to the step 12 where the time counted by the ignition coil conduction timer for the second and third cylinders is arithmetically operated and the measurement of the conduction time by the ignition coil conduction timer for the second and third cylinders starts. Then, the operation is transferred to the step 6 where only "1" is added to the content of the pulse number PLSNUM.

In the step 8, when the value of the pulse number PLSNUM is 4 (or when the present reference position detection pulse is generated at the position of 65° prior to the top dead center of the second cylinder), the operation is transferred to the step 9*c* where the fuel is injected from the injector IJ3 for the third cylinder and then transferred to the step 10*c* where the third injector injection timer for counting the injection time of the injector for the third cylinder starts. Thereafter, the operation is transferred to the step 11 where the time counted by the ignition coil conduction timer for the first and fourth cylinders is arithmetically operated and the measurement of the conduction time by the ignition coil conduction timer for the first and fourth cylinders starts. Then, the operation is transferred to the step 6 where only "1" is added to the content of the pulse number PLSNUM and returned to the main routine.

In the step 9, when the value of the pulse number PLSNUM is 6 (or when the present reference position detection pulse is generated at the position of 65° prior to the top dead center of the first cylinder), the operation is transferred to the step 9*d* where the fuel is injected from the injector IJ4 for the fourth cylinder and then transferred to the step 10*d* where the fourth injector injection timer for counting the injection time of the injector for the fourth cylinder starts. Thereafter, the operation is transferred to the step 12 where the time counted by the ignition coil conduction timer for the second and third cylinders is arithmetically operated and the measurement of the conduction time by the ignition coil conduction timer for the second and third cylinders starts. Then, the operation is transferred to the step 6 where only "1" is added to the content of the pulse number PLSNUM and returned to the main routine.

In the step 8, when the value of the pulse number is not either of 0, 2, 4 and 6, nothing is done and the operation is transferred to the step 6 where only "1" is added to the content of the pulse number PLSNUM.

Figure 9:
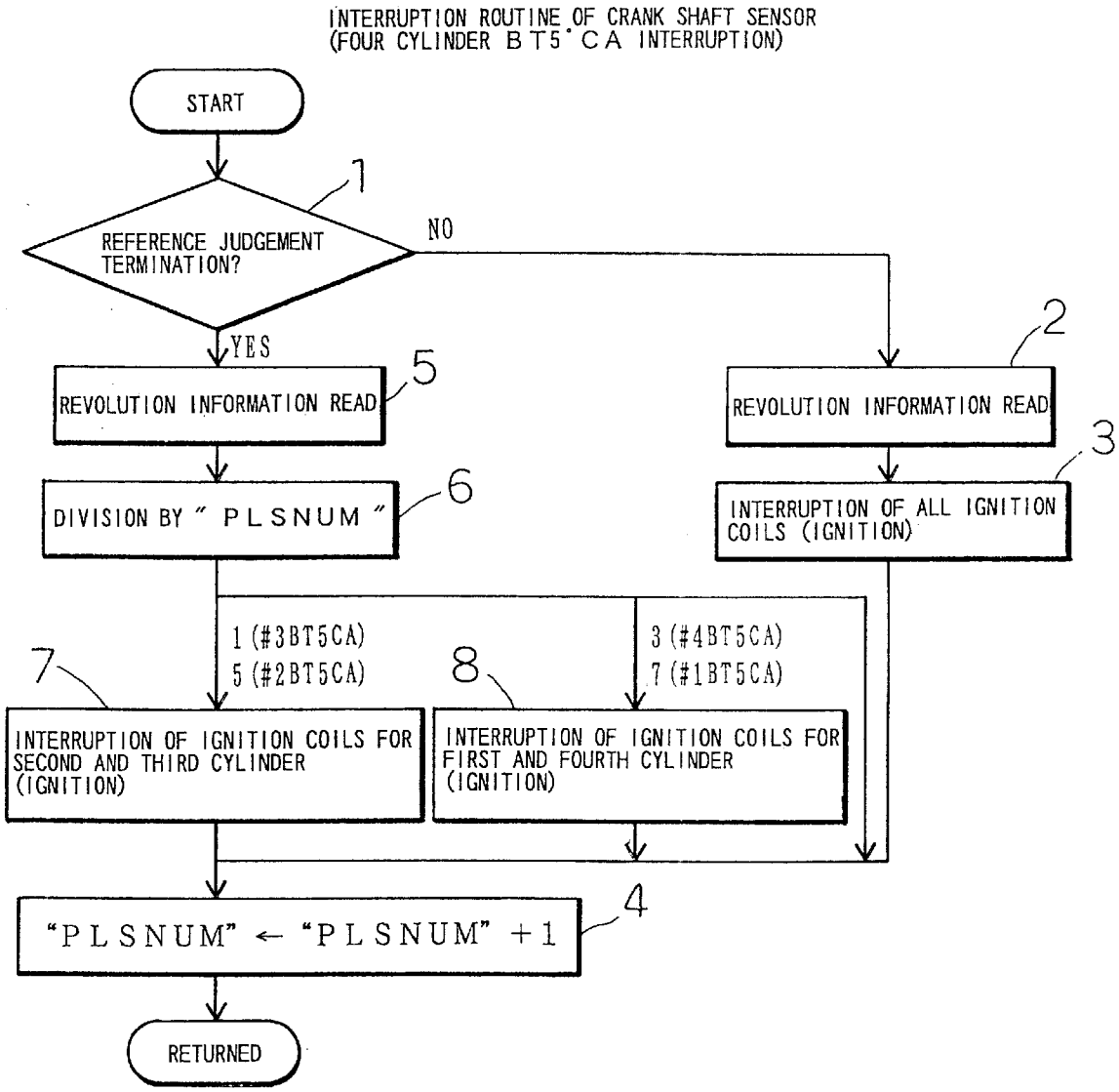
FIG. 9 is a flow chart showing an algorithm of another crank shaft sensor interruption routine of a program practiced by the CPU of the four-cylinder internal combustion engine control apparatus of the invention.

When the crank shaft sensor 4 generates every low revolution ignition position detection pulse at the position of 5° prior to the top dead center, the interruption routine of FIG. 9 is practiced. In this interruption routine, it is judged whether the reference judgment termination flag is set or not at the step 1. As a result, when it is judged that the reference judgement termination flag is not set (or no reference judgement pulse is detected), the operation is transferred to the step 2 where the revolution rate information and at the next step 3, the conduction of all the ignition coils are stopped so that the primary current through the ignition coils IG14 and IG23 is interrupted. The interruption of the primary current induces the igniting high voltage simultaneously across the secondary coils of the ignition coils IG14 and Ig23 whereby the ignition plugs PL1 through PL4 are simultaneously ignited. After the primary current through all the ignition coils is interrupted and all the ignition plugs are ignited, the operation is transferred to the step 4 where only "1" is added to the storage content of the pulse number PLSNUM and returned to the main routine.

Thus, it will be noted that in the extreme low revolution range of the engine where the cam shaft sensor cannot detect the reference judgement pulse, all the cylinders are ignited when every low revolution ignition position detection pulse is generated.

The reference judgement pulse generated by the cam shaft sensor is detected and when the reference judgement is judged to terminate at the step 1 of the interruption routine of FIG. 9, the operation is transferred to the step 5 where the revolution rate information is read and then transferred to the step 6 where the operation is transferred to the step 7 or 8 in accordance with the value stored by the pulse number PLSNUM. More particularly, when the value of the pulse number PLSNUM is 1 or 5, the operation is transferred to the step 7 where the primary current through the ignition coil IG23 for the second and third cylinders is interrupted so that the ignition operation is made in the second and third cylinders. When the value of the pulse number PLSNUM is 3 or 7, the operation is transferred to the step 8 where the primary current through the ignition coil IG14 for the first and fourth cylinders is interrupted so that the ignition operation is made in the first and fourth cylinders.

Figure 10A:
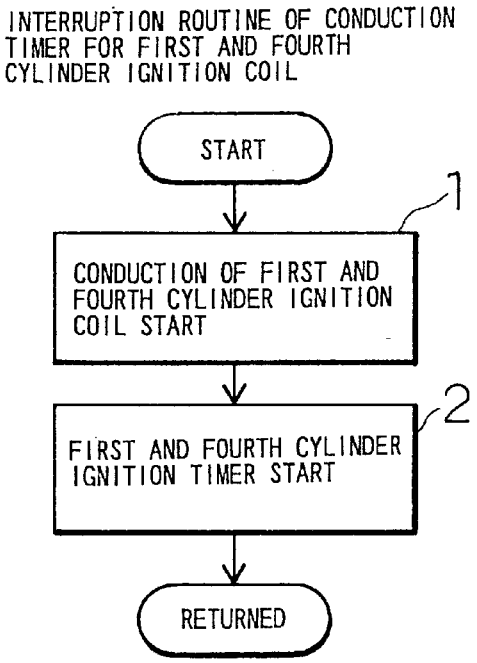
FIG. 10A is a flow chart showing an algorithm of first and fourth ignition coil conduction timer interruption routine of the program practiced by the CPU of the four-cylinder internal combustion engine control apparatus of the invention.

When the ignition coil conduction timer for the first and fourth cylinders starting in the interruption routine of FIG. 8 finishes to count the conduction start time, the interruption routine of the ignition coil conduction timer for the first and fourth cylinders of FIG. 10A is practiced. At the step 1 of this interruption routine, the conduction of the primary coil of the ignition coil IG14 for the first and fourth cylinders starts and at the step 2 thereof, the measurement of the ignition position arithmetically operated by the ignition timer for the first and fourth cylinders in the main routine starts and the operation is returned to the main routine.

Figure 10B:
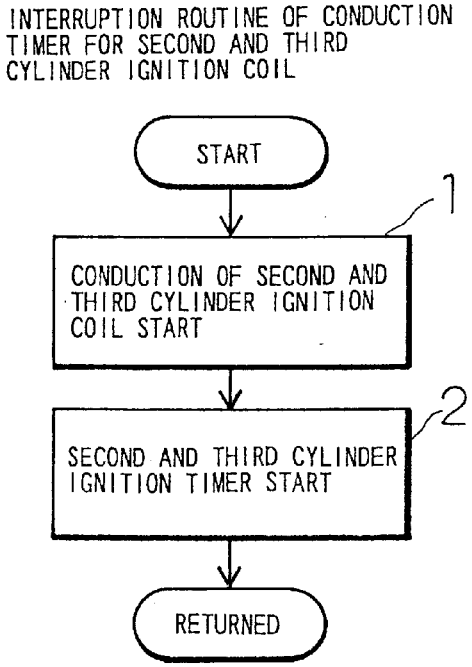
FIG. 10B is a flow chart showing an algorithm of second and third ignition coil conduction timer interruption routine of the program practiced by the CPU of the four-cylinder internal combustion engine control apparatus of the invention.

When the ignition coil conduction timer for the second and third cylinders finishes to count the conduction start time, the interruption routine of the ignition coil conduction timer for the second and third cylinders of FIG. 10B is practiced. At the step 1 of this interruption routine, the conduction of the primary coil of the ignition coil IG23 for the second and third cylinders starts and at the step 2 thereof, the measurement of the ignition position arithmetically operated by the ignition timer for the second and third cylinders in the main routine starts and the operation is returned to the main routine.

Figure 11A:
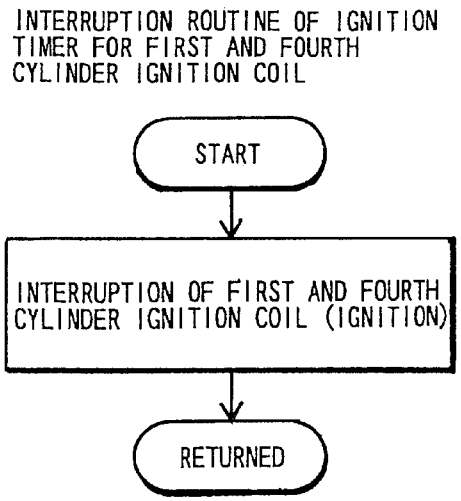
FIG. 11A is a flow chart showing an algorithm of first and fourth ignition timer interruption routine of the program practiced by the CPU of the four-cylinder internal combustion engine control apparatus of the invention.

When the measurement of the ignition position made by the ignition timer for the first and fourth cylinders is finished, the interruption routine of the ignition timer for the first and fourth cylinders of FIG. 11A is practiced and the primary current through the ignition coil IG14 for the first and fourth cylinders is interrupted. This makes the simultaneous ignition operation in the first and fourth cylinders.

Figure 11B:
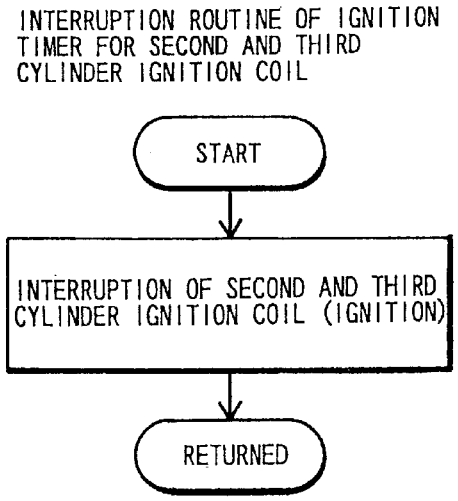
FIG. 11B is a flow chart showing an algorithm of second and third ignition timer interruption routine of the program practiced by the CPU of the four-cylinder internal combustion engine control apparatus of the invention.

When the measurement of the ignition position made by the ignition timer for the second and third cylinders is finished, the interruption routine of the ignition timer for the second and third cylinders of FIG. 11B is practiced and the primary current through the ignition coil IG23 for the second and third cylinders is interrupted and the simultaneous ignition operation in the second and third cylinders is made.

Furthermore, when the measurement of the injection time made by the first through fourth injector injection timers is finished, there are practiced the interruption routines of FIGS. 12A through 12D in which the injection instruction signals U1 through U4 supplied to the injector injection drive circuits A1 through A4 for the first through fourth cylinders stops being supplied whereby the injection of the fuel from the injectors are stopped.

In the aforementioned embodiment, the urgent fuel injection control means is accomplished by the steps 1 through 4 of the interruption routine of FIG. 8 and the interruption routine of FIG. 12 to apply the injection instruction signals U1 through U4 to the fuel injection system so that the injection of the fuel from the injectors for all the cylinders starts at the position where the crank shaft sensor generates each of the reference position detection pulses under the condition of being unable to detect any reference judgement pulse from the cam shaft sensor when the revolution rate of the internal combustion engine is within the extremely low revolution range to inject the fuel from the injectors for a set time.

Furthermore, the urgent ignition control means is accomplished by the steps 1, 2 and 5 of the interruption routine of FIG. 8 and the interruption routines 1, 2 and 3 of FIG. 9 to apply the ignition signals to the ignition system so as to simultaneously make the ignition operation in all the cylinders at the position where the crank shaft sensor generates each of the low revolution ignition position detection signals under the condition of being unable to detect any reference judgement pulse from the cam shaft sensor.

Also, the reference position detection pulse judgment means is accomplished by the steps 1 and 4 of the interruption routine of FIG. 7, the steps 1 and 4 of the interruption routine of FIG. 9 and the steps 1 and 6 of the interruption routine of FIG. 9 to judge which of the cylinders each of a series of reference position detection pulses detects the reference position for by distinguishing the generation order of the series of the reference position detection pulses after the reference position detection pulses are generated when the reference judgement pulses are detected.

The fuel injection time arithmetical operation means is accomplished by the task T3 of the main routine of FIG. 6 to arithmetically operate the fuel injection time of the injector for each of the cylinders under the predetermined control conditions and the ignition position arithmetical operation means is accomplished by the task 2 thereof to arithmetically operate the ignition position for each of the cylinders under the predetermined control conditions.

The constant fuel injection control means is accomplished by the step 1, the steps 7 and 8 and the steps 9*a* through 9*d* and 10*a* through 10*d* and the interruption routine of FIGS. 12A through 12D to apply the injection instruction signal to the fuel injection system so as to start the injection of the fuel from the injector for each of the cylinders at the position where the reference position detection pulse for each of the cylinders judged by the reference position detection judgement pulse judgement means is generated and to stop the injection of the fuel when the fuel injection time arithmetically operated by the fuel injection arithmetical operation means lapses.

The constant ignition position control means is accomplished by the steps 1, 7, 8, 11 and 12 of FIG. 8, the interruption routines of FIGS. 10A and 10B and the interruption routine of FIGS. 11A and 11B to apply the ignition signal to the ignition system so as to start the measurement of the ignition position of each of the cylinders arithmetically operated by the ignition position arithmetical operation means at the position where the reference position detection pulse for each of the cylinders judged by the reference position detection pulse judgement means is generated when the revolution rate of the internal combustion engine is within the constant revolution range and to make the ignition operation at each of the cylinders when the thus arithmetically operated ignition position for each of the cylinders is measured.

The construction of the control apparatus in which the four cycle three-cylinder internal combustion engine is controlled will be described with reference to FIGS. 4, 5, 6, 7 and 13 through 18. herein just below.

In case that the four cycle three-cylinder internal combustion engine, the crank shaft sensor 4 comprises a rotor rotationally driven by the crank shaft of the internal combustion engine and having first through third reluctors 12*a* through 12*c* provided at an equal distance of 120° angle corresponding to the three cylinders, respectively and a signal generator 13 to generate pulses of different polarities when the reluctors on the rotor 12 at their front edge and at their rear edge as viewed in the rotational direction, respectively. The relation of position between the reluctors 12*a* through 12*c* on the rotor 12 and the signal generator 13 is so set as to generate a reference position detection pulse and a low revolution ignition position detection pulse when the signal generator detects the front edge 12*a*1~12*c*1 and the rear edge 12*a*2~12*c*2 of each of the reluctors corresponding to each of the cylinders at a position advanced relative to the low revolution ignition position of each of the cylinders and at a low revolution ignition position of each of the cylinders set near the top dead center in the compression stroke of each of the cylinders, respectively.

Figure 4:
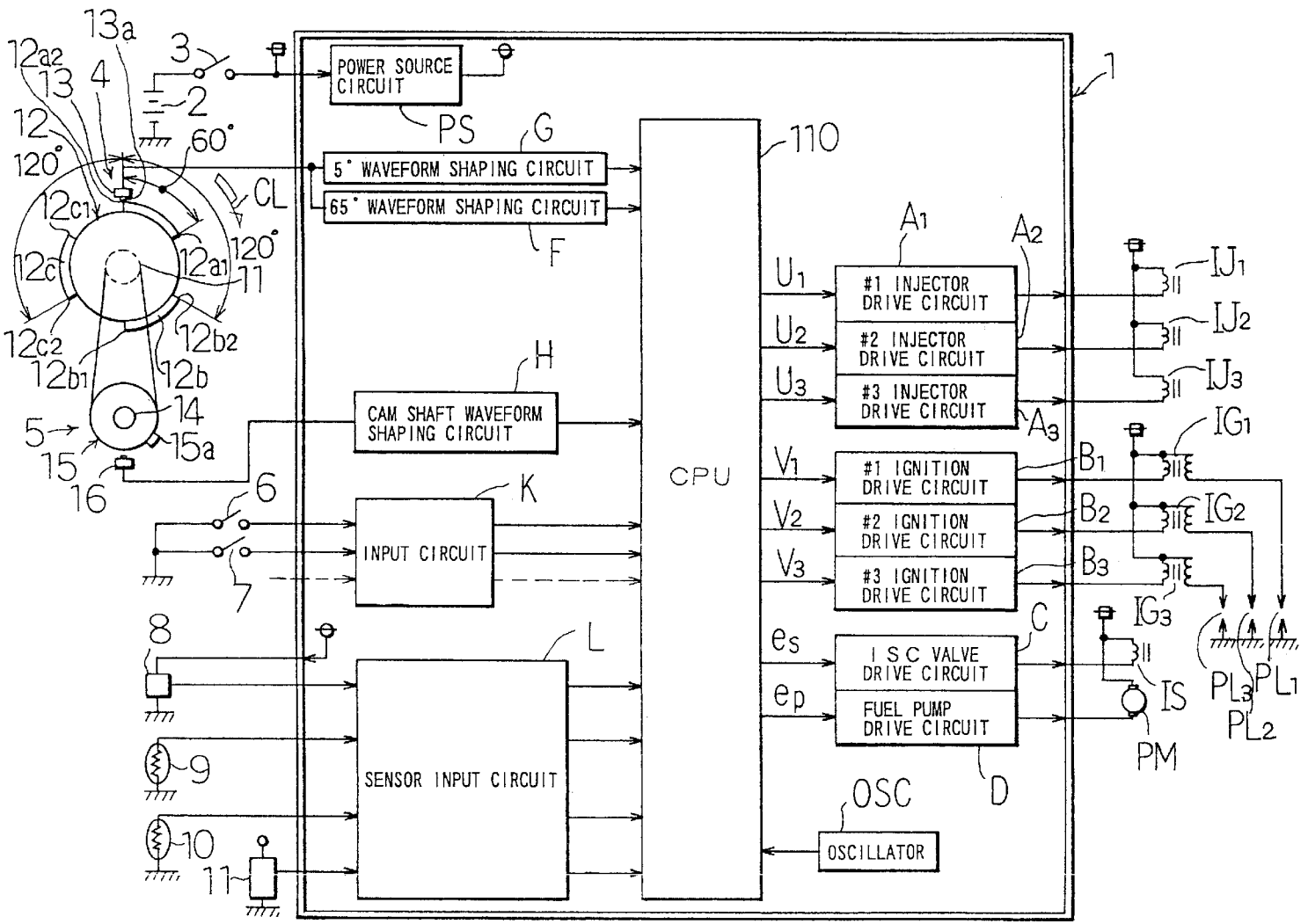
FIG. 4 is a block diagram illustrating a construction of a hardware for a control apparatus to control a four cycle three-cylinder internal combustion engine and to which the present invention is applied.

In the illustrated embodiment, the first through third reluctors corresponding to the first through third cylinders, respectively, are so provided as to be sequentially placed in line in a forwardly rotational direction of the rotor 12 (in the direction indicated by an arrow CL in FIG. 4). Thus, as the rotor rotates, the pulse signal is induced in the pulser coil 4*a* of the signal generator 13 in order of the negative pulse S1, the positive pulse S1', the negative pulse S3, the positive pulse S3', the negative pulse S2, the positive pulse S2', the negative pulse S1 and the positive pulse S1' as indicated by FIG. 5B.

In the present embodiment, the front edge of the reluctor corresponding to each of the cylinders as viewed in FIG. 4 passes the magnetic pole portion 13*a* of the signal generator 13 at the reference position of each of the cylinders (the position of 65° prior to the top dead center of the first cylinder) once per two revolutions of the crank shaft. The pulses S1, S2, S3 - - - generated at a distance of 240° (or every other pulse) among a series of negative pulses S1, S3, S2 and S1 - - - generated by the signal generator 13 may be used for the reference position detection pulses for the first cylinder, respectively while the pulses S3', S2', S1' - - - generated at a distance of 240° (or every other pulse) among a series of positive pulses S1', S2', S3' and S1' - - - generated by the signal generator 13 may be used for the low revolution ignition position detection pulses for the first through third cylinders, respectively.

In case that the three-cylinder internal combustion engine is controlled, there are omitted the injector drive circuit A4 for the fourth cylinder and the injector IJ4 for the fourth cylinder shown in FIG. 1 and provided the ignition coils IG1 through IG3 for the first through third cylinders and the ignition drive circuits B1 through B3 for the first through third cylinders to control the primary current of these ignition coils. The ignition drive circuits B1 through B3 serve to supply the primary current to the ignition coils IG1 through IG3 when the ignition signals V1 through V3 are given from the CPU, respectively, and interrupt the primary current through the ignition coils IG1 through IG3 when the ignition signals V1 through V3 are extinguished to apply the igniting high voltage across the ignition plugs PL1 through PL3 provided in the first through third cylinders. The construction of the other hardware is substantially identical to that of the control apparatus for the four-cylinder engine illustrated in FIGS. 1 and 2.

Figures 5A, 5B, 5C, 5D, 5E, 5F, 5G, 5H, 5I, 5J, 5K, 5L, 5M, 5N:
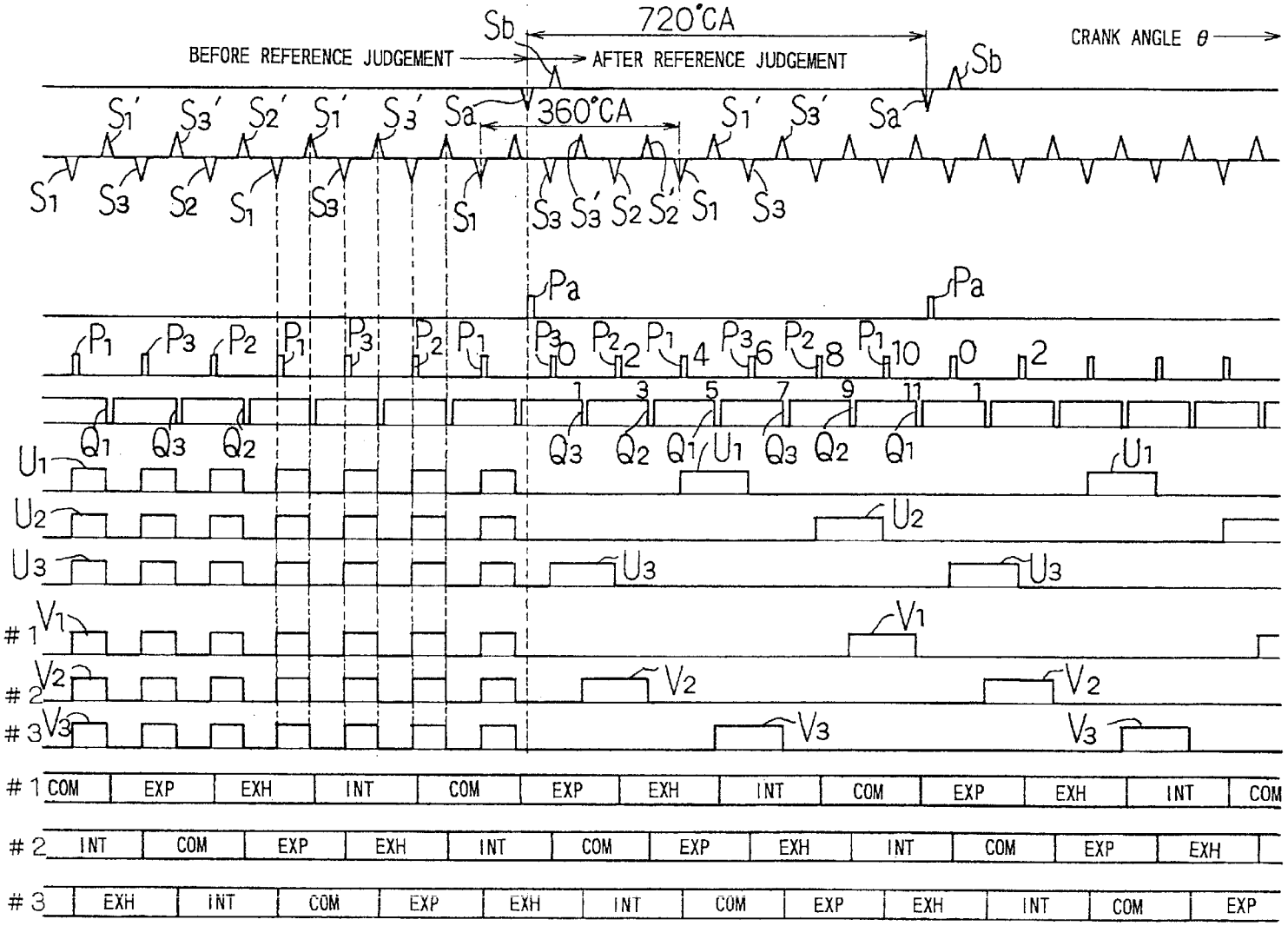
FIG. 5 shows waveforms of signals in various parts of the apparatus of FIG. 4.

The negative pulses S3, S2 and S1 - - - generated by the signal generator 13 are input to the 65° waveform shaping circuit F, which serves to convert the pulses into the signals P3, P2 and P1 - - - shown in FIG. 5D and input the latters to the CPU. These signals are generated once when the crank shaft rotates every one revolution. The signals P1 through P3 generated at a distance of 240° are used for the reference position detection signals P1 through P3 for the first through third cylinders.

The positive pulses S3', S2' and S1' - - - generated by the signal generator 13 are input to the 5° waveform shaping circuit G, which serves to convert the pulses into the negative logical signals Q3, Q2 and Q1 - - - shown in FIG. 5E and input the latters to the CPU. The signals Q1, Q2 and Q3 generated at the low revolution ignition positions set near the top dead center of the compression stroke for the first through third cylinders are used for the low revolution ignition position detection signals P1 through P3 for the first through third cylinders.

The CPU 110 sequentially assigns the numbers of 0, 1, 2, 3, 4, 5, 6, 7 - - - , 11 to the reference position detection signals and the low revolution ignition detection signals P3 and Q2, P2 and Q2, P1 and Q1 - - - sequentially input thereto after there is detected the reference judgment signal Pa obtained by shaping the reference judgement pulses Sa generated by the cam shaft sensor 5 as indicated in FIG. 5D and FIG. 5E and judges that the input signals P3 and Q3, P2 and Q2, P1 and Q1 - - - are the third cylinder reference position detection signal and the third cylinder low revolution ignition position detection signal, the second cylinder reference position detection signal and the second cylinder low revolution ignition position detection signal, the first cylinder reference position detection signal and the first cylinder low revolution ignition position detection signal - - - from the assigned numbers.

Also, the CPU 110 arithmetically operates the revolution rate of the engine from the generation period of the pulses generated by the crank shaft sensor 4 and then arithmetically operates the conduction start position and the interruption position (the ignition position) of the primary current of the ignition coil for the respective cylinders and the fuel injection time therefor relative to the arithmetically operated revolution rate and the control conditions detected by the various sensors 8 through 10.

The CPU 110 applies the injection instruction signals U1 through U3 of set time width to the injector drive circuits A1 through A3 of the fuel injection system as indicated a portion "before reference judgement" in FIGS. 5F through H, whereby the fuel starts to be injected simultaneously by the injectors IJ1 through IJ3 for the first through third cylinders and continues to be injected for the set time whenever the signal generator 13 of the crank shaft sensor 4 generates the reference position detection pulses S3, S2 and S1 - - - (or whenever the reference position detection signals P3, P2, P1, P3 - - - are input) when there cannot be detected any pulse Pa obtained by shaping the reference judgement pulse Sa. Thus, the fuel is injected simultaneously from the injectors for the first through third cylinders.

The CPU 110 also simultaneously applies the ignition signals VI though V3 (see FIGS. 5I through J) to the ignition drive circuits B1 through B34 everytime the signal generator 13 of the crank shaft sensor 4 detects the front edges of the respective reluctors to generate the negative pulses S3, S2 and S1 - - - under the condition in which the revolution rate of the engine is within the low revolution range to simultaneously supply the primary current through the ignition coils IG1 through IG3 for the first through third cylinders and to interrupt the ignition signals V1 through V3 when the signal generator 13 detects every rear edge of the respective reluctors to generate the positive pulses S3', S2' and S1' - - - whereby the primary current through the ignition coils IG1 through IG3 for the first through third cylinders are interrupted so that the igniting high voltage is induced simultaneously across the secondary coils of the ignition coils IG1 through IG3.

The steps L through N of FIG. 5 designate the combustion cycles of the first, second and third cylinders, respectively.

In these steps, "EXP", "EXH", "INT" and "COM" express the explosion stroke, the exhaust stroke, the intake stroke and the compression stroke, respectively.

Since the crank shaft sensor 4 shown in FIG. 4 generates the negative and positive pulses, respectively at the distance of 120°, the simultaneous ignition operation is made in the first through third cylinders when the signal generator 13 detects every rear edge of the respective reluctors to generate the positive pulses, which causes the respective cylinders to have the ignition operation twice in the compression stroke. In this case, when the first ignition operation is made at the beginning of the compression stroke, the mixture gas will be developed to the combustion with low probability even though the ignition operation is made because the piston is located near the bottom dead center so as to have a low compression ratio and also have a light load of the engine. Thus, in practice, the second ignition operation made at the end of the compression stroke ignites the mixture gas and therefore the engine starts without any trouble.

The inventors confirm in an ignition test of the four cycle three-cylinder internal combustion engine that the engine could start without any trouble even though the three cylinders are simultaneously ignited at the distance of 120° when it should start.

In order that the engine more easily starts, the first ignition operation in the compression stroke of the respective cylinders is desirably made at the position closer to the bottom dead center of the piston, if possible. To this end, the low revolution ignition position is advanced by some degree relative to the top dead center of the piston in the compression stroke, but as it is excessively advanced, the piston will be forced backward at the start of the engine. This causes the failure of the start of the engine. Thus, in case that the invention is applied to the three-cylinder internal combustion engine, it will be noted that the low revolution ignition position should be determined to be at such a proper position as the first ignition operation is made closer to the bottom dead center without any backward movement of the piston.

Although all the injectors for the all the cylinders simultaneously inject the fuel at the extreme low revolution range where the reference judgement pulse cannot be detected, the fuel is never excessively supplied to the respective cylinders by properly adjusting the drive current supplied to the pump motor of the fuel pump so as to regulate the injection amount of the fuel in a suitable manner.

Flow charts showing algorithm of a program practiced by the CPU 110 in case the electronic control unit 1 controls the four cycle three-cylinder internal combustion engine are illustrated in FIGS. 6, 7 and 13 through 17.

In case that the four cycle three-cylinder internal combustion engine is controlled, a construction of a main routine is similar to that shown in FIG. 6 and a cam shaft sensor interruption routine is similar to that shown in FIG. 7.

Figure 13:
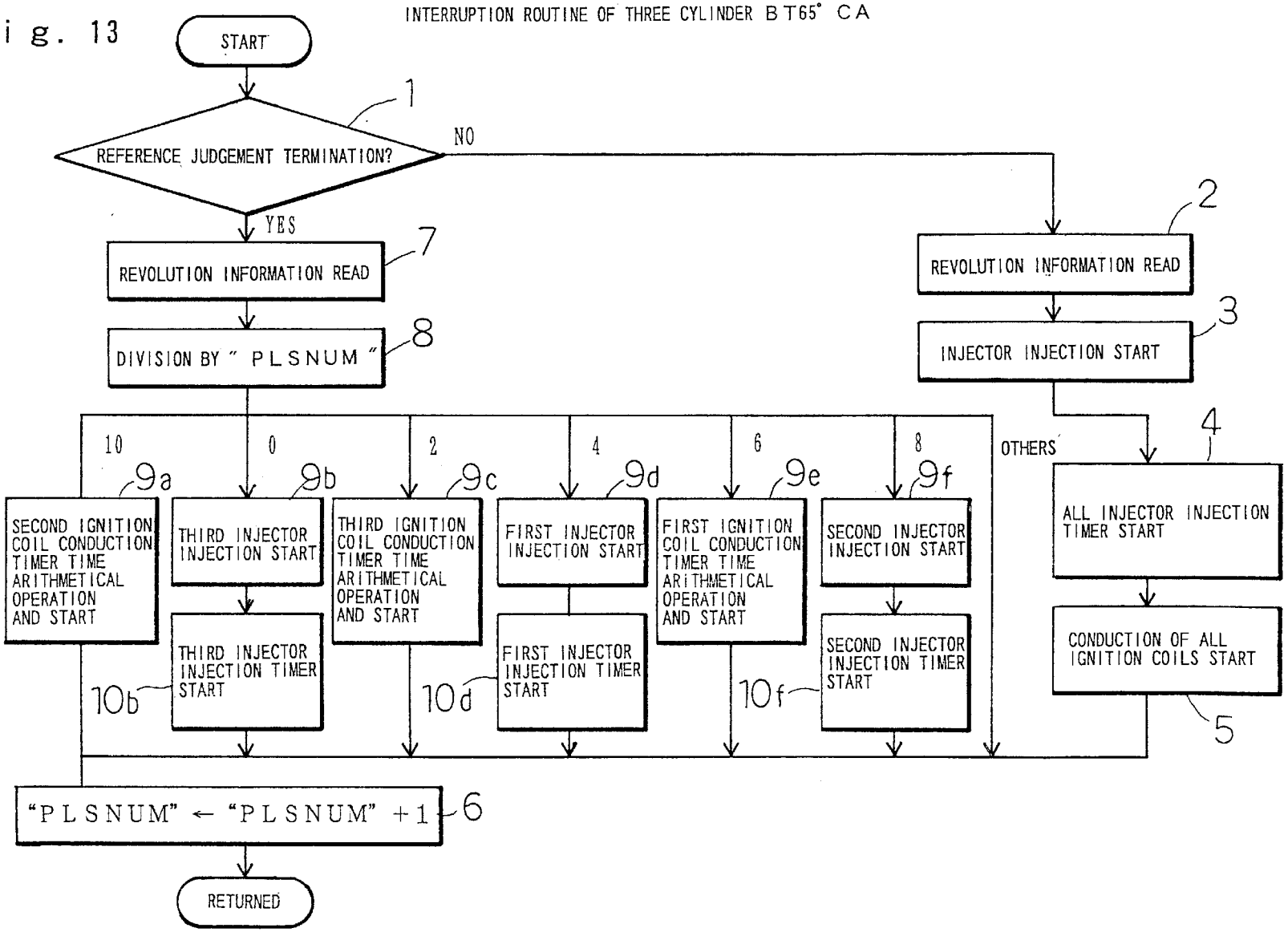
FIG. 13 is a flow chart showing an algorithm of a crank shaft sensor interruption routine of a program practiced by the CPU of the three-cylinder internal combustion engine control apparatus of the invention.

In case that the four cycle three-cylinder internal combustion engine is controlled, the interruption routine of FIG. 13 is practiced when the crank shaft sensor 4 generates every negative pulse at the position of 65° prior to the top dead center of the respective cylinders. In this interruption routine, it is judged whether the reference judgment terminates or not (or whether a reference judgement termination flag is set or not) at the step 1. As a result, when it is judged that the reference judgement termination flag is not set (or no reference judgement pulse is detected), the operation is transferred to the step 2 where the revolution rate information is read and further transferred to the step 3 where the drive signals are applied to the injector drive circuit for all the cylinders to simultaneously inject the fuel from the injectors IJ1 through IJ3 for all the cylinders. Thereafter, at the step 4, all the injector injection timers for arithmetically operating the fuel injection time starts and after, at the step 5, the conduction of the primary coils of all the ignition coils IG1 through IG3 starts, the operation is transferred to the step 6 where "1" is added to the content of the pulse number PLSNUM and then the operation is returned to the main routine.

The reference judgement pulse generated by the cam shaft sensor is detected and when it is judged that the reference judgement termination flag is set at the step 1 of the interruption routine of FIG. 13, the operation is transferred to the step 7 where the revolution rate information is read and thereafter transferred to the step 8 where it is divided into either of the steps 9*a* through 9*f* in accordance with the value of the pulse number PLSNUM.

More particularly, when the value of the pulse number PLSNUM is 10 (or when the present reference position detection pulse is generated at the position of 65° prior to the top dead center of the compression stroke of the first cylinder), the operation is transferred to the step 9*a* where the conduction start time of the primary current through the ignition coil for the second cylinder is arithmetically operated and the timer for counting the conduction start time starts. Then, the operation is transferred to the step 6 where "1" is added to the content of the pulse number PLSNUM and then the operation is returned to the main routine.

At the step 8, when the value of the pulse number PLSNUM is 0, the operation is transferred to the step 9*b* where the fuel starts to be injected from the injector IJ3 for the third cylinder and then transferred to the step 10*b* where the third injector injection timer for counting the injection time of the injector for the third cylinder starts. Thereafter, the operation is transferred to the step 6 where only "1" is added to the content of the pulse number PLSNUM.

At the step 8, when the value of the pulse number PLSNUM is 2 (or when the present reference position detection pulse is generated at the position of 65° prior to the top dead center of the compression stroke of the second cylinder), the operation is transferred to the step 9*c* where the conduction start time of the primary current through the ignition coil for the third cylinder is arithmetically operated and the conduction timer for counting the conduction start time starts as well. Then, the operation is transferred to the step 6 where only "1" is added to the content of the pulse number PLSNUM and returned to the main routine.

At the step 8, when the value of the pulse number PLSNUM is 4, the operation is transferred to the step 9*d* where the injection of the fuel from the injector IJ1 for the first cylinder starts and then transferred to the step 10*d* where the first injector injection timer for counting the injection time of the injector for the first cylinder starts. Then, the operation is transferred to the step 6 where only "1" is added to the content of the pulse number PLSNUM and returned to the main routine.

At the step 8, when the value of the pulse number PLSNUM is 6 (or when the present reference position detection pulse is generated at the position of 65° prior to the top dead center of the compression stroke of the third cylinder), the operation is transferred to the step 9*e* where the conduction start time of the primary current through the ignition coil for the first cylinder is arithmetically operated and the conduction timer for counting the conduction start time starts as well. Then, the operation is transferred to the step 6 where only "1" is added to the content of the pulse number PLSNUM and returned to the main routine.

At the step 8, when the value of the pulse number PLSNUM is 8, the operation is transferred to the step 9*f* where the injection of the fuel from the injector IJ2 for the second cylinder starts and then transferred to the step 10*f* where the second injector injection timer for counting the injection time of the injector for the second cylinder starts. Then, the operation is transferred to the step 6 where only "1" is added to the content of the pulse number PLSNUM and returned to the main routine.

Although not shown, at the step 8 of the interruption routine of FIG. 13, when the value of the pulse number is not either of 10, 0, 2, 4, 6 and 8, nothing is done and the operation is transferred to the step 6 where only "1" is added to the content of the pulse number PLSNUM.

Figure 14:
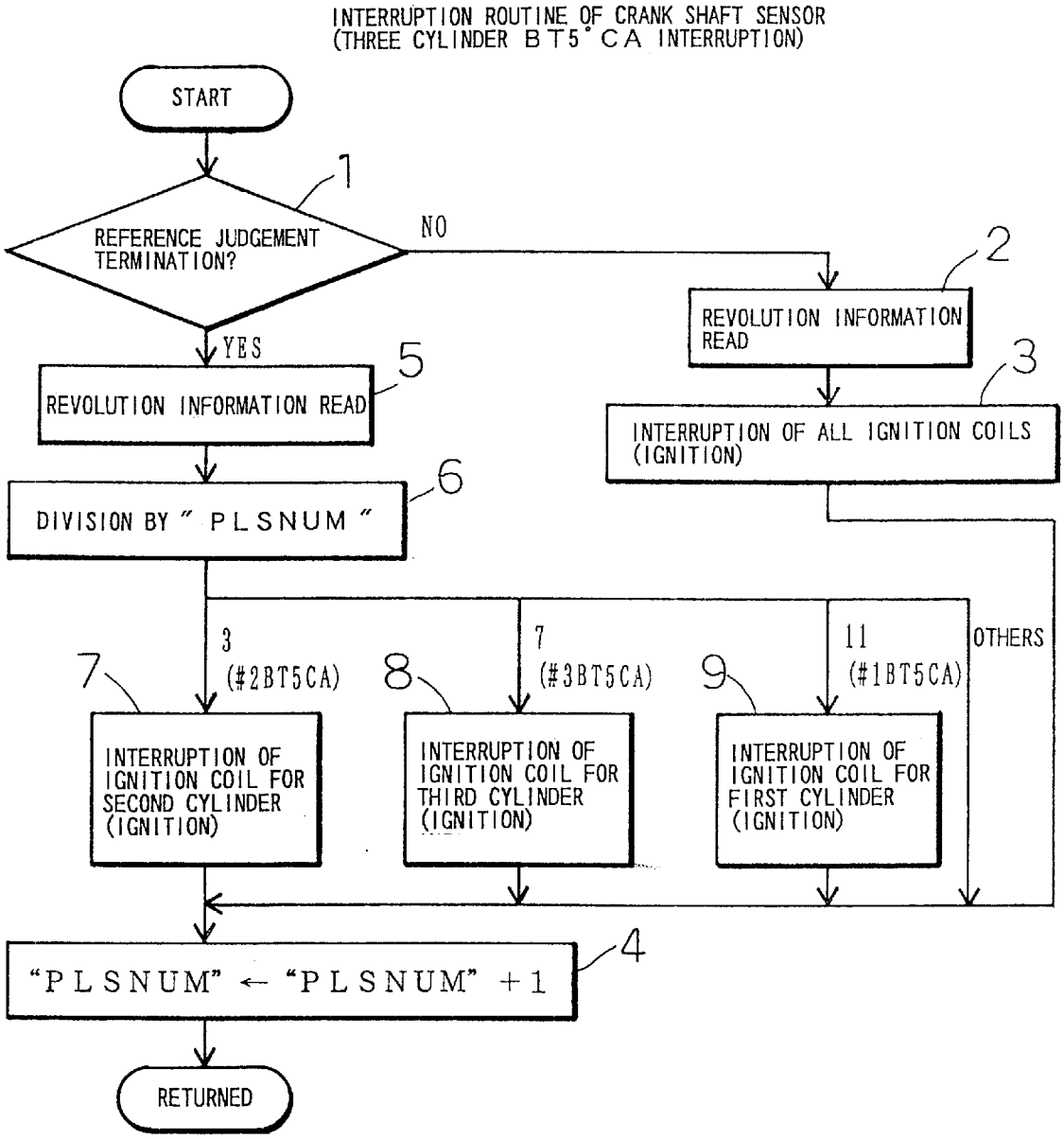
FIG. 14 is a flow chart showing an algorithm of another crank shaft sensor interruption routine of a program practiced by the CPU of the three-cylinder internal combustion engine control apparatus of the invention.

When the crank shaft sensor 4 generates every positive pulse at the position of 5° prior to the top dead center, the interruption routine of FIG. 14 is practiced. In this interruption routine, it is judged whether the reference judgment terminates or not (or whether the reference judgement pulse is detected) at the step 1. As a result, when it is judged that the reference judgement does not terminate, the operation is transferred to the step 2 where the revolution rate information arithmetically operated by the main routine is read and at the next step 3, the conduction of all the ignition drive circuits is stopped so that the primary current through the ignition coils IG1 through IG3 is interrupted. The interruption of the primary current induces the igniting high voltage simultaneously across the secondary coils of the ignition coils IG1 through IG3 whereby the ignition plugs PL1 through PL3 are simultaneously ignited. After the primary current through all the ignition coils is interrupted and all the ignition plugs are ignited, the operation is transferred to the step 4 where only "1" is added to the storage content of the pulse number PLSNUM and returned to the main routine.

Thus, it will be noted that in the extreme low revolution range of the engine where the cam shaft sensor cannot detect the reference judgement pulse, all the cylinders are ignited when every low revolution ignition position detection pulse is generated.

When the reference judgement pulse generated by the cam shaft sensor is detected and it is judged that the reference judgement terminates at the step 1 of the interruption routine of FIG. 14, the operation is transferred to the step 5 where the revolution rate information is read and then transferred to the step 6 where the operation is transferred to the step 7, 8 or 9 in accordance with the value stored by the pulse number PLSNUM. More particularly, when the value of the pulse number PLSNUM is 3, the operation is transferred to the step 7 where the primary current through the ignition coil IG2 for the second cylinder is interrupted so that the ignition operation is made in the second cylinder. When the value of the pulse number PLSNUM is 7, the operation is transferred to the step 8 where the primary current through the ignition coil IG3 for the third cylinder is interrupted so that the ignition operation is made in the third cylinder. When the value of the pulse number PLSNUM is 11, the operation is transferred to the step 9 where the primary current through the ignition coil IG1 for the first cylinder is interrupted so that the ignition operation is made in the first cylinder.

When the ignition coil conduction timer for the first cylinder finishes to count the conduction start time, the interruption routine of the ignition coil conduction timer for the first cylinder of FIG. 15A is practiced. In the step 1 of this interruption routine, the conduction of the primary coil of the ignition coil IG1 for the first cylinder starts. After, at the step 2 thereof, the measurement of the ignition position arithmetically operated by the ignition timer for the first cylinder in the main routine starts, the operation is returned to the main routine.

When the ignition coil conduction timer for the second cylinder finishes to count the conduction start time, the interruption routine of the ignition coil conduction timer for the second cylinder of FIG. 15B is practiced. At the step 1 of this interruption routine, the conduction of the primary coil of the ignition coil IG2 for the second cylinder starts. After, at the step 2 thereof, the measurement of the ignition position arithmetically operated by the ignition timer for the second cylinder in the main routine starts, the operation is returned to the main routine.

Furthermore, when the ignition coil conduction timer for the third cylinder finishes to count the conduction start time, the interruption routine of the ignition coil conduction timer for the third cylinder of FIG. 15C is practiced. At the step 1 of this interruption routine, the conduction of the primary coil of the ignition coil IG3 for the third cylinder starts. After, at the step 2 thereof, the measurement of the ignition position arithmetically operated by the ignition timer for the third cylinder in the main routine starts, the operation is returned to the main routine.

Figure 16A:
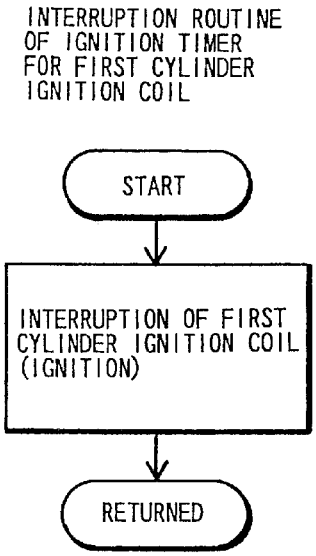
FIG. 16A is a flow chart showing an algorithm of a first cylinder ignition timer interruption routine of the program practiced by the CPU of the three-cylinder internal combustion engine control apparatus of the invention.

When the measurement of the ignition position made by the ignition timer for the first cylinder is finished, the interruption routine of the ignition timer for the first cylinder shown in FIG. 16A is practiced and the primary current through the ignition coil IG1 for the first cylinder is interrupted. This makes the ignition operation in the first cylinder.

Figure 16B:
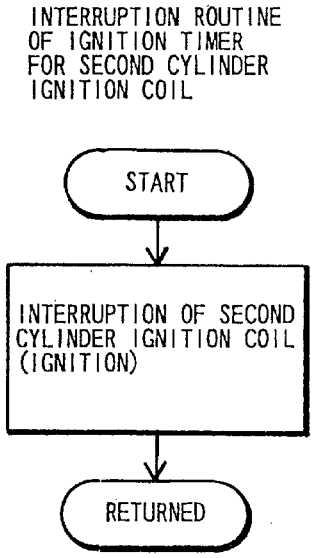
FIG. 16B is a flow chart showing an algorithm of a second cylinder ignition timer interruption routine of the program practiced by the CPU of the three-cylinder internal combustion engine control apparatus of the invention.

When the measurement of the ignition position made by the ignition timer for the second cylinder is finished, the interruption routine of the ignition timer for the second cylinder shown in FIG. 16B is practiced. In this interruption routine, the primary current through the ignition coil IG2 for the second cylinder is interrupted. This makes the ignition operation in the second cylinder.

Figure 16C:
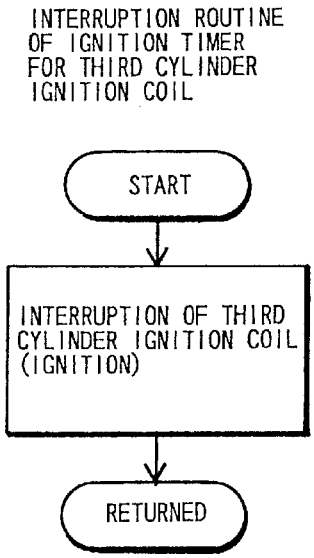
FIG. 16C is a flow chart showing an algorithm of a third cylinder ignition timer interruption routine of the program practiced by the CPU of the three-cylinder internal combustion engine control apparatus of the invention.

When the measurement of the ignition position made by the ignition timer for the third cylinder is finished, the interruption routine of the ignition timer for the third cylinder shown in FIG. 16C is practiced. In this interruption routine, the primary current through the ignition coil IG3 for the third cylinder is interrupted. This makes the ignition operation in the third cylinder.

Figure 17A:
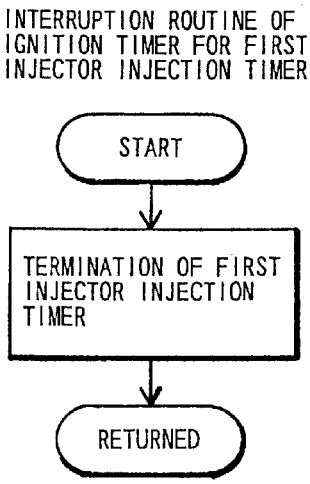
FIG. 17A is a flow chart showing an algorithm of a first injector injection timer interruption routine of the program practiced by the CPU of the three-cylinder internal combustion engine control apparatus of the invention.
Figure 17B:
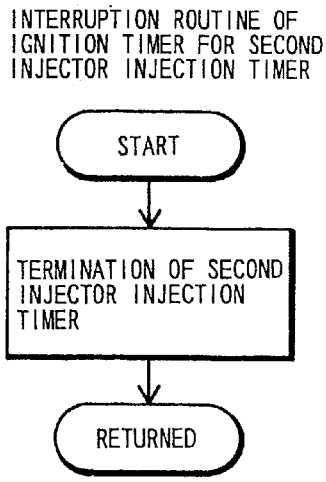
FIG. 17B is a flow chart showing an algorithm of a second injector injection timer interruption routine of the program practiced by the CPU of the three-cylinder internal combustion engine control apparatus of the invention.
Figure 17C:
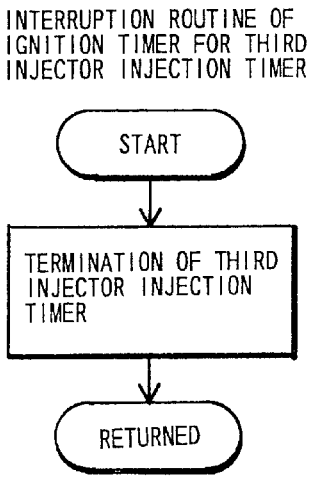
FIG. 17C is a flow chart showing an algorithm of a third injector injection timer interruption routine of the program practiced by the CPU of the three-cylinder internal combustion engine control apparatus of the invention.

Furthermore, when the measurement of the injection time made by the first through third injector injection timers is finished, there are practiced the interruption routines of FIGS. 17A through 17C in which the injection instruction signals U1 through U3 supplied to the injector injection drive circuits A1 through A3 for the first through third cylinders stops being supplied whereby the injection of the fuel from the injectors IJ1~IJ3 are stopped.

In the aforementioned embodiment, the urgent fuel injection control means is accomplished by the steps 1 through 4 of the interruption routine shown in FIG. 13 and the interruption routine of FIG. 17 to apply the injection instruction signals to the fuel injection system so that the injection of the fuel from the injectors for all the cylinders simultaneously starts when the crank shaft sensor detects the front edges of the respective reluctors as viewed in the rotational direction thereof to generate the pulses under the condition of being unable to detect any reference judgement pulse output by the cam shaft sensor to inject the fuel from the injectors for a set time.

Furthermore, the urgent ignition control means is accomplished by the steps 1, 2 and 5 of the interruption routine shown in FIG. 13 and the steps 1, 2 and 3 of the interruption routines 1, 2 and 3 of FIG. 14 to apply the ignition signals to the ignition system so as to simultaneously make the ignition operation at all the cylinders when the crank shaft sensor detects the front edges of the respective reluctors as viewed in the rotational direction thereof to generate the pulses under the condition of being unable to detect any reference judgement pulse output by the cam shaft sensor.

Also, the reference position detection pulse judgment means is accomplished by the steps 1 and 4 of the interruption routine shown in FIG. 7, the steps 1 and 4 of the interruption routine of FIG. 14 and the steps 1 and 6 of the interruption routine of FIG. 13 to judge which of the cylinders each of a series of reference position detection pulses generated by the crank shaft sensor detects the reference position for by distinguishing the generation order of the series of the reference position detection pulses after the reference position detection pulses are generated when the reference judgement pulses are detected.

The fuel injection time arithmetical operation means is accomplished by the task T3 of the main routine shown in FIG. 6 to arithmetically operate the fuel injection time of the injector for each of the cylinders under the predetermined control conditions at the constant revolution range and the ignition position arithmetical operation means is accomplished by the task 2 of FIG. 6 to arithmetically operate the ignition position for each of the cylinders under the predetermined control conditions at the constant revolution range.

The constant fuel injection control means is accomplished by the step 1, the steps 7 and 8 and the steps 9*a* through 9*f* of the interruption routine shown in FIG. 13 to apply the injection instruction signal to the fuel injection system so as to start the injection of the fuel from the injector for each of the cylinders at the position where the reference position detection pulse for each of the cylinders judged by the reference position detection pulse judgement means is generated when the revolution rate of the engine is at the constant revolution range and to stop the injection of the fuel when the fuel injection time arithmetically operated by the fuel injection arithmetical operation means lapses.

The constant ignition position control means is accomplished by the steps 1, 7, 8, 10*b*, 10*d* and 10*f* of the interruption routine shown in FIG. 13, the interruption routines of FIGS. 15A, 15B and 15C and the interruption routines of FIGS. 16A through 16C to apply the ignition signal to the ignition system so as to start the measurement of the ignition position of each of the cylinders arithmetically operated by the ignition position arithmetic operation means at the position where the reference position detection pulse for each of the cylinders judged by the reference position detection pulse judgement means is generated to make the ignition operation at each of the cylinders when the thus arithmetically operated ignition position for each of the cylinders is measured.

As aforementioned, in the invention, since the ignition operation is simultaneously made in all the cylinders at the position where the crank shaft sensor generates each of the low revolution ignition position detection signal under the condition of being unable to detect any reference judgement pulse generated by the cam shaft sensor (when the revolution rate of the engine is extremely low such as at the start thereof or when the output of the cam shaft sensor is not input to the ECU due to the disconnection), such a sensor as sequentially generates pulses at the reference position and at the low revolution ignition position of the series of cylinders may be used as the crank shaft sensor. Accordingly, the crank shaft sensor may have only one pulser coil provided therein, which causes the construction of the crank shaft sensor to be simplified. Since the circuit to input the output of the crank shaft sensor to the CPU may comprise only two circuits including the circuit to convert the reference position detection pulse into the signal having such a waveform as can be recognized by the CPU and a circuit to convert the low revolution ignition position detection pulse into the signal having such a waveform as can be recognized by the CPU, the construction of the electronic control unit can be more simplified than that of the prior art.

In case that the invention is applied to the control apparatus for controlling the six-cylinder internal combustion engine, the six cylinders may be divided into three cylinder sets, respective one of which includes two cylinders having the ignition position far away from each other at the crank angle of 360° and three reluctors may be provided at the distance of 120° corresponding to the three cylinder sets, respectively. The construction of the crank shaft sensor may be identical to that used for controlling the three-cylinder internal combustion engine.

In this case, the electronic control unit may comprise urgent fuel injection control means to apply the injection instruction signal to the fuel injection system so as to simultaneously start the injection of the fuel from the injectors for all the cylinders at the position where the signal generator of the crank shaft sensor detects the front edges as viewed in the rotational direction to generate the pulses under the condition of being unable to detect any reference judgement pulse output by the cam shaft sensor to inject the fuel from the corresponding injector for the set time, urgent ignition signal supply means to apply the ignition signal to the ignition system so as to simultaneously make the ignition operation in all the cylinders at the position where the signal generator of the crank shaft sensor detects the rear edges as viewed in the rotational direction to the crank shaft sensor to generate the pulses under the condition of being unable to detect any reference judgement pulse, reference position detection pulse judgment means to judge which of the cylinder sets the series of the reference position detection pulses detect the reference position for from the generation order of the series of the reference position detection pulses after the reference judgement pulses are generated when the reference judgement pulses are detected, fuel injection time arithmetical operation means to arithmetically operate a fuel injection time of the injector for each of the cylinders under the predetermined control conditions, ignition position arithmetical operation means to arithmetically operate the ignition position for each of the cylinder sets on the predetermined control conditions, constant fuel injection control means to start the injection of the fuel from the injector for each of the cylinders at a position where there is generated the reference position detection pulse for each of the cylinder sets judged by the reference position detection pulse judgment means and to stop the injection of the fuel when the fuel injection time arithmetically operated by the fuel injection arithmetical operation means lapses and constant ignition position control to start a measurement of the ignition position of each of the cylinder sets arithmetically operated by the ignition position arithmetic operation means at the position where there is generated the reference position detection pulse for each of the cylinder sets judged by the reference position detection pulse judgement means to make the ignition operation at each of the cylinder sets when the ignition position for each of the cylinder sets arithmetically operated by the ignition position arithmetical operation means is measured.

Although, in the illustrated embodiments, both of the ignition system and the fuel injection system are controlled, only the ignition system may be controlled by the invention, which may be applied to the internal combustion engine having no fuel injection system used.

Figure 18:
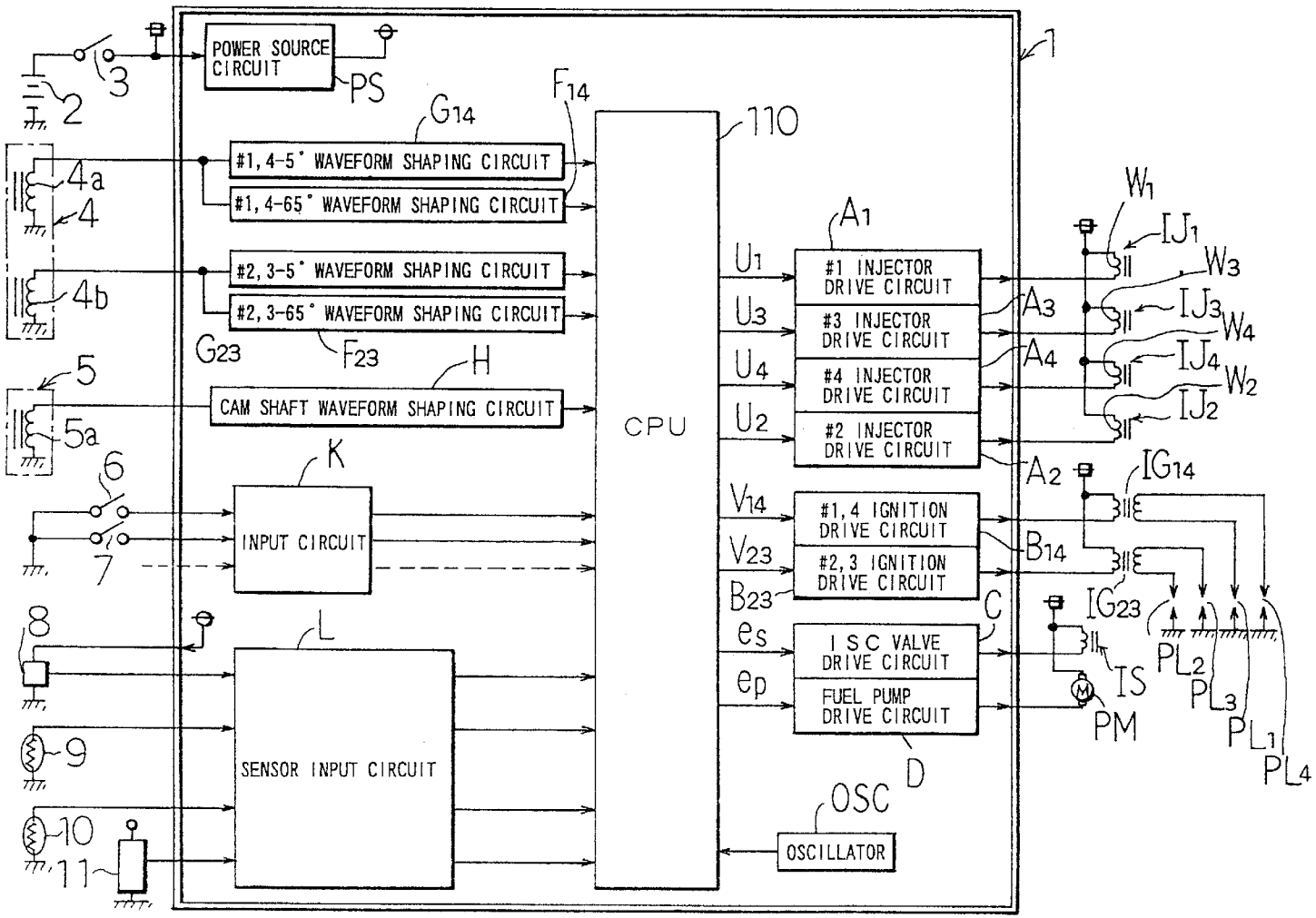
Fig. 18 Prior Art
FIG. 18 is a block diagram of a construction of a prior art four-cylinder internal combustion engine control apparatus.

For reference, a prior art control apparatus for controlling the four cycle four-cylinder internal combustion engine will be described with reference to FIG. 18. In FIG. 18, the same numerals designate the same components shown in FIG. 1.

In the example of FIG. 18, the electronic control unit 1 comprises a 65° waveform shaping circuit F14 for the first and fourth cylinders, a 5° waveform shaping circuit G14 for the first and fourth cylinders, a 65° waveform shaping circuit F23 for the second and third cylinders and a 5° waveform shaping circuit G23 for the second and third cylinders. The output of the crank shaft sensor 4 is input through the waveform shaping circuits to the CPU 110.

Figure 19:
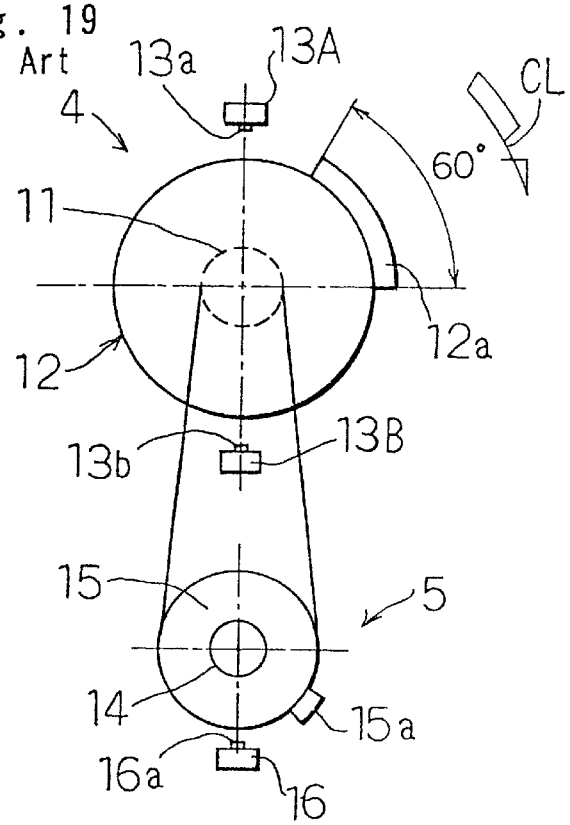
Fig. 19 Prior Art
FIG. 19 illustrates constructions of a crank shaft sensor and a cam shaft sensor used in the control apparatus of FIG. 18.

As shown in FIG. 19, the crank shaft sensor 4 comprises a rotor 12 mounted on a crank shaft 11 and signal generators 13A and 13B symmetrically disposed far away from each other at an angle distance of 180° around the rotor and secured to an engine case or the like. An arc-like reluctor 12*a* having a predetermined polar angle is formed on the periphery of the rotor 12. The signal generator 13A may comprise an iron core at a leading end thereof having a magnetic pole portion 13*a* faced to the periphery of the rotor 12, a pulser coil 4*a* (see FIG. 18) wound on the iron core and a permanent magnet magnetically bonded to the iron core as conventional. The signal generator 13A outputs pulses of different polarities generated from the pulser coil 4*a* when the front edge of the reluctor as viewed in the rotational direction passes the position where the magnetic pole portion 13*a* of the iron core is located (or when the signal generator 13A detects the front edge of the reluctor) and when the rear edge of the reluctor as viewed in the rotational direction passes the position where the magnetic pole portion 13*a* of the iron core is located (or when the signal generator 13A detects the rear edge of the reluctor).

The signal generator 13B may has the same construction as the signal generator 13A and a pulser coil 4*b* is wound on the iron core with a magnetic pole portion 13*b* on the leading edge 13*b* of the iron core being faced to the periphery of the rotor 12. The signal generator 13B outputs the pulses of different polarities generated from the pulser coil 4*b* when the signal generator 13B detects the front edge of the reluctor as viewed in the rotational direction and when the signal generator 13B detects the rear edge of the reluctor as viewed in the rotational direction.

Figures 20A, 20B, 20C, 20D, 20E, 20F, 20G, 20H, 20I, 20J, 20K, 20L, 20M, 20N, 20O, 20P, 20Q, 20R:
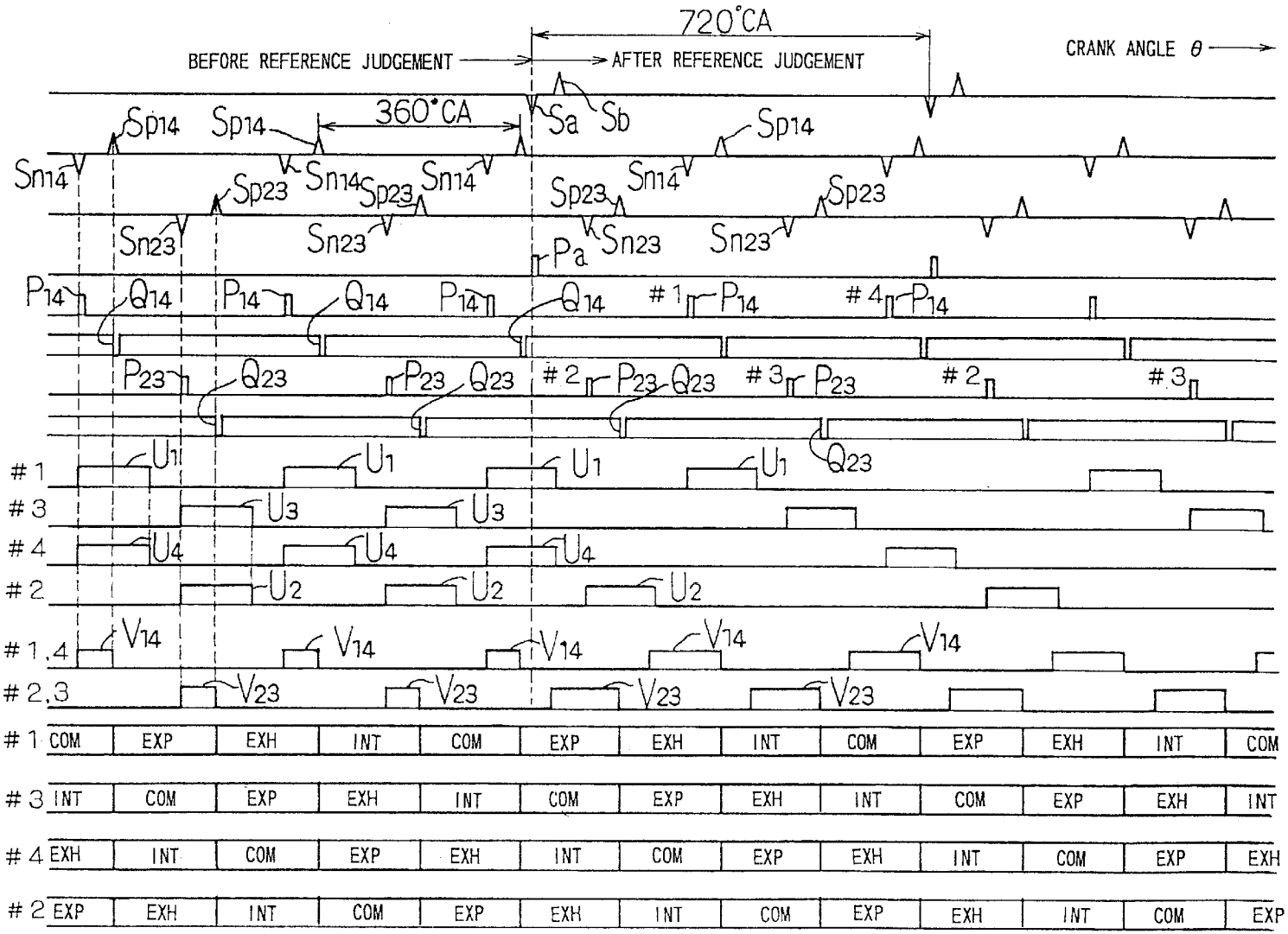
FIG. 20 illustrates waveforms of signals in various parts of the control apparatus of FIG. 18.

In the illustrated example, the reluctor 12*a* is so formed as to have a polar arc angle of 60° and as shown in FIG. 20B, the position where the signal generator 13A is mounted is so set that there are generated reference position detection pulses Sn14 from the pulser coil 4*a* at the reference position for the first cylinder so set at the position advanced by an angle of 65° relative to the top dead center of the first cylinder (the position of the rotary angle of the crank shaft when the piston of the first cylinder reaches the top dead center) and at the reference position for the fourth cylinder (the position displaced by an angle of 360° from the reference position of the first cylinder) so set at the position advanced by an angle of 65° relative to the top dead center of the fourth cylinder (the position displaced by an angle of 360° relative to the top dead center of the first cylinder), respectively and low revolution ignition position detection pulses Sp14 from the pulser coil 4*a* at the low revolution ignition position for the first cylinder so set at the position advanced by an angle of 5° relative to the top dead center of the first cylinder and at the low revolution ignition position for the fourth cylinder so set at a position advanced by an angle of 5° relative to the top dead center of the fourth cylinder, respectively.

As shown in FIG. 20C, the position where the signal generator 13B is mounted is so set that there are generated a reference position detection pulse Sn23 from the pulser coil 4*b* at the reference position for the second cylinder so set at a position advanced by an angle of 65° relative to the top dead center of the second cylinder and at the reference position for the third cylinder (the position displaced by an angle of 360° from the reference position for the second cylinder) so set at the position advanced by an angle of 65° relative to the top dead center of the third cylinder, respectively and low revolution ignition position detection pulses Sp23 from the pulser coil 4*b* at the low revolution ignition position for the second cylinder so set at the position advanced by an angle of 5° relative to the top dead center of the second cylinder and at the low revolution ignition position for the third cylinder so set at a position advanced by an angle of 5° relative to the top dead center of the third cylinder, respectively.

The cam shaft sensor 5 may has the same construction as the one as shown in FIG. 1 and the signal generator 16 outputs the pulses of different polarities as shown in FIG. 20A generated from the pulser coil 5*a* when it detects the front and rear edges of the reluctor 15*a* as viewed in the rotational direction, respectively.

The other construction of the prior art control apparatus is identical to the construction of the apparatus shown in FIG. 1.

The reference position detection pulses Sn14 generated by the signal generator 13A of the crank shaft sensor 4 at a position of 65° prior to the top dead center of the first cylinder and at the position of 65° prior to the top dead center of the fourth cylinder are converted by the 65° waveform shaping circuit 112A for the first and fourth cylinders into the reference position detection signals P14 as shown in FIG. 20E and then input to the CPU 110. The low revolution ignition position detection pulses Sp14 generated by the signal generator 13A at the position of 5° prior to the top dead center of the first cylinder and at the position of 5° prior to the top dead center of the fourth cylinder are converted by the 5° waveform shaping circuit 113A for the first and fourth cylinders into the reference position detection signals Q14 as shown in FIG. 20F and then input to the CPU 110.

The reference position detection pulses Sn23 generated by the signal generator 13B of the crank shaft sensor 4 at the reference position of the second cylinder and at the reference position of the third cylinder are converted by the 65° waveform shaping circuit 112B for the second and third cylinders into the reference position detection signals P23 as shown in FIG. 20G and then input to the CPU 110. The low revolution ignition position detection pulses Sp23 generated by the signal generator 13B at the positions of 5° prior to the top dead center of the second and third cylinders are converted by the 5° waveform shaping circuit 113B for the second and third cylinders into the low revolution ignition position detection signals Q23 as shown in FIG. 20H and then input to the CPU 110.

The reference judgement pulse Sa generated by the cam shaft sensor 5 is converted by the cam shaft waveform shaping circuit H into the reference judgement signal Pa having such a waveform as shown in FIG. 20D and input to the CPU 110.

The CPU 110 is activated by being connected to the power source PS when the switch 3 is closed and applies to the fuel pump drive circuit D the drive signal ep interrupting with the predetermined duty ratio to supply from the drive circuit through the pump motor PM the drive current controlled by the pulse width modulation system so as to supply the fuel to the injector IJ1~IJ4 under a pressure suitable for starting the engine.

The CPU 110 judges whether the reference position detection pulses Sn14 sequentially generated by the crank shaft sensor after the reference judgement pulses Sa as indicated at "AFTER REFERENCE JUDGEMENT" in FIG. 20E detects the reference position of the first cylinder or the reference position of the fourth cylinder by specifying the order of generation of the reference position detection signals P14 and P14 for the first and fourth cylinders sequentially input after detecting the reference judgement signal Pa obtained by shaping the reference judgement pulse Sa generated by the cam shaft sensor 5. In FIG. 20E, the reference position detection signal P14 for the first cylinder and the reference position detection signal P14 for the fourth cylinder have the codes of #1 and #4 assigned thereto, respectively.

Similarly, the CPU 110 judges whether the reference position detection pulses Sn23 and S23, - - - sequentially generated by the crank shaft sensor after the reference judgement pulses Sa as indicated at "AFTER REFERENCE JUDGEMENT" in FIG. 20G detects the reference position of the second cylinder or the reference position of the third cylinder by specifying the order of generation of the reference position detection signals P23 and P23 for the second and third cylinders sequentially input after detecting the reference judgement signal Pa obtained by shaping the reference judgement pulse Sa generated by the cam shaft sensor 5.

Also, the CPU 110 arithmetically operates the revolution rate of the engine from the period of generation of the pulses generated by the crank shaft sensor 4 and then arithmetically operates the conduction start position and the conduction stop position of the primary current through the ignition coils for the respective cylinders and the fuel injection time relative to the obtained revolution rate and the control conditions detected by the various sensors 8 through 10.

Since the cam shaft sensor generates one reference judgement pulse generated when the crank shaft rotates two revolutions, the maximum crank angle (the delay of detection of the reference judgement pulses) at which the crank shaft rotates after the start operation of the engine begins until the reference judgement pulse is generated is 720°. Since the revolution rate of the cam shaft is as half as that of the crank shaft, it is difficult to obtain the reference judgement pulses of magnitude by which the electronic control unit can recognize the pulse from the cam shaft sensor at the extreme low revolution range which is near the start revolution rate. Thus, the crank angle from the beginning of the start operation of the engine to the condition where the reference judgement pulses are positively detected will exceed 720°. This prevents the electronic control unit from controlling the ignition position and the fuel injection time.

It will be noted that under the condition where the CPU cannot recognize the reference judgement pulses, the CPU applies the injection instruction signals U1 and U4 to the injector drive circuits A1 and A4 for a set time as indicated at "BEFORE REFERENCE JUDGEMENT" in FIGS. 20I and K so that the injection of the fuel from the injectors IJ1 and IJ4 for the first and fourth cylinders simultaneously starts and continues for a set time when the signal generator 13A of the crank shaft sensor 4 generates every reference position judgement pulses Sn14 (or when every reference position detection signal P14 is input). This simultaneously injects the fuel from the injectors for the first and fourth cylinders.

Similarly, when the CPU cannot detect any pulse Pa obtained by shaping the reference judgement pulse Sa, the CPU applies the injection instruction signals U2 and U3 to the injector drive circuits A2 and A3 for a set time as indicated at "BEFORE REFERENCE JUDGEMENT" in FIGS. 20J and L so that the injection of the fuel from the injectors IJ2 and IJ3 for the second and third cylinders simultaneously starts and continues for a set time when the signal generator 13A of the crank shaft sensor 4 generates every reference position judgement pulse Sn23 (or when every reference position detection signal P23 is input). This simultaneously injects the fuel from the injectors for the second and third cylinders.

Also, when the reference position detection pulses Sn14 for the first and fourth cylinders are generated under the condition where the revolution rate of the engine is within the extreme low revolution range, the CPU 110 applies the ignition signal V14 to the ignition drive circuit B14 for the first and fourth cylinders as shown in FIG. 20M to pass the primary current from the ignition drive circuit B14 through the ignition coil IG14. Furthermore, when the CPU extinguishes the ignition signal V14 supplied to the ignition coil IG14 when the low revolution ignition position detection pulses Sp14 are generated to interrupt the primary current through the ignition coil Ig14. This causes the igniting high voltage to be induced across the secondary coil of the ignition coil IG14. The high voltage is applied to the ignition plugs PL1 and PL4 for the first and fourth cylinders to simultaneously ignite the first and fourth cylinders.

Similarly, when the reference position detection pulses Sn23 for the second and third cylinders are generated under the condition where the revolution rate of the engine is within the extreme low revolution range, the CPU 110 applies the ignition signal V23 to the ignition drive circuit B23 for the second and third cylinders as shown in FIG. 20N to pass the primary current from the ignition drive circuit B23 through the ignition coil IG23. Furthermore, when the CPU extinguishes the ignition signal V23 supplied to the ignition coil IG23 when the low revolution ignition position detection pulses Sp23 are generated to interrupt the primary current through the ignition coil Ig23. This causes the igniting high voltage to be induced across the secondary coil of the ignition coil IG23. The high voltage is applied to the ignition plugs PL2 and PL3 for the second and third cylinders to simultaneously ignite the second and third cylinders.

Figure 21:
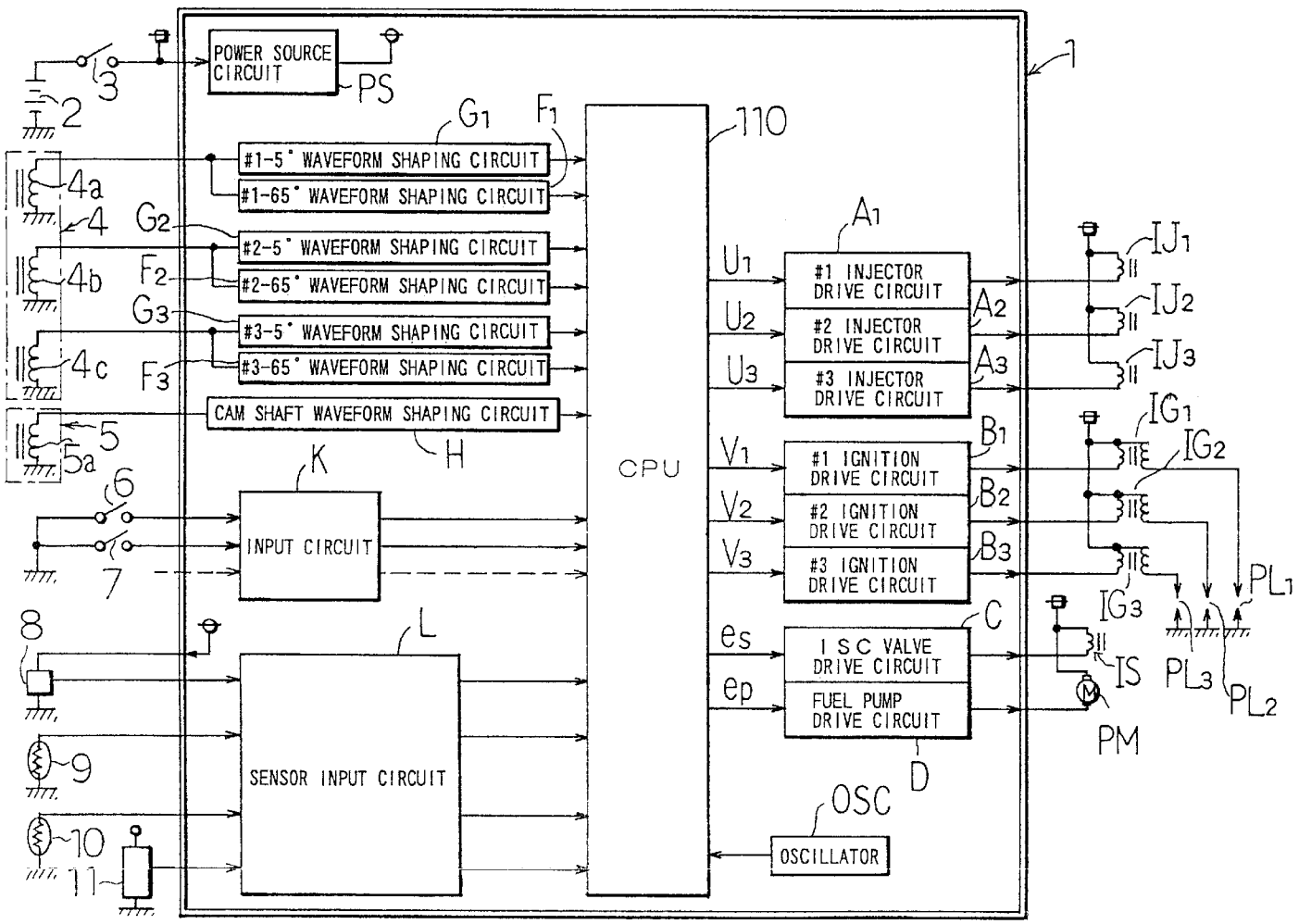
Fig. 21 Prior Art
FIG. 21 is a block diagram of a construction of the prior art three-cylinder internal combustion engine control apparatus.

The construction of the prior art control apparatus for controlling the four cycle three-cylinder internal combustion engine is illustrated in FIG. 21. In this figure, reference numerals 4*a* through 4*c* designate pulser coils for the first through third cylinders provided in the signal generators for the first through third cylinders of the crank shaft sensor 4, respectively, reference numerals F1 through F3 designate 65° waveform shaping circuits for the first through third cylinders, respectively and reference numerals G1 through G3 designate 5° waveform shaping circuits for the first through third cylinders, respectively.

Also, reference numerals IJ1 through IJ3 designate injectors for the first through third cylinders, respectively, reference numerals A1 through A3 designate injector drive circuits for the first through third cylinders, respectively, reference numerals IG1 through IG3 designate ignition coils for the first through third cylinders, respectively and reference numerals PL1 through PL3 designate ignition plugs provided in the first through third cylinders, respectively. The other components are the same as those for the control apparatus for the four-cylinder internal combustion engine shown in FIG. 18.

Figure 22:
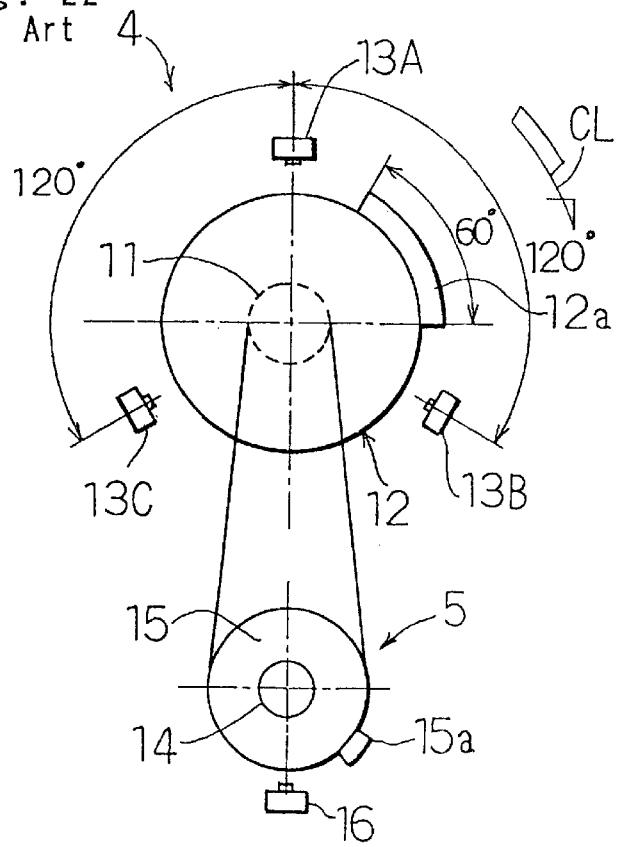
Fig. 22 Prior Art
FIG. 22 illustrates constructions of a crank shaft sensor and a cam shaft sensor used in the control apparatus of FIG. 21.

The examples of constructions of the crank shaft sensor 4 and the cam shaft sensor 5 are shown in FIG. 22. In these examples, the signal generators 13A through 13C for the first through third cylinders are disposed at the angle distance of 120°.

Figures 23A, 23B, 23C, 23D, 23E, 23F, 23G, 23H, 23I, 23J, 23K, 23L, 23M, 23N, 23O, 23P, 23Q, 23R, 23S, 23T:
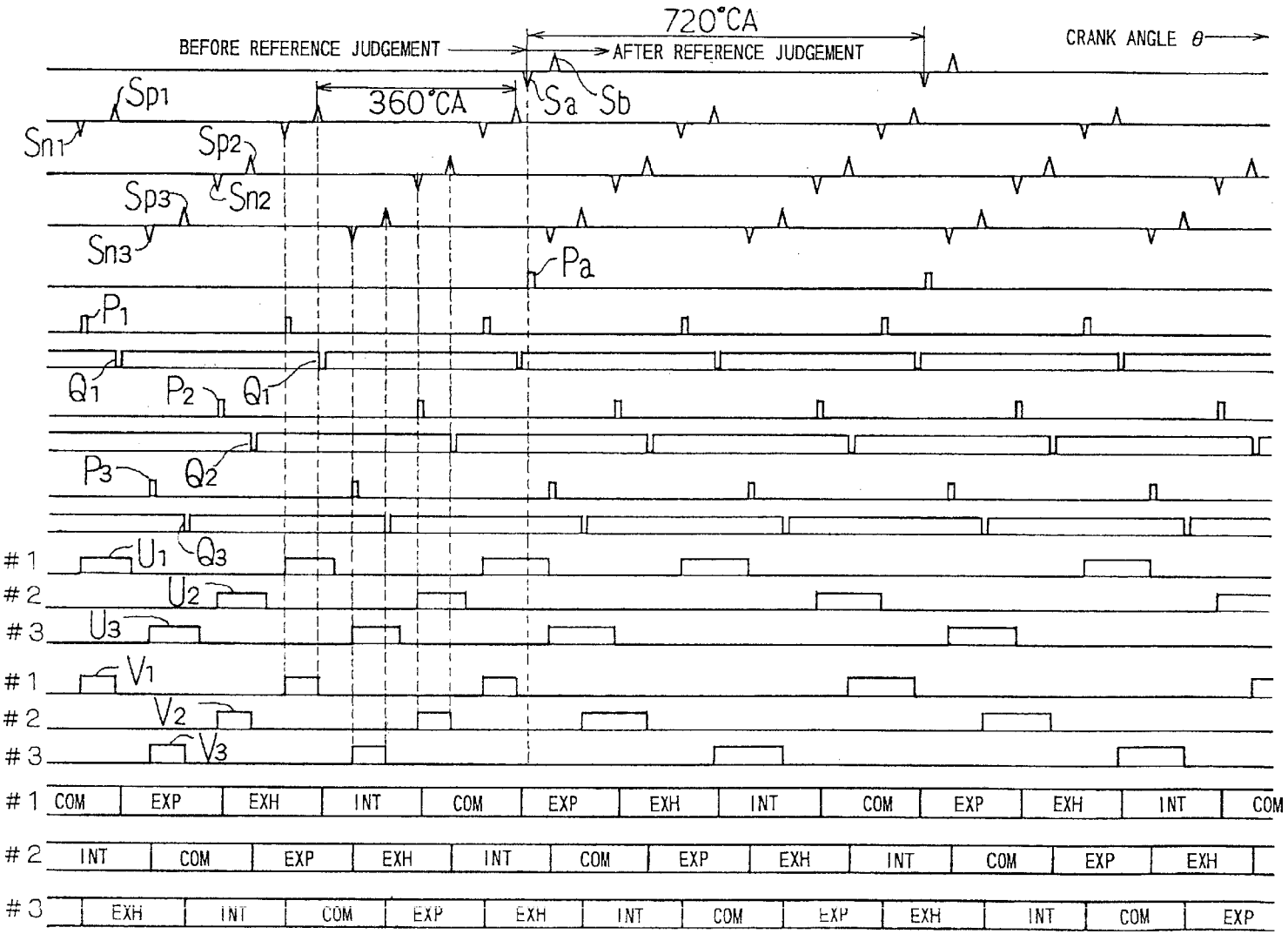
FIG. 23 illustrates waveforms of signals in various parts of the control apparatus of FIG. 21.

The waveforms at the various portions of the control apparatus of FIG. 21 relative to the rotary angle θ of the crank shaft are shown in FIG. 23. In this figure, waveforms Sn1 through Sn3 designate reference position detection pulses for the first through third cylinders obtained from the signal generators 13A through 13C for the first through third cylinders, respectively, waveforms Sp1 through Sp3 designate low revolution ignition position detection pulses for the first through third cylinders, respectively, waveforms P1 through P3 designate reference position detection signals for the first through third cylinders obtained by shaping the reference position detection pulses for the first through third cylinders by the waveform shaping circuits F1 through F3, respectively, waveforms Q1 through Q3 designate low revolution ignition position detection signals for the first through third cylinders obtained by shaping the low revolution ignition position detection pulses for the first through third cylinders, respectively and waveforms V1 through V3 designate ignition signals applied to the ignition drive circuits B1 through B3 for the first through third cylinders, respectively.

It will be noted from the foregoing that the prior art control apparatus for the four cycle internal combustion engine requires the pulser coils of number at least as half as the number of cylinders provided in the crank shaft sensor 4. In case that the number of the cylinders of the internal combustion engine is 3, then three pulser coils are required to be provided therein. The respective waveform shaping circuits for the pulser coils re are required for inputting the pulses form the pulser coils to the CPU. Thus, it will be noted that the prior art control apparatus for the internal combustion engine has the complicated construction and therefore is large-sized, which cannot be avoided from being expensive.

On the other hand, the control apparatus of the invention has the number of the pulser coils in the crank shaft sensor reduced as shown in FIGS. 1 and 4 and therefore the number of the waveform shaping circuit in the electronic control unit can be reduced as well. This causes the construction of the control apparatus to be more simplified.

As aforementioned, with the control apparatus of the invention, since the ignition operation in all the cylinders at the position where the crank shaft sensor generates each of low revolution ignition position detection signals under the condition of being unable to detect any reference judgement pulse generated by the cam shaft sensor; only one pulser coil may be enough for the crank shaft sensor as long as it can sequentially generate pulses at the reference position and at the low revolution ignition position for the series of cylinders. This causes the construction of the crank shaft sensor to be more simplified.

Furthermore, according to the invention, since the circuit to input the outputs of the crank shaft sensors to the CPU can be formed of two circuits including the circuit to convert the reference position detection pulses into the signals the CPU can recognize and the circuit to convert the low revolution ignition position detection pulses into the signals the CPU can recognize, the construction of the electronic control unit can be more simplified.

In addition thereto, according to the invention, since the internal combustion engine can be driven even when the electronic control unit cannot detect the reference judgement pulses generated by the cam shaft sensor due to the disconnection. Operators on vehicles such as outer boards or snow mobiles used on the sea or on secluded places in the mountains can safely drive them without stopping the engine due to accident of the cam shaft sensor.

Although some preferred embodiments have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. An internal combustion engine control system to control an ignition system for a four cycle multi-cylinder internal combustion engine comprising a crank shaft sensor mounted on a crank shaft of said internal combustion engine to generate a low revolution ignition position detection signal of pulse waveform at a low revolution ignition position of each of cylinders set near a top dead center in a compression stroke of each of said cylinders and to generate a reference position detection pulse at a reference position of each of said cylinders set at a position advanced relative to said low revolution ignition position of each of said cylinders, a cam shaft sensor mounted on a cam shaft of said internal combustion engine to generate a reference judgement pulse at a set rotary angle position of said cam shaft once per one revolution of said cam shaft and ignition position arithmetical operation means to arithmetically operate an ignition position for each of said cylinders under the predetermined control conditions, said control system comprising the steps of;

simultaneously making an ignition operation in all of said cylinders at a position where said crank shaft sensor generates each of low revolution ignition position detection signals under the condition of being unable to detect any reference judgement pulse from said cam shaft sensor;

judging which of said cylinders a series of reference position detection pulses are one detecting the reference position for from a generation order of said series of said reference position detection pulses after said reference judgement pulses are generated when said reference judgement pulses are detected;

and starting a measurement of said ignition position of each of said cylinders arithmetically operated by said ignition position arithmetical operation means at a position where the judged reference position detection pulse for each of said cylinders is generated and making the ignition operation at each of said cylinders when the thus arithmetically operated ignition position for each of said cylinders is measured.

2. An internal combustion engine control system to control an ignition system and a fuel injection system for a four cycle multi-cylinder internal combustion engine having a fuel supplied by said fuel injection system having an injector provided for each of cylinders comprising a crank shaft sensor mounted on a crank shaft of said internal combustion engine to generate a low revolution ignition position detection signal of pulse waveform at a low revolution ignition position of each of said cylinders set near a top dead center in a compression stroke of each of said cylinders and to generate a reference position detection pulse at a reference position of each of said cylinders set at a position advanced relative to said low revolution ignition position of each of said cylinders, a cam shaft sensor mounted on a cam shaft of said internal combustion engine to generate a reference judgement pulse at a set rotary angle position of said cam shaft once per one revolution of said cam shaft, ignition position arithmetical operation means to arithmetically operate an ignition position for each of said cylinders under the predetermined control conditions and fuel injection time arithmetical operation means to arithmetically operate a fuel injection time of said injector for each of said cylinders, said control system comprising the steps of;

starting an injection of said fuel from said injectors for all of said cylinders at a position where said crank shaft sensor generates each of said reference position detection pulse under the condition of being unable to detect any reference judgement pulse from said cam shaft sensor to inject said fuel from said injectors for a set time;

simultaneously making an ignition operation in all of said cylinders at a position where said crank shaft sensor generates each of said low revolution ignition position detection signals under the condition of being unable to detect any reference judgement pulse from said cam shaft sensor;

judging which of said cylinders a series of said reference position detection pulses are one detecting the reference position for from a generation order of said series of said reference position detection pulses after said reference judgement pulses are generated when said reference judgement pulses are detected;

starting an injection of said fuel from said injector for each of said cylinders at a position where the judged reference position detection pulse for each of said cylinders is generated and stopping said injection of said fuel when said fuel injection time arithmetically operated by said fuel injection arithmetical operation means lapses;

and starting a measurement of said ignition position of each of said cylinders arithmetically operated by said ignition position arithmetical operation means at a position where the judged reference position detection pulse for each of said cylinders is generated when said revolution rate of said internal combustion engine is within said low revolution range and making the ignition operation at each of said cylinders when the thus arithmetically operated ignition position for each of said cylinders is measured.

3. An internal combustion engine control apparatus to control an ignition system for a four cycle multi-cylinder internal combustion engine, said internal combustion engine control apparatus comprising;

a crank shaft sensor mounted on a crank shaft of said internal combustion engine to generate a low revolution ignition position detection signal of pulse waveform at a low revolution ignition position of each of cylinders set near a top dead center in a compression stroke of each of said cylinders and to generate a reference position detection pulse at a reference position of each of said cylinders set at a position advanced relative to said low revolution ignition position of each of said cylinders;

a cam shaft sensor mounted on a cam shaft of said internal combustion engine to generate a reference judgement pulse at a set rotary angle position of said cam shaft once per one revolution of said cam shaft;

and an electronic control unit including urgent ignition signal supply means to supply an ignition signal to said ignition system whereby an ignition operation is simultaneously made in all of said cylinders at a position where said crank shaft sensor generates each of low revolution ignition position detection signals under the condition of being unable to detect any reference judgement pulse from said cam shaft sensor, reference position detection pulse judgement means to judge which of said cylinders a series of said reference position detection pulses are one detecting the reference position for from a generation order of said series of said reference position detection pulses after said reference judgement pulses are generated when said reference judgement pulses are detected, ignition position arithmetical operation means to arithmetically operate an ignition position for each of said cylinders under predetermined control conditions and constant ignition position control means to apply an ignition signal to said ignition system so as to start a measurement of said ignition position of each of said cylinders arithmetically operated by said ignition position arithmetical operation means at a position where the reference position detection pulse for each of said cylinders judged by said reference position pulse judgement means is generated and to make the ignition operation at each of said cylinders when the thus arithmetically operated ignition position for each of said cylinders is measured.

4. An internal combustion engine control apparatus as set forth in claim 3, and wherein said internal combustion engine has four cylinders divided into two sets of two cylinders having their ignition positions provided in a manner far away to each other at a crank angle of 360°, said crank shaft sensor comprising a rotor rotationally driven by said crank shaft and having two reluctors provided at an equal angle distance corresponding to said two sets of cylinders, respectively and a single signal generator to generate pulses of different polarities when each of said reluctors on said rotor at a front edge and at a rear edge as viewed in the rotational direction, respectively;

and a relation of position between each of said reluctors on said rotor and said signal generator being set so that the pulse generated when said signal generator detects said front edge of said reluctor corresponding to respective sets of cylinders and the pulse generated when said signal generator detects said rear edge of said reluctor corresponding to respective sets of cylinders become said reference position detection pulse and said low revolution ignition position detection pulse for each set of cylinders.

5. An internal combustion engine control apparatus as set forth in claim 3, and wherein said internal combustion engine has four cylinders divided into two sets of two cylinders having their ignition positions provided in a manner far away to each other at a crank angle of 360°, said crank shaft sensor comprising a rotor rotationally driven by said crank shaft and having two reluctors provided at an equal angle distance corresponding to said two sets of cylinders, respectively and a single signal generator to generate pulses of different polarities when each of said reluctors on said rotor at a front edge and at a rear edge as viewed in the rotational direction, respectively;

a relation of position between each of said reluctors on said rotor and said signal generator being set so that the pulse generated when said signal generator detects said front edge of said reluctor corresponding to respective sets of cylinders and the pulse generated when said signal generator detects said rear edge of said reluctor corresponding to respective sets of cylinders become said reference position detection pulse and said low revolution ignition position detection pulse for each set of cylinders;

and each of said reluctor on said rotor of said crank shaft sensor being formed so as to have a polar arc angle of 60° and said reference position of each of said cylinders being set at a position advanced by an angle of 65° relative to the top dead center of a compression stroke of each of said cylinders while said low revolution ignition position of each of said cylinders is set at a position advanced by an angle of 5° relative to said top dead center of said compression stroke of each of said cylinders.

6. An internal combustion engine control apparatus to control an ignition system and a fuel injection system for a four cycle multi-cylinder internal combustion engine having a fuel supplied by said fuel injection system having an injector provided for each of cylinders, said control apparatus comprising;

a crank shaft sensor mounted on a crank shaft of said internal combustion engine to generate a low revolution ignition position detection signal of pulse waveform at a low revolution ignition position of each of said cylinders set near a top dead center in a compression stroke of each of said cylinders and to generate a reference position detection pulse at a reference position of each of said cylinders set at a position advanced relative to said low revolution ignition position of each of said cylinders;

a cam shaft sensor mounted on a cam shaft of said internal combustion engine to generate a reference judgement pulse at a set rotary angle position of said cam shaft once per one revolution of said cam shaft;

and a electronic control unit including urgent fuel injection control means to start an injection of said fuel from said injectors for all of said cylinders at a position where said crank shaft sensor generates each of said reference position detection pulses under the condition of being unable to detect any reference judgement pulse from said cam shaft sensor to inject said fuel from the corresponding injector for a set time, urgent ignition signal supply means to apply an ignition signal to said ignition system so as to simultaneously make an ignition operation in all of said cylinders at a position where said crank shaft sensor generates each of low revolution ignition position detection signals under the condition of being unable to detect any reference judgement pulse from said cam shaft sensor, reference position detection pulse judgment means to judge which of said cylinders a series of said reference position detection pulses are one detecting the reference position for from a generation order of said series of said reference position detection pulses after said reference judgement pulses are generated when said reference judgement pulses are detected, fuel injection time arithmetical operation means to arithmetically operate a fuel injection time of said injector for each of said cylinders under the predetermined control conditions, ignition position arithmetical operation means to arithmetically operate an ignition position for each of said cylinders under the predetermined control conditions, constant fuel injection control means to start an injection of said fuel from an injector for each of said cylinders at a position where the reference position detection pulse for each of said cylinders judged by said reference position detection pulse judgement means is generated and to stop said injection of said fuel when said fuel injection time arithmetically operated by said fuel injection arithmetical operation means lapses and constant ignition position control to apply an ignition signal to said ignition system so as to start a measurement of said ignition position of each of said cylinders arithmetically operated by said ignition position arithmetical operation means at a position where the reference position detection pulse for each of said cylinders judged by said reference position detection pulse judgement means is generated and to make the ignition operation at each of said cylinders when the thus arithmetically operated ignition position for each of said cylinders is measured.

7. An internal combustion engine control apparatus as set forth in claim 6, and wherein said internal combustion engine has four cylinders divided into two sets of two cylinders having their ignition positions provided in a manner far away to each other at a crank angle of 360°, said crank shaft sensor comprising a rotor rotationally driven by said crank shaft and having two reluctors provided at an equal angle distance corresponding to said two sets of cylinders, respectively and a single signal generator to generate pulses of different polarities when each of said reluctors on said rotor at a front edge and at a rear edge as viewed in the rotational direction, respectively;

and a relation of position between each of said reluctors on said rotor and said signal generator being set so that the pulse generated when said signal generator detects said front edge of said reluctor corresponding to respective sets of cylinders and the pulse generated when said signal generator detects said rear edge of said reluctor corresponding to respective sets of cylinders become said reference position detection pulse and said low revolution ignition position detection pulse for each set of cylinders.

8. An internal combustion engine control apparatus as set forth in claim 6, and wherein said internal combustion engine has four cylinders divided into two sets of two cylinders having their ignition positions provided in a manner far away to each other at a crank angle of 360°, said crank shaft sensor comprising a rotor rotationally driven by said crank shaft and having two reluctors provided at an equal angle distance corresponding to said two sets of cylinders, respectively and a single signal generator to generate pulses of different polarities when each of said reluctors on said rotor at a front edge and at a rear edge as viewed in the rotational direction, respectively;

a relation of position between each of said reluctors on said rotor and said signal generator being set so that the pulse generated when said signal generator detects said front edge of said reluctor corresponding to respective sets of cylinders and the pulse generated when said signal generator detects said rear edge of said reluctor corresponding to respective sets of cylinders become said reference position detection pulse and said low revolution ignition position detection pulse for each set of cylinders;

and each of said reluctor on said rotor of said crank shaft sensor being formed so as to have a polar arc angle of 60° and said reference position of each of said cylinders being set at a position advanced by an angle of 65° relative to the top dead center of a compression stroke of each of said cylinders while said low revolution ignition position of each of said cylinders is set at a position advanced by an angle of 5° relative to said top dead center of said compression stroke of each of said cylinders.

9. An internal combustion engine control apparatus to control an ignition system and a fuel injection system for a four cycle three-cylinder internal combustion engine having three cylinders, said control apparatus comprising;

a crank shaft sensor including a rotor rotationally driven by said crank shaft of said internal combustion engine and having three reluctors provided at a distance of 120° angle corresponding to said three cylinders, respectively and a single signal generator to generate pulses of different polarities when said signal generator detects each of said reluctors on said rotor at a front edge thereof and at a rear edge thereof as viewed in the rotational direction, respectively and a relation of position between each of said reluctors on said rotor and said signal generator being set so as to generate a reference position detection pulse and a low revolution ignition position detection pulse when said signal generator detects said front edge and said rear edge of said reluctor corresponding to each of said cylinders at a position advanced relative to said low revolution ignition position of each of said cylinders and at a low revolution ignition position of each of cylinders set near a top dead center in a compression stroke of each of said cylinders, respectively;

a cam shaft sensor mounted on a cam shaft of said internal combustion engine to generate a reference judgement pulse at a set rotary angle position of said cam shaft once per one revolution of said cam shaft;

and an electronic control unit including urgent ignition signal supply means to supply an ignition signal to said ignition system so that an ignition operation is simultaneously made in all of said cylinders when said signal generator of said crank shaft sensor detects said rear edge of each of said reluctors as viewed in the rotational direction to generate said pulse under the condition of being unable to detect any reference judgement pulse from said cam shaft sensor, reference position detection pulse judgement means to judge which of said cylinders a series of said reference position detection pulses are one detecting the reference position for from a generation order of said series of said reference position detection pulses after said reference judgement pulses are generated when said reference judgement pulses are detected, ignition position arithmetical operation means to arithmetically operate an ignition position for each of said cylinders under predetermined control conditions and constant ignition position control means to apply an ignition signal to said ignition system so as to start a measurement of said ignition position of each of said cylinders arithmetically operated by said ignition position arithmetical operation means at a position where the reference position detection pulse for each of said cylinders judged by said reference position detection pulse judgement means is generated and to make the ignition operation in each of said cylinders when the thus arithmetically operated ignition position for each of said cylinders is measured.

10. An internal combustion engine control apparatus as set forth in claim 9 and wherein each of said reluctor on said rotor of said crank shaft sensor is formed so as to have a polar arc angle of 60° and said reference position of each of said cylinders being set at a position advanced by an angle of 65° relative to said top dead center of said compression stroke of each of said cylinders while said low revolution ignition position of each of said cylinders is set at a position advanced by an angle of 5° relative to said top dead center of said compression stroke of each of said cylinders.

11. An internal combustion engine control apparatus to control an ignition system and a fuel injection system for a four cycle three-cylinder internal combustion engine having three cylinders and having a fuel supplied by said fuel injection system having an injector provided for each of said three cylinders when an injection instruction signal is applied to said injector, said control apparatus comprising;

a crank shaft sensor including a rotor rotationally driven by said crank shaft of said internal combustion engine and having three reluctors provided at an angle distance of 120° corresponding to said three cylinders, respectively and a single signal generator to generate pulses of different polarities when said signal generator detects each of said reluctors on said rotor at a front edge and at a rear edge as viewed in the rotational direction, respectively and a relation of position between each of said reluctors on said rotor and said signal generator being set so as to generate a reference position detection pulse and a low revolution ignition position detection pulse when said signal generator detects said front edge and said rear edge of said reluctor corresponding to each of said cylinders at a position advanced relative to said low revolution ignition position of each of said cylinders and at a low revolution ignition position of each of cylinders set near a top dead center in a compression stroke of each of said cylinders, respectively;

a cam shaft sensor mounted on a cam shaft of said internal combustion engine to generate a reference judgement pulse at a set rotary angle position of said cam shaft once per one revolution of said cam shaft;

and a electronic control unit including urgent fuel injection control means to apply said injection instruction signal to said fuel injection system so as to simultaneously start an injection of said fuel from said injectors for all of said cylinders at a position where said signal generator of said crank shaft sensor detects said front edge as viewed in the rotational direction to generate a pulse under the condition of being unable to detect any reference judgement pulse from said cam shaft sensor to inject said fuel from said injectors for a set time, urgent ignition signal supply means to simultaneously make an ignition operation in all of said cylinders at a position where said signal generator of said crank shaft sensor detects said rear edge as viewed in the rotational direction to said crank shaft sensor to generate a pulse under the condition of being unable to detect any reference judgement pulse from said cam shaft sensor, reference position detection pulse judgment means to judge which of said cylinders a series of reference position detection pulses are one detecting the reference position for from a generation order of said series of said reference position detection pulses after said reference judgement pulses are generated when said reference judgement pulses are detected, fuel injection time arithmetical operation means to arithmetically operate a fuel injection time of said injector for each of said cylinders under the predetermined control conditions, ignition position arithmetical operation means to arithmetically operate an ignition position for each of said cylinders under the predetermined control conditions, constant fuel injection control means to start an injection of said fuel from an injector for each of said cylinders at a position where there is generated the reference position detection pulse for each of said cylinders judged by said reference position detection pulse judgment means and to stop said injection of said fuel when said fuel injection time arithmetically operated by said fuel injection arithmetical operation means lapses and constant ignition position control to apply an ignition signal to said ignition system so as to start a measurement of said ignition position of each of said cylinders arithmetically operated by said ignition position arithmetical operation means at a position where there is generated the reference position detection pulse for each of said cylinders judged by said reference position detection pulse judgement means and to make the ignition operation at each of said cylinders when the ignition position for each of said cylinders arithmetically operated by said ignition position arithmetical operation means is measured.

12. An internal combustion engine control apparatus as set forth in claim 11 and wherein each of said reluctor on said rotor of said crank shaft sensor is formed so as to have a polar arc angle of 60° and said reference position of each of said cylinders being set at a position advanced by an angle of 65° relative to said top dead center of said compression stroke of each of said cylinders while said low revolution ignition position of each of said cylinders is set at a position advanced by an angle of 5° relative to said top dead center of said compression stroke of each of said cylinders.

13. An internal combustion engine control apparatus to control an ignition system for a four cycle six-cylinder internal combustion engine having six cylinders, said six cylinders being divided into three cylinder sets, respective one of which includes two cylinders having an ignition position far away from each other by a crank angle of 360° and said control apparatus comprising;

a crank shaft sensor including a rotor rotationally driven by said crank shaft of said internal combustion engine and having three reluctors provided at a distance of 120° angle corresponding to said three cylinder sets, respectively and a single signal generator to generate pulses of different polarities when said signal generator detects each of said reluctors on said rotor at a front edge and at a rear edge as viewed in the rotational direction, respectively and a relation of position between each of said reluctors on said rotor and said signal generator being set so as to generate a reference position detection pulse and a low revolution ignition position detection pulse when said signal generator detects said front edge and said rear edge of said reluctor corresponding to each of said cylinder sets at a reference position advanced relative to a top dead center of a compression stroke of each of said cylinder sets and at a low revolution ignition position of each of cylinder sets set near said top dead center in said compression stroke of each of said cylinder sets, respectively;

a cam shaft sensor mounted on a cam shaft of said internal combustion engine to generate a reference judgement pulse at a set rotary angle position of said cam shaft once per one revolution of said cam shaft;

and an electronic control unit including urgent ignition signal supply means to supply an ignition signal to said ignition system so that an ignition operation is simultaneously made in all of said cylinders when said signal generator of said crank shaft sensor detects said rear edge of each of said reluctors as viewed in the rotational direction to generate said pulse under the condition of being unable to detect any reference judgement pulse from said cam shaft sensor, reference position detection pulse judgement means to judge which of said cylinders a series of reference position detection pulses are one detecting the reference position for from a generation order of said series of said reference position detection pulses after said reference judgement pulses are generated when said reference judgement pulses are detected, ignition position arithmetical operation means to arithmetically operate an ignition position for each of said cylinder sets under predetermined control conditions and constant ignition position control means to apply an ignition signal to said ignition system so as to start a measurement of said ignition position of each of said cylinder sets arithmetically operated by said ignition position arithmetical operation means at a position where there is generated the reference position detection pulse for each of said cylinder sets judged by said reference position detection pulse judgement means and to make the ignition operation at each of said cylinder sets when the thus arithmetically operated ignition position for each of said cylinders is measured.

14. An internal combustion engine control apparatus to control an ignition system and a fuel injection system for a four cycle six-cylinder internal combustion engine having six cylinders and having a fuel supplied by said fuel injection system having an injector provided for each of said three cylinders when an injection instruction signal is applied to said injector, said six cylinders being divided into three cylinder sets, respective one of which includes two cylinders having an ignition position far away from each other at a crank angle of 360° and said control apparatus comprising;

a crank shaft sensor including a rotor rotationally driven by said crank shaft of said internal combustion engine and having three reluctors provided at a distance of 120° angle corresponding to said three cylinder sets, respectively and a single signal generator to generate pulses of different polarities when said signal generator detects each of said reluctors on said rotor at a front edge and at a rear edge as viewed in the rotational direction, respectively and a relation of position between each of said reluctors on said rotor and said signal generator being set so as to generate a reference position detection pulse and a low revolution ignition position detection pulse when said signal generator detects said front edge and said rear edge of said reluctor corresponding to each of said cylinder sets at a reference position advanced relative to a top dead center of a compression stroke of each of said cylinder sets and at a low revolution ignition position of each of cylinder sets set near said top dead center in said compression stroke of each of said cylinder sets, respectively;

a cam shaft sensor mounted on a cam shaft of said internal combustion engine to generate a reference judgement pulse at a set rotary angle position of said cam shaft once per one revolution of said cam shaft;

and an electronic control unit including urgent fuel injection control means to apply said injection instruction signal to said fuel injection system so as to simultaneously start an injection of said fuel from said injectors for all of said cylinders at a position where said signal generator of said crank shaft sensor detects said front edge as viewed in the rotational direction to generate a pulse under the condition of being unable to detect a reference judgement pulse from said cam shaft sensor to inject said fuel from the corresponding injector for a set time, urgent ignition signal supply means to apply said ignition signal to said ignition system so as to simultaneously make an ignition operation in all of said cylinders at a position where said signal generator of said crank shaft sensor detects said rear edge as viewed in the rotational direction to generate a pulse under the condition of being unable to detect any reference judgement pulse from said cam shaft sensor, reference position detection pulse judgment means to judge which of said cylinder sets a series of reference position detection pulses are one detecting the reference position for from a generation order of said series of said reference position detection pulses after said reference judgement pulses are generated when said reference judgement pulses is detected, fuel injection time arithmetical operation means to arithmetically operate a fuel injection time of said injector for each of said cylinders under the predetermined control conditions, ignition position arithmetical operation means to arithmetically operate an ignition position for each of said cylinder sets under the predetermined control conditions, constant fuel injection control means to apply a fuel injection instruction signal to said fuel injection system so as to start an injection of said fuel from an injector for each of said cylinders at a position where there is generated the reference position detection pulse for each of said cylinder sets judged by said reference position detection pulse judgment means and to stop said injection of said fuel when said fuel injection time arithmetically operated by said fuel injection arithmetical operation means lapses and constant ignition position control to apply an ignition signal to said ignition system so as to start a measurement of said ignition position of each of said cylinder sets arithmetically operated by said ignition position arithmetical operation means at a position where there is generated the reference position detection pulse for each of said cylinder sets judged by said reference position detection pulse judgement means and to make the ignition operation at each of said cylinder sets when the ignition position for each of said cylinder sets arithmetically operated by said ignition position arithmetical operation means is measured.

* * * * *